US011020639B2

(12) United States Patent
Golden et al.

(10) Patent No.: US 11,020,639 B2
(45) **Date of Patent: *Jun. 1, 2021**

(54) GOLF CLUB HAVING AN ELASTOMER ELEMENT FOR BALL SPEED CONTROL

(71) Applicant: Acushnet Company, Fairhaven, MA (US)

(72) Inventors: Charles E. Golden, Encinitas, CA (US); John Morin, The Woodlands, TX (US); Oswaldo Gonzalez, San Jacinto, CA (US); Jonathan Hebreo, San Diego, CA (US); Marni D. Ines, San Marcos, CA (US); Gery M. Zimmerman, Fallbrook, CA (US); Jason A. Mata, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/833,054

(22) Filed: Mar. 27, 2020

(65) Prior Publication Data

US 2020/0222767 A1 Jul. 16, 2020

Related U.S. Application Data

(63) Continuation-in-part of application No. 16/286,412, filed on Feb. 26, 2019, now Pat. No. 10,625,127, (Continued)

(51) Int. Cl.
*A63B 53/04* (2015.01)

(52) U.S. Cl.
CPC ..... *A63B 53/0475* (2013.01); *A63B 53/0408* (2020.08); *A63B 53/0445* (2020.08)

(58) Field of Classification Search
CPC ..... A63B 53/0475; A63B 53/0408; A63B 53/0445; A63B 60/54; A63B 53/047
(Continued)

(56) References Cited

U.S. PATENT DOCUMENTS 1,133,129 A 3/1915 Govan
2,111,249 A 3/1938 Plese
(Continued)

FOREIGN PATENT DOCUMENTS

JP H11-192329 5/2001
JP 2001-170222 6/2001
(Continued)

*Primary Examiner* — Sebastiano Passaniti
(74) *Attorney, Agent, or Firm* — Kevin N. McCoy

(57) ABSTRACT

A golf club head including a club head body including a back portion and a striking face, wherein the striking face comprises a front surface configured to strike a golf ball and a rear surface opposite the front surface, wherein the back portion is spaced from the rear surface, a first deformable member residing between the back portion and the rear surface of the striking face, wherein the first deformable member comprises a front surface in contact with the rear surface of the striking face, and a second deformable member residing between the back portion and the rear surface of the striking face, wherein the second deformable member comprises a front surface in contact with the rear surface of the striking face, wherein the first deformable member has a greater Shore A durometer than the second deformable member.

19 Claims, 38 Drawing Sheets

Related U.S. Application Data which is a continuation-in-part of application No. 16/225,577, filed on Dec. 19, 2018, now abandoned, which is a continuation-in-part of application No. 16/158,578, filed on Oct. 12, 2018, now Pat. No. 10,293,226, which is a continuation-in-part of application No. 16/027,077, filed on Jul. 3, 2018, now abandoned, which is a continuation-in-part of application No. 15/220,122, filed on Jul. 26, 2016, now Pat. No. 10,086,244.

(58) Field of Classification Search
USPC ..... 473/324–350, 287–292
See application file for complete search history.

(56) References Cited

U.S. PATENT DOCUMENTS 3,817,522 A 6/1974 Simmons
4,195,842 A 4/1980 Coleman
4,398,965 A 8/1983 Campau
4,754,977 A 7/1988 Sahm
4,826,172 A 5/1989 Antonious
4,938,470 A 7/1990 Antonious
5,121,922 A 6/1992 Harsh, Sr.
5,184,823 A 2/1993 Desboilles
5,261,664 A 11/1993 Anderson
5,290,032 A 3/1994 Fenton
5,328,184 A 7/1994 Antonious
5,346,213 A 9/1994 Yamada
5,398,929 A 3/1995 Kitaichi
5,403,007 A 4/1995 Chen
5,464,211 A 11/1995 Atkins, Sr.
5,492,327 A 2/1996 Biafore, Jr.
5,499,814 A 3/1996 Lu
5,505,453 A 4/1996 MacK
5,529,543 A * 6/1996 Beaumont, Sr. ..... A63B 60/00 473/290
5,547,194 A 8/1996 Aizawa
5,628,697 A 5/1997 Gamble
5,669,829 A 9/1997 Lin
5,697,855 A * 12/1997 Aizawa ..... A63B 53/04 473/350
5,888,148 A 3/1999 Allen
5,890,973 A 4/1999 Gamble
5,899,821 A 5/1999 Hsu
6,001,030 A * 12/1999 Delaney ..... A63B 53/0487 473/329
6,015,354 A 1/2000 Ahn
6,165,081 A 12/2000 Chou
6,299,547 B1 10/2001 Kosmatka
6,299,549 B1 10/2001 Shieh
6,364,789 B1 4/2002 Kosmatka
6,595,870 B2 7/2003 Stites
6,695,715 B1 2/2004 Chikaraishi
6,832,961 B2 12/2004 Sano
6,855,066 B2 2/2005 Best
6,902,495 B2 6/2005 Pergande
6,921,344 B2 * 7/2005 Gilbert ..... A63B 60/00 473/334
6,964,620 B2 11/2005 Gilbert
6,991,559 B2 1/2006 Yabu
7,056,229 B2 6/2006 Chen
7,096,558 B2 8/2006 Sano
7,140,977 B2 11/2006 Atkins, Sr.
7,160,204 B2 1/2007 Huang
7,211,006 B2 5/2007 Chang
7,247,104 B2 7/2007 Poynor
7,371,190 B2 5/2008 Gilbert
7,559,853 B2 7/2009 Hirano
7,575,523 B2 8/2009 Yokota
7,582,024 B2 9/2009 Shear
7,588,503 B2 9/2009 Roach
7,597,633 B2 10/2009 Shimazaki
7,604,550 B1 10/2009 Currie
7,686,706 B2 3/2010 Matsunaga
7,713,141 B2 5/2010 Yamamoto
7,749,100 B2 7/2010 Tavares
7,785,212 B2 * 8/2010 Lukasiewicz, Jr. ..... A63B 53/0466 473/332
7,798,913 B2 9/2010 Noble
7,871,338 B2 * 1/2011 Nakano ..... A63B 60/00 473/332
7,935,000 B2 5/2011 Stites
7,967,700 B2 6/2011 Stites
8,088,025 B2 1/2012 Wahl
8,157,673 B2 4/2012 Gilbert
8,187,116 B2 5/2012 Boyd
8,210,961 B2 7/2012 Finn
8,210,965 B2 7/2012 Roach
8,267,807 B2 9/2012 Takechi
8,277,337 B2 * 10/2012 Shimazaki ..... A63B 53/04 473/350
8,328,663 B2 12/2012 Wahl
8,353,784 B2 1/2013 Boyd
8,403,771 B1 3/2013 Rice
8,403,774 B2 3/2013 Stites
8,517,863 B2 8/2013 Wahl
8,562,652 B2 10/2013 Biedermann
8,608,585 B2 12/2013 Stites
8,753,219 B2 6/2014 Gilbert
8,753,228 B2 6/2014 Golden
8,758,159 B2 6/2014 Morin
8,814,725 B2 8/2014 Wahl
8,821,307 B2 9/2014 Park
9,259,629 B2 * 2/2016 Gilbert ..... A63B 53/0475
9,265,995 B2 2/2016 Wahl
9,457,241 B2 10/2016 Hebreo
9,597,562 B2 3/2017 Dipert
10,086,244 B2 10/2018 Morin
10,293,226 B2 * 5/2019 Hebreo ..... A63B 53/047
10,625,127 B2 * 4/2020 Golden ..... A63B 60/52
2003/0092502 A1 * 5/2003 Pergande ..... A63B 53/08 473/332
2003/0190975 A1 10/2003 Fagot
2005/0107183 A1 * 5/2005 Takeda ..... A63B 53/047 473/326
2005/0277485 A1 12/2005 Hou
2007/0026961 A1 2/2007 Hou
2007/0135233 A1 7/2007 Perras
2008/0004131 A1 1/2008 Lin
2008/0305888 A1 * 12/2008 Tseng ..... A63B 53/0475 473/332
2009/0163295 A1 6/2009 Tseng
2010/0056297 A1 3/2010 Roach
2010/0273565 A1 10/2010 Stites
2011/0124432 A1 5/2011 Oldknow
2011/0250985 A1 10/2011 Stites
2012/0064997 A1 3/2012 Sato
2015/0165280 A1 6/2015 Hebreo
2015/0343281 A1 12/2015 Ban
2017/0144037 A1 5/2017 Dipert

FOREIGN PATENT DOCUMENTS

JP 2006-000139 A 1/2006
JP 2007-21171 1/2007
JP 2009-61317 3/2009
JP 2015-517882 6/2015

* cited by examiner

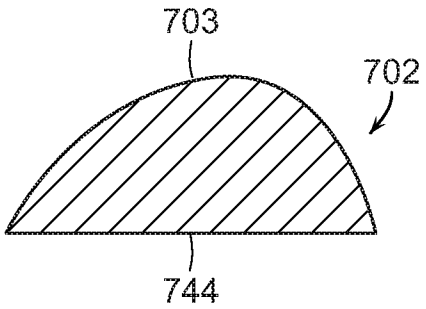
FIG. 14G
FIG. 14H
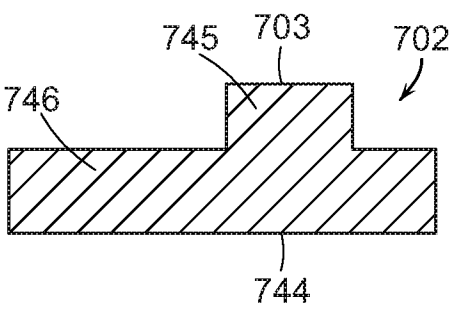
FIG. 14I
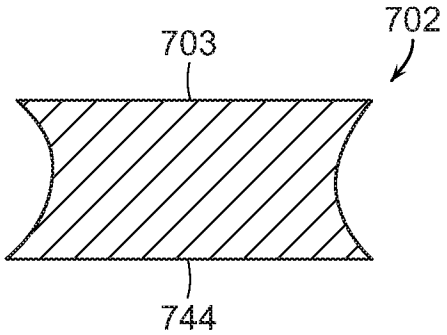
FIG. 14J
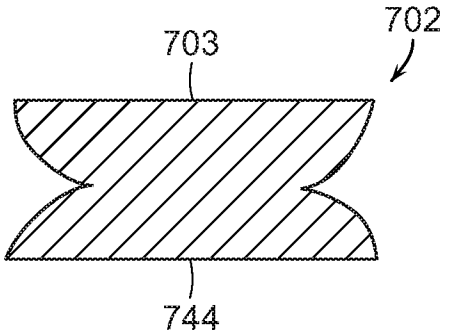
FIG. 14K
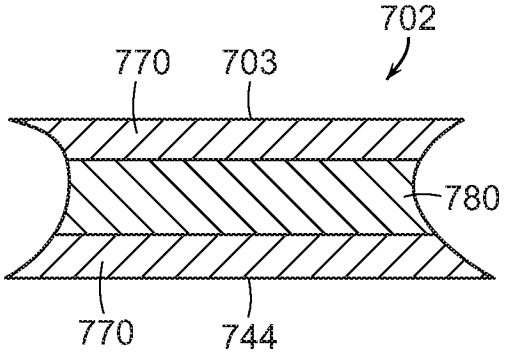
FIG. 14L

GOLF CLUB HAVING AN ELASTOMER ELEMENT FOR BALL SPEED CONTROL

RELATED APPLICATIONS

This application is a continuation-in-part of application Ser. No. 16/286,412, filed Feb. 26, 2019, which is a continuation-in-part of application Ser. No. 16/225,577, filed Dec. 19, 2018, which is a continuation-in-part of application Ser. No. 16/158,578, filed Oct. 12, 2018, now U.S. Pat. No. 10,293,226, which is a continuation-in-part of application Ser. No. 16/027,077, filed Jul. 3, 2018, which is a continuation-in-part of application Ser. No. 15/220,122, filed Jul. 26, 2016, now U.S. Pat. No. 10,086,244, which are hereby incorporated by reference in their entirety. To the extent appropriate, the present application claims priority to the above-referenced applications.

BACKGROUND

It is a goal for golfers to reduce the total number of swings needed to complete a round of golf, thus reducing their total score. To achieve that goal, it is generally desirable to for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club.

SUMMARY

One non-limiting embodiment of the present technology includes a golf club head including a club head body including a back portion and a striking face; wherein the striking face comprises a front surface configured to strike a golf ball and a rear surface opposite the front surface; wherein the back portion is spaced from the rear surface; a first deformable member residing between the back portion and the rear surface of the striking face; wherein the first deformable member comprises a front surface in contact with the rear surface of the striking face and a rear surface in contact with the back portion; and a second deformable member residing between the back portion and the rear surface of the striking face; wherein the second deformable member comprises a front surface in contact with the rear surface of the striking face and a rear surface in contact with the back portion; and a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, wherein the striking face comprises a plurality of scorelines, wherein the striking face comprises a heel reference plane extending parallel to the y-axis and the-x-axis, wherein the heel reference plane is offset 1 millimeter towards the heel from a heel-most extent of the scorelines, wherein the striking face comprises a striking face length measured from the heel reference plane to a toe-most extent of the front surface of the striking face parallel to the x-axis; wherein the rear surface of the striking face comprises a first supported region, wherein a perimeter of the front surface of the first deformable member defines the first supported region, wherein the first supported region comprises a first geometric center, wherein the first geometric center of the first supported region is located a first supported region offset length toward from the heel reference plane measured parallel to the x-axis; wherein the rear surface of the striking face comprises a second supported region, wherein a perimeter of the front surface of the second deformable member defines the second supported region, wherein the second supported region comprises a second geometric center, wherein the second geometric center of the second supported region is located a second supported region offset length toeward from the heel reference plane measured parallel to the x-axis; wherein the first supported region offset length divided by the second supported region offset length is greater than 1.0.

In an additional non-limiting embodiment of the present technology the first supported region offset length divided by the second supported region offset length is greater than 1.5.

In an additional non-limiting embodiment of the present technology the first supported region offset length divided by the second supported region offset length is greater than 2.0.

In an additional non-limiting embodiment of the present technology at least a portion of the striking face comprises a thickness of less than or equal to 2.2 mm.

In an additional non-limiting embodiment of the present technology the front surface of the first deformable member is circular having a front diameter, wherein the rear surface of the first deformable member is circular having a rear diameter, wherein the front diameter is less than the rear diameter and wherein the front surface of the second deformable member is circular having a front diameter, wherein the rear surface of the second deformable member is circular having a rear diameter, wherein the front diameter is less than the rear diameter.

In an additional non-limiting embodiment of the present technology the first deformable member has a greater Shore A durometer than the second deformable member.

In an additional non-limiting embodiment of the present technology the striking face comprises a first density, wherein the back portion comprises a back cover, wherein the back cover comprises a recess, wherein the second deformable member is at least partially retained within the recess, wherein the back cover comprises a second density, wherein the first density is greater than the second density.

In an additional non-limiting embodiment of the present technology the center of gravity of the golf club head is located less than or equal to 20 millimeters above the ground plane, measured parallel to the y-axis, and wherein the golf club head comprises an MOI-Y greater than or equal to 250 kg-mm$^2$.

One non-limiting embodiment of the present technology includes a golf club head including a club head body including a back portion and a striking face; wherein the striking face comprises a front surface configured to strike a golf ball and a rear surface opposite the front surface; wherein the back portion is spaced from the rear surface; a first deformable member residing between the back portion and the rear surface of the striking face; wherein the first deformable member comprises a front surface in contact with the rear surface of the striking face; and a second deformable member residing between the back portion and the rear surface of the striking face; wherein the second deformable member comprises a front surface in contact with the rear surface of the striking face; wherein the first deformable member has a greater Shore A durometer than the second deformable member.

In an additional non-limiting embodiment of the present technology the striking face comprises a first density, wherein the back portion comprises a back cover, wherein the back cover comprises a recess, wherein the second deformable member is at least partially retained within the recess, wherein the back cover comprises a second density, wherein the first density is greater than the second density.

In an additional non-limiting embodiment of the present technology at least a portion of the striking face comprises a thickness of less than or equal to 2.2 mm.

In an additional non-limiting embodiment of the present technology the front surface of the first deformable member is circular having a front diameter, wherein the rear surface of the first deformable member is circular having a rear diameter, wherein the front diameter is less than the rear diameter, wherein the front surface of the second deformable member is circular having a front diameter, wherein the rear surface of the second deformable member is circular having a rear diameter, wherein the front diameter is less than the rear diameter.

In an additional non-limiting embodiment of the present technology the golf club head comprises an interior cavity formed between the back portion and the striking face, wherein an aperture is formed through the back portion, an adjustment driver residing within the aperture, the adjustment driver including a recess adjacent the interior cavity, wherein at least a portion of the first deformable member resides within the recess, wherein the back portion comprises a shelf surrounding the aperture and wherein the adjustment driver comprises a flange, the flange in contact with the shelf.

An additional non-limiting embodiment of the present technology further includes a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, wherein the striking face comprises a plurality of scorelines, wherein the striking face comprises a heel reference plane extending parallel to the y-axis and the-x-axis, wherein the heel reference plane is offset 1 millimeter towards the heel from a heel-most extent of the scorelines, wherein the striking face comprises a striking face length measured from the heel reference plane to a toe-most extent of the front surface of the striking face parallel to the x-axis, wherein the rear surface of the striking face comprises a first supported region, wherein a perimeter of the front surface of the first deformable member defines the first supported region, wherein the first supported region comprises a first geometric center, wherein the first geometric center of the first supported region is located a first supported region offset length toeward from the heel reference plane measured parallel to the x-axis, wherein the rear surface of the striking face comprises a second supported region, wherein a perimeter of the front surface of the second deformable member defines the second supported region, wherein the second supported region comprises a second geometric center, wherein the second geometric center of the second supported region is located a second supported region offset length toeward from the heel reference plane measured parallel to the x-axis, wherein the first supported region offset length divided by the second supported region offset length is greater than 1.5.

One non-limiting embodiment of the present technology includes a golf club head including a club head body including a back portion and a striking face; wherein the striking face comprises a front surface configured to strike a golf ball and a rear surface opposite the front surface; wherein the back portion is spaced from the rear surface; a first deformable member residing between the back portion and the rear surface of the striking face; wherein the first deformable member comprises a front surface in contact with the rear surface of the striking face; and a second deformable member residing between the back portion and the rear surface of the striking face; wherein the second deformable member comprises a front surface in contact with the rear surface of the striking face; wherein the back portion comprises a back cover; wherein the back cover comprises a recess; and wherein the second deformable member is at least partially retained within the recess.

In an additional non-limiting embodiment of the present technology the striking face comprises a first density, wherein the back cover comprises a second density, wherein the first density is greater than the second density.

In an additional non-limiting embodiment of the present technology the first deformable member has a greater Shore A durometer than the second deformable member.

In an additional non-limiting embodiment of the present technology at least a portion of the striking face comprises a thickness of less than or equal to 2.2 mm.

In an additional non-limiting embodiment of the present technology the front surface of the first deformable member is circular having a front diameter, wherein the rear surface of the first deformable member is circular having a rear diameter, wherein the front diameter is less than the rear diameter, wherein the front surface of the second deformable member is circular having a front diameter, wherein the rear surface of the second deformable member is circular having a rear diameter, wherein the front diameter is less than the rear diameter.

In an additional non-limiting embodiment of the present technology the golf club head comprises an interior cavity formed between the back portion and the striking face, wherein an aperture is formed through the back portion, an adjustment driver residing within the aperture, the adjustment driver including a recess adjacent the interior cavity, wherein at least a portion of the first deformable member resides within the recess, wherein the back portion comprises a shelf surrounding the aperture and wherein the adjustment driver comprises a flange, the flange in contact with the shelf.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 14G illustrates a cross sectional view of an elastomer element similar to that of FIG. 14A but the center of the front portion is offset from a center of the rear portion.

FIG. 14H illustrates a cross sectional view of an elastomer element similar to that of FIG. 14B but the center of the front portion is offset from a center of the rear portion.

FIG. 14I illustrates a cross sectional view of an elastomer element similar to that of FIG. 14C but the center of the front portion is offset from a center of the rear portion.

FIG. 14J illustrates a cross sectional view of an elastomer element which necks down in diameter between the front portion and the rear portion.

FIG. 14K illustrates a cross sectional view of an elastomer element which necks down in diameter between the front portion and the rear portion.

FIG. 14L illustrates a cross sectional view of an elastomer element similar to that of FIG. 14J but includes a first material and a second material.

DETAILED DESCRIPTION

The technologies described herein contemplate an iron-type golf club head that incorporates an elastomer element to promote more uniform ball speed across the striking face of the golf club. Traditional thin-faced iron-type golf clubs generally produce less uniform launch velocities across the striking face due to increased compliance at the geometric center of the striking face. For example, when a golf club strikes a golf ball, the striking face of the club deflects and then springs forward, accelerating the golf ball off the striking face. While such a design may lead to large flight distances for a golf ball when struck in the center of the face, any off-center strike of golf ball causes significant losses in flight distance of the golf ball. In comparison, an extremely thick face causes more uniform ball flight regardless of impact location, but a significant loss in launch velocities. The present technology incorporates an elastomer element between a back portion of the hollow iron and the rear surface of the striking face. By including the elastomer element, the magnitude of the launch velocity may be reduced for strikes at the center of the face while improving uniformity of launch velocities across the striking face. In some examples, the compression of the elastomer element between the back portion and the striking face may also be adjustable to allow for a golfer or golf club fitting professional to alter the deflection of the striking face when striking a golf ball.

Figure 1B:
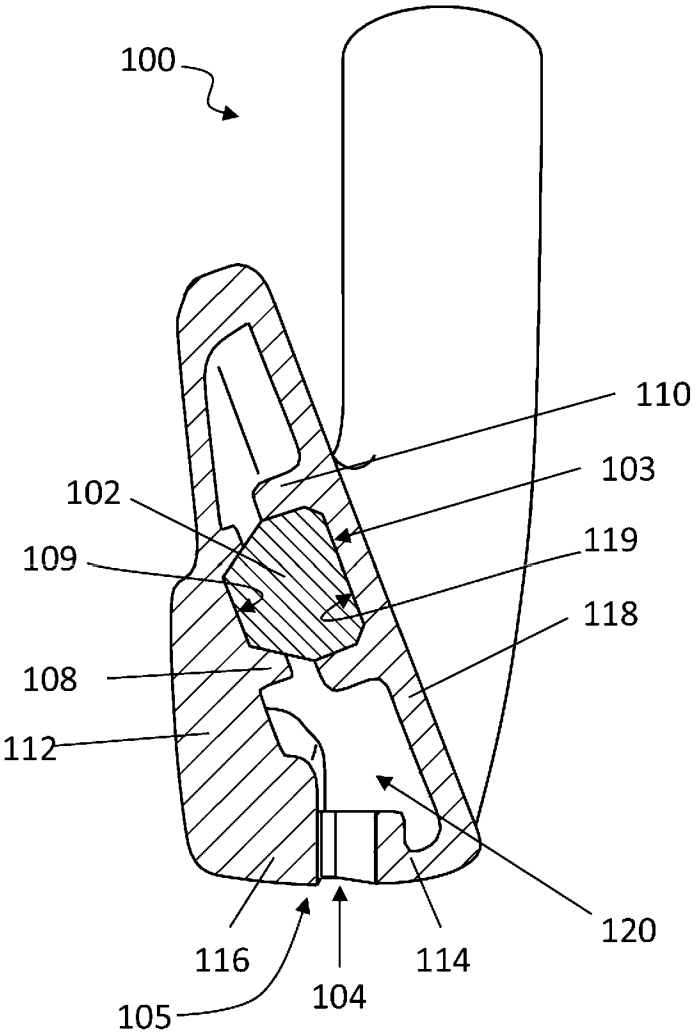
FIGS. 1A-1B depict section views of a golf club head having an elastomer element.
Figure 1A:
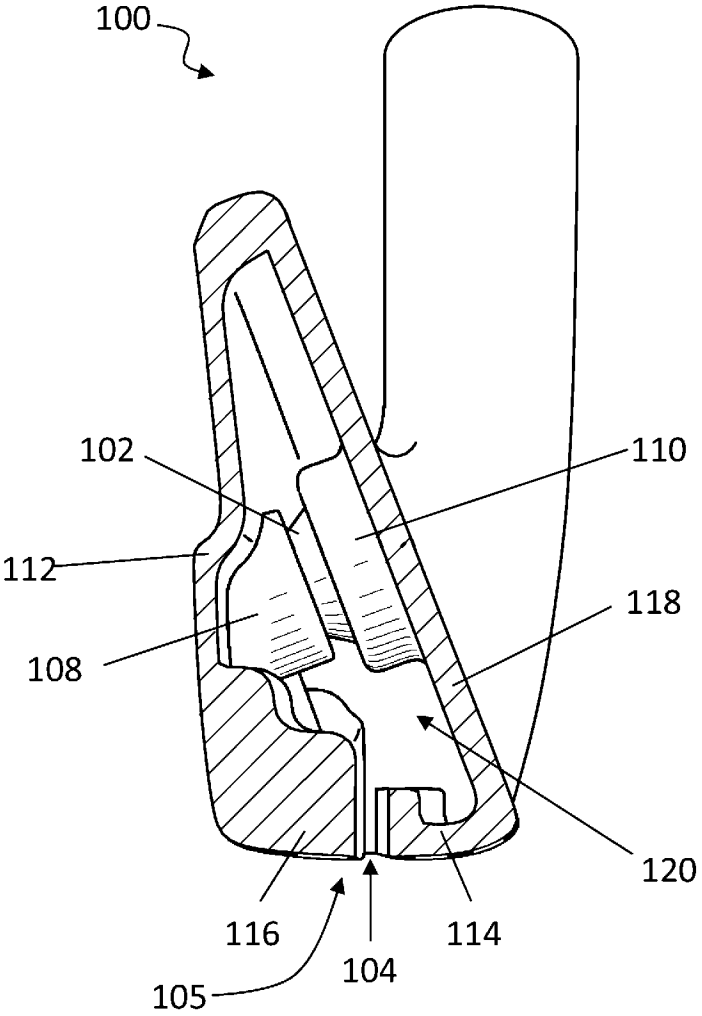
Figure 1C:
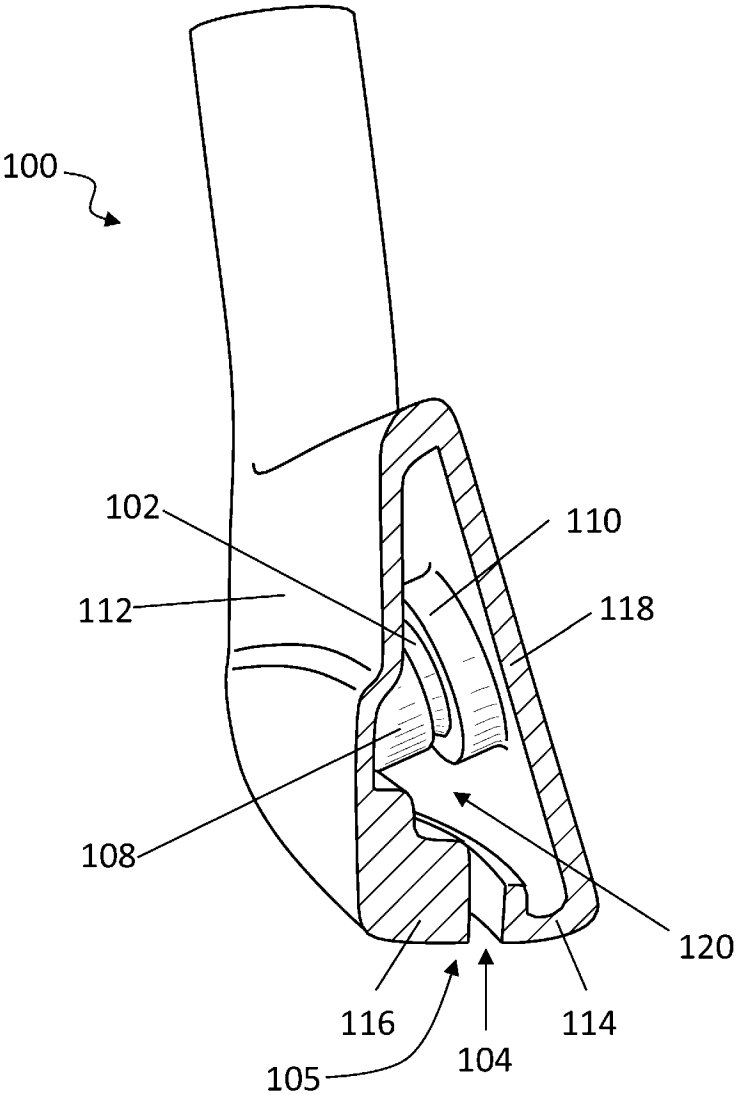
FIG. 1C depicts a perspective section view of the golf club head depicted in FIGS. 1A-1B.

FIGS. 1A-1B depict section views depict section views of a golf club head 100 having an elastomer element 102. FIG. 1C depicts a perspective section view of the golf club head 100. FIGS. 1A-1C are described concurrently. The club head 100 includes a striking face 118 and a back portion 112. A cavity 120 is formed between the striking face 118 and the back portion 112. An elastomer element 102 is disposed in the cavity 120 between the striking face 118 and the back portion 112. A rear portion of the elastomer element 102 is held in place by a cradle 108. The cradle 108 is attached to the back portion 112 of the golf club head 100, and the cradle 108 includes a recess 109 to receive the rear portion of the elastomer element 102. The lip of the cradle 108 prevents the elastomer element 102 from sliding or otherwise moving out of position. The elastomer element 102 may have a generally frustoconical shape, as shown in FIGS. 1A-1B.

In other examples, the elastomer element 102 may have a cylindrical, spherical, cuboid, or prism shape. The recess 109 of the cradle 108 is formed to substantially match the shape of the rear portion of the elastomer element 102. For example, with the frustoconical elastomer element 102, the recess 109 of the cradle 108 is also frustoconical such that the surface of the rear portion of the elastomer element 102 is in contact with the interior walls of the recess 109 of the cradle 108. The cradle 108 may be welded or otherwise attached onto the back portion 112, or the cradle 108 may be formed as part of the back portion 112 during a casting or forging process. The back portion 112 may also be machined to include the cradle 108.

A front portion 103 of the elastomer element 102 contacts the rear surface 119 of the striking face 118. The front portion 103 of the elastomer element 102 may be held in place on the rear surface 119 of the striking face 118 by a securing structure, such as flange 110. The flange 110 protrudes from the rear surface 119 of the striking face 118 into the cavity 120. The flange 110 receives the front portion 103 of the elastomer element 102 to substantially prevent the elastomer element 102 from sliding along the rear surface 119 of the striking face 118. The flange 110 may partially or completely surround the front portion 103 of the elastomer element 102. Similar to the cradle 108, the flange 110 may be shaped to match the shape of the front portion 103 of the elastomer element 102 such that the surface of the front portion 103 of the elastomer element 102 is in contact with the interior surfaces of the flange 110. The flange 110 may be welded or otherwise attached to the rear surface 119 of the striking face 118. The flange 110 may also be cast or forged during the formation of the striking face 118. For instance, where the striking face 118 is a face insert, the flange 110 may be incorporated during the casting or forging process to make the face insert. In another example, the flange 110 and the striking face 118 may be machined from a thicker face plate. Alternative securing structures other than the flange 110 may also be used. For instance, two or more posts may be included on rear surface 119 of the striking face 118 around the perimeter of the front portion 103 of the elastomer element 102. As another example, an adhesive may be used to secure the elastomer element 102 to the rear surface 119 of the striking face 118. In other embodiments, no securing structure is utilized and the elastomer element 102 is generally held in place due to the compression of the elastomer element 102 between the cradle 108 and the rear surface 119 of the striking face 118.

In the example depicted in FIGS. 1A-1C, the elastomer element 102 is disposed behind the approximate geometric center of the striking face 118. In traditional thin face golf clubs, strikes at the geometric center of the striking face 118 display the largest displacement of the striking face 118, and thus the greatest ball speeds. By disposing the elastomer 102 at the geometric center of the striking face 118, the deflection of the striking face 118 at that point is reduced, thus reducing the ball speed. Portions of the striking face 118 not backed by the elastomer element 102, however, continue to deflect into the cavity 120 contributing to the speed of the golf ball. As such, a more uniform distribution of ball speeds resulting from ball strikes across the striking face 118 from the heel to the toe may be achieved. In other examples, the elastomer element 102 may be disposed at other locations within the club head 100.

The elasticity of the elastomer element 102 also affects the deflection of the striking face 118. For instance, a material with a lower elastic modulus allows for further deflection of the striking face 118, providing for higher maximum ball speeds but less uniformity of ball speeds. In contrast, a material with a higher elastic modulus further prevents deflection of the striking face 118, providing for lower maximum ball speeds but more uniformity of ball speeds. Different types of materials are discussed in further detail below with reference to Tables 2-3.

The golf club head 100 also includes a sole 105 having a sole channel 104 in between a front sole portion 114 and a rear sole portion 116. The sole channel 104 extends along the sole 105 of the golf club head 100 from a point near the heel to a point near the toe thereof. While depicted as being a hollow channel, the sole channel 104 may be filled or spanned by a plastic, rubber, polymer, or other material to prevent debris from entering the cavity 120. The sole channel 104 allows for additional deflection of the lower portion of the striking face 118. By allowing for further deflection of the lower portion of the striking face 118, increased ball speeds are achieved from ball strikes at lower portions of the striking face 118, such as ball strikes off the turf. Accordingly, the elastomer element 102 and the sole channel 104 in combination with one another provide for increased flight distance of a golf ball for turf strikes along with more uniform ball speeds across the striking face 118.

Figure 2B:
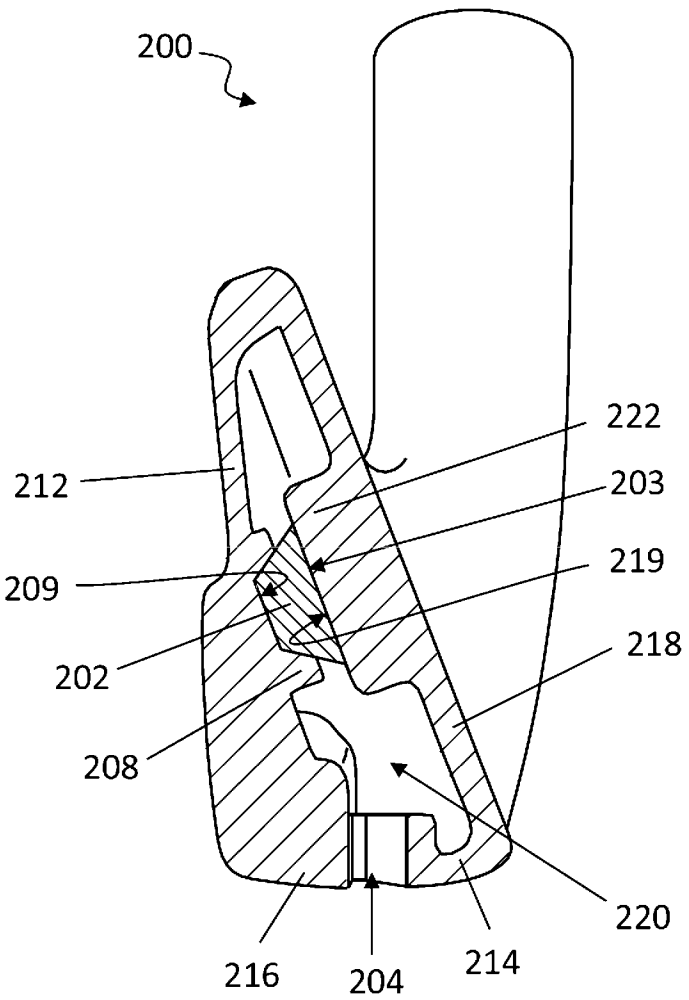
FIGS. 2A-2B depict section views of a golf club head having an elastomer element and a striking face with a thickened center portion.
Figure 2A:
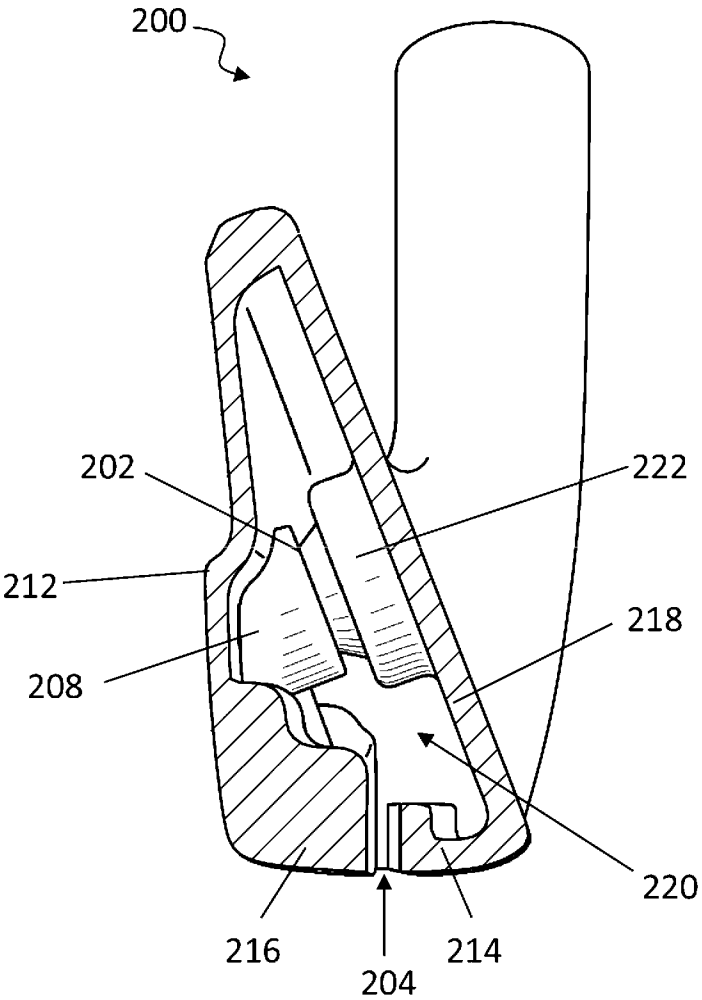

FIGS. 2A-2B depict sections views of a golf club head 200 having an elastomer element 202 and a striking face 218 with a thickened center portion 222. Golf club head 200 is similar to golf club head 100 discussed above with reference to FIGS. 1A-1C, except a thickened portion 222 of the striking face 218 is utilized rather than a flange 110. The thickened portion 222 of the striking face 218 protrudes into the cavity 220. The front portion 203 of the elastomer element 202 contacts the rear surface 219 of the thickened portion 222. The rear portion of the elastomer element 202 is received by a recess 209 in a cradle 208, which is attached to the back portion 212 and substantially similar to the cradle 108 discussed above with reference to FIGS. 1A-1C. Due the thickened portion 222 of the striking face 218, the elastomer element 202 may be shorter in length than the elastomer element 102 in FIGS. 1A-1C. The golf club head 200 also includes a sole channel 204 disposed between a front sole portion 214 and a rear sole portion 216. The sole channel 204 also provides benefits similar to that of sole channel 104 described in FIGS. 1A-1C and may also be filled with or spanned by a material.

Figure 3B:
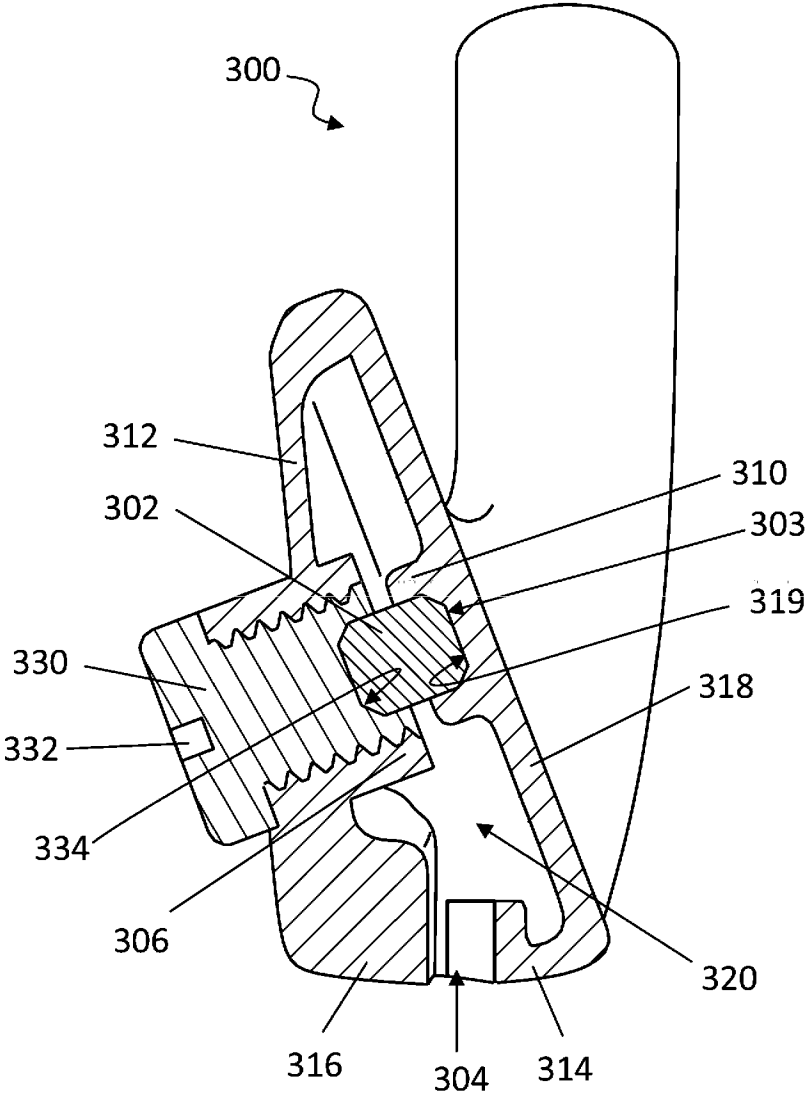
FIGS. 3A-3B depict section views of a golf club head having an elastomer element and an adjustment mechanism to adjust the compression of the elastomer element.
Figure 3A:
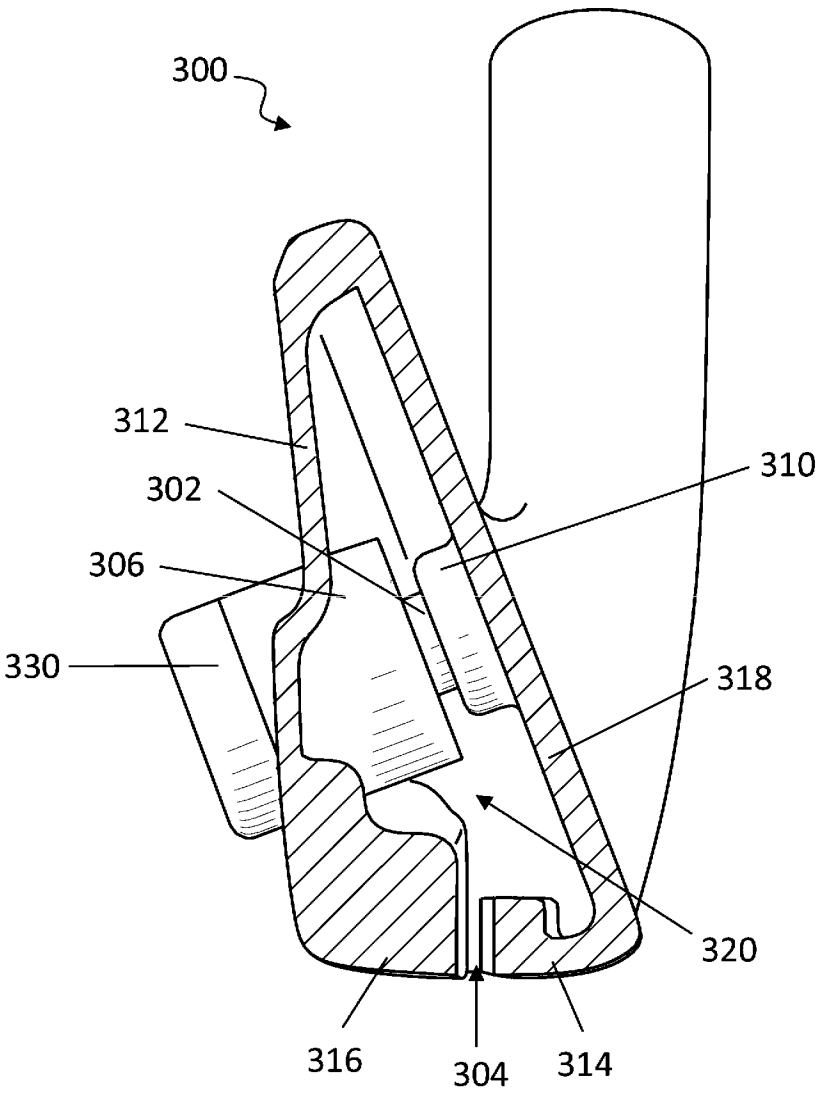

FIGS. 3A-3B depict section views of a golf club head 300 having an elastomer element 302 and an adjustment mechanism to adjust the compression of the elastomer element 302. The golf club head 300 includes a striking face 318 and a back portion 312, and a cavity 320 is formed between the back portion 312 and the striking face 318. Similar to the golf club head 100 described above with reference to FIGS. 1A-1C, a flange 310 is disposed on the rear surface 319 of the striking face 318, and the flange 310 receives the front portion 303 of the elastomer element 302. In the example depicted in FIGS. 3A-3B, the elastomer element 302 has a generally cylindrical shape. In other examples, however, the elastomer element 302 may have a conical, frustoconical, spherical, cuboid, or prism shape.

The golf club head 300 also includes an adjustment mechanism. The adjustment mechanism is configured to adjust the compression of the elastomer element 302 against the rear surface 319 of the striking face 318. In the embodiment depicted in FIGS. 3A-3B, the adjustment mechanism includes an adjustment receiver 306 and an adjustment driver 330. The adjustment receiver 306 may be a structure with a through-hole into the cavity 320, and the adjustment driver 330 may be a threaded element or screw, as depicted. The through-hole of the adjustment receiver 306 includes a threaded interior surface for receiving the threaded element 330. The adjustment receiver 306 may be formed as part of the forging or casting process of the back portion 312 or may also be machined and tapped following the forging and casting process. The threaded element 330 includes an interface 334, such as a recess, that contacts or receives a rear portion of the elastomer element 302. The threaded element 330 also includes a screw drive 332 that is at least partially external to the golf club head 300 such that a golfer can access the screw drive 332. When the threaded element 330 is turned via screw drive 332, such as by a screwdriver, Allen wrench, or torque wrench, the threaded element 330 moves further into or out of the cavity 320. In some examples, the interface 334 that contacts or receives the rear portion of the elastomer element 302 may be lubricated so as to prevent twisting or spinning of the elastomer element 302 when the threaded element 330 is turned. As the threaded element 330 moves further into the cavity 320, the compression of the elastomer element 302 against the rear surface 319 of the striking face 318 increases, thus altering a performance of the elastomer element 302.

A higher compression of the elastomer element 302 against the rear surface 319 of the striking face 318 further restricts the deflection of the striking face 318. In turn, further restriction of the deflection causes more uniform ball speeds across the striking face 318. However, the restriction on deflection also lowers the maximum ball speed from the center of the striking face 318. By making the compression of the elastomer element 302 adjustable with the adjustment mechanism, the golfer or a golf-club-fitting professional may adjust the compression to fit the particular needs of the golfer. For example, a golfer that desires further maximum distance, but does not need uniform ball speed across the striking face 318, can reduce the initial set compression of the elastomer element 302 by loosening the threaded element 330. In contrast, a golfer that desires uniform ball speed across the striking face 318 can tighten the threaded element 330 to increase the initial set compression of the elastomer element 302.

While the adjustment mechanism is depicted as including a threaded element 330 and a threaded through-hole in FIGS. 3A-3B, other adjustment mechanisms could be used to adjust the compression of the elastomer element 302 against the rear surface 319 of the striking face 318. For instance, the adjustment mechanism may include a lever where rotation of the lever alters the compression of the elastomer element 302. The adjustment mechanism may also include a button that may be depressed to directly increase the compression of the elastomer element 302. Other types of adjustment mechanisms may also be used.

The golf club head 300 also includes a sole channel 304 between a front sole portion 314 and a rear sole portion 316, similar to the sole channel 104 discussed above with reference to FIGS. 1A-1C. The sole channel 304 also provides benefits similar to that of sole channel 104 and may also be filled with or spanned by a material.

The golf club head 300 may also be created or sold as a kit. In the example depicted where the adjustment mechanism is a threaded element 330, such as a screw, the kit may include a plurality of threaded elements 330. Each of the threaded elements 330 may have a different weight, such that the golfer can select the desired weight. For example, one golfer may prefer an overall lighter weight for the head of an iron, while another golfer may prefer a heavier weight. The plurality of threaded elements 330 may also each have different weight distributions. For instance, different threaded elements 330 may be configured so as to distribute, as desired, the weight of each threaded element 330 along a length thereof. The plurality of threaded elements 330 may also have differing lengths. By having differing lengths, each threaded elements 330 may have a maximum compression that it can apply to the elastomer element 302. For instance, a shorter threaded elements 330 may not be able to apply as much force onto the elastomer element 302 as a longer threaded elements 330, depending on the configuration of the adjustment receiver 306. The kit may also include a torque wrench for installing the threaded elements 330 into the adjustment receiver 306. The torque wrench may include preset settings corresponding to different compression or performance levels.

Figure 4B:
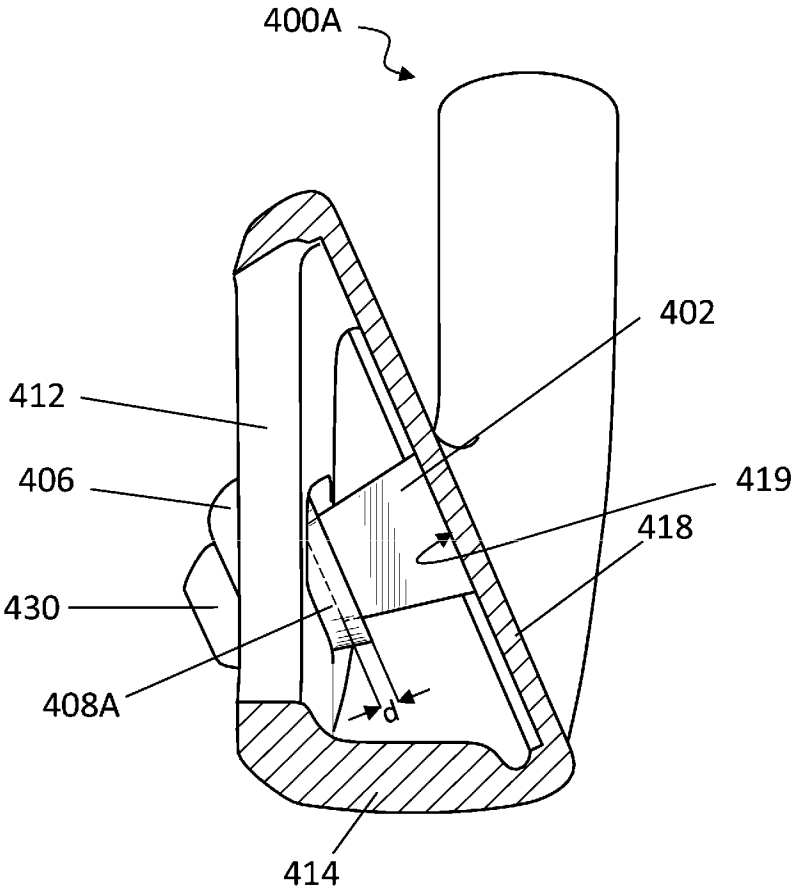
FIG. 4B depicts a section view of the golf club head of FIG. 4A.
Figure 4A:
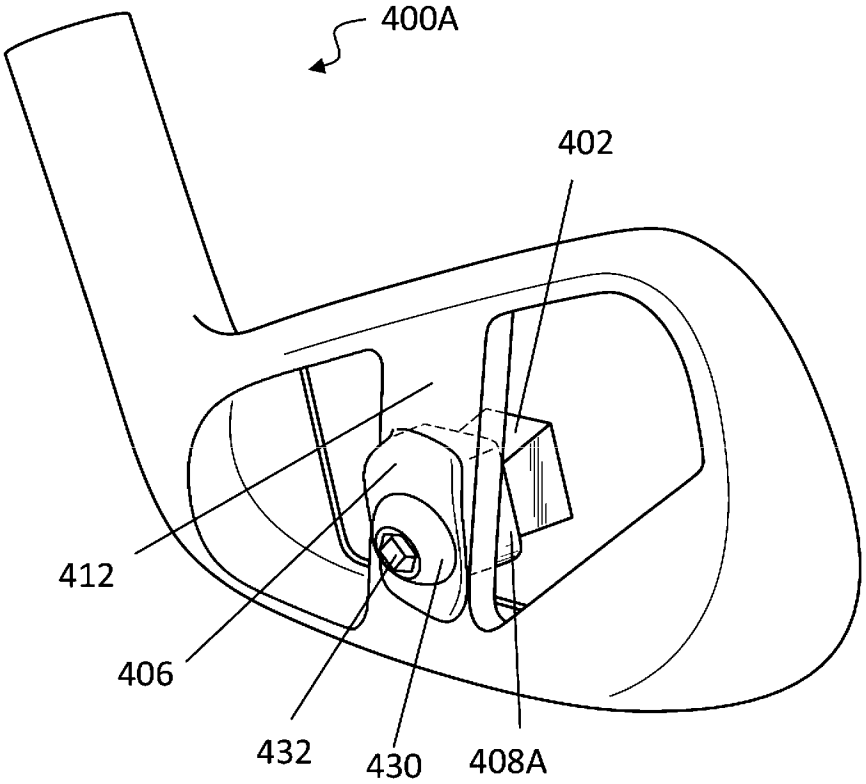
FIG. 4A depicts a perspective view of another example of a golf club head having an elastomer element and an adjustment mechanism to adjust the compression of the elastomer element.

FIG. 4A depicts a perspective view of another example of a golf club head 400A having an elastomer element 402 and an adjustment mechanism to adjust the compression of the elastomer element 402. FIG. 4B depicts a section view of the golf club head 400A. The golf club 400A includes striking face 418 and a back portion 412 with a cavity 420 formed there between. Like the adjustment mechanism in FIGS. 3A-3B, the adjustment mechanism in golf club head 400A includes an adjustment receiver 406 and an adjustment driver 430. In the example depicted, the adjustment receiver 406 is a structure having a threaded through-hole for accepting the adjustment driver 430, and the adjustment driver 430 is a screw. In some embodiments, the adjustment receiver 406 may be defined by a threaded through-hole through the back portion 412, without the need for any additional structure.

The tip of the screw 430 is in contact with a cradle 408A that holds a rear portion of the elastomer element 402. As the screw 430 is turned, the lateral movement of the screw 430 causes the cradle 408A to move towards or away from the striking face 418. Accordingly, in some examples, the screw 430 extends substantially orthogonal to the rear surface 419 of the striking face 418. Because the cradle 408A holds the rear portion of the elastomer element 402, movement of the cradle 408A causes a change in the compression of the elastomer element 402 against the rear surface 419 of the striking face 418. As such, the compression of the elastomer element 402 may be adjusted by turning the screw 430 via screw drive 432, similar to manipulation of the threaded element 330 in golf club head 300 depicted in FIGS. 3A-3B.

Figure 4C:
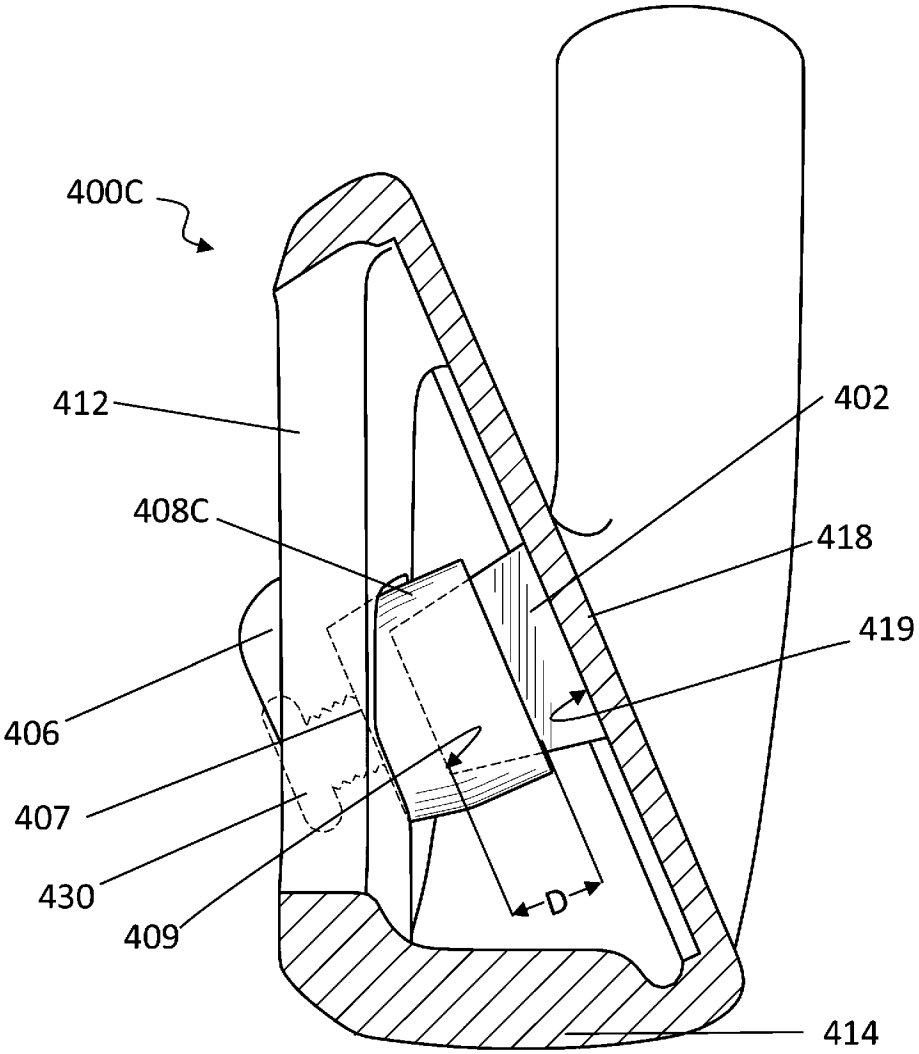
FIG. 4C depicts a section view of another example of a golf club having an elastomer element and an adjustment mechanism to adjust the compression of the elastomer element.

FIG. 4C depicts a section view of another example of a golf club 400C having an elastomer element 402 and an adjustment mechanism to adjust the compression of the elastomer element 402. The golf club head 400C is substantially similar to the golf club head 400A depicted in FIGS. 4A-4B, except golf club head 400C includes a larger cradle 408C having a depth D greater than a depth of a comparatively smaller cradle (e.g., the cradle 408A of FIGS. 4A-4B having a depth d). The larger cradle 408C encompasses more the elastomer element 402 than a smaller cradle. By encompassing a larger portion of the elastomer element 402, the cradle 408C further limits the deformation of the elastomer element 402 upon a strike of a golf ball by golf club head 400C. Limitation of the deformation of the elastomer element 402 also may limit the potential maximum deflection of the striking face 418, and therefore may reduce the maximum ball speed for the golf club head 400C while increasing the uniformity of speeds across the striking face 418. The larger cradle 408C does not come into contact with the rear surface 419 of the striking face 418 at maximum deflection thereof. The cradle 408C itself may be made of the same material as the back portion 412, such as a steel. The cradle 408C may also be made from a titanium, a composite, a ceramic, or a variety of other materials.

The size of the cradle 408C may be selected based on the desired ball speed properties. For instance, the cradle 408C may encompass approximately 25% or more of the volume of the elastomer element 402, as shown in FIG. 4C. In other examples, the cradle 408C may encompass between approximately 25%-50% of the volume of the elastomer element 402. In yet other examples, the cradle 408C may encompass approximately 10%-25% or less than approximately 10% of the volume of the elastomer element 402. In still other examples, the cradle 408C may encompass more than 50% of the volume of the elastomer element 402. For the portion of the elastomer element 402 encompassed by the cradle 408C, substantially the entire perimeter surface of that portion of elastomer element 402 may contact the interior surfaces of the recess 409 of the cradle 408C.

The connection between the cradle 408C and the adjustment driver 430 can also be seen more clearly in FIG. 4C. The tip of the adjustment driver 430, which may be a flat surface, contacts the rear surface 407 of the cradle 408C. Thus, as the adjustment driver 430 moves into the cavity 420, the cradle 408C and the elastomer element 402 are pushed towards the striking face 418. Conversely, as the adjustment driver 430 is backed out of the cavity 420, the cradle 408C maintains contact with the adjustment driver 430 due to the force exerted from the elastomer element 402 resulting from the compression thereof. In some embodiments, the surface of the tip of the screw 430 and/or the rear surface 407 of the cradle 408C may be lubricated so as to prevent twisting of the cradle 408C. In other examples, the tip of the adjustment driver 430 may be attached to the cradle 408C such that the cradle 408C twists with the turning of the adjustment driver 430. In such an embodiment, the elastomer element 402 may be substantially cylindrical, conical, spherical, or frustoconical, and the interior 409 of the cradle 408C may be lubricated to prevent twisting of the elastomer element 402. In another example, the rear surface 419 of the striking face 418 and/or the front surface of the elastomer element 402 in contact with the rear surface 419 of the striking face 418 may be lubricated so as to allow for spinning of the elastomer element 402 against the rear surface 419 of the striking face 418.

While the golf club heads 400A and 400C are depicted with a continuous sole 414 rather than a sole channel like the golf club head 300 of FIGS. 3A-3B, other embodiments of golf club heads 400A and 400C may include a sole channel. In addition, golf club heads 400A and 400C may also be sold as kits with a plurality of screws and/or a torque wrench, similar to the kit discussed above for golf club head 300. An additional back plate may be added to the aft portion of the golf club heads 400A and 400C, while still leaving a portion of the screw exposed for adjustment.

Simulated results of different types of golf club heads further demonstrate ball speed uniformity across the face of the golf club heads including an elastomer element. Table 1 indicates ball speed retention across the face of a golf club head for several different example golf club heads. Example 1 is a baseline hollow iron having a 2.1 mm face thickness with a sole channel. Example 2 is a hollow iron with a 2.1 mm face with a rigid rod extending from the back portion to the striking face, also including a sole channel. Example 3 is a hollow iron with a striking face having a thick center (6.1 mm) and a thin perimeter (2.1 mm), also having a sole channel. Example 4 is a golf club head having an elastomer element similar to golf club head 100 depicted in FIGS. 1A-1C. The "Center" row indicates ball speeds resulting from a strike in the center of the golf club head, the "½" Heel" row indicates the loss of ball speed from a strike a half inch from the center of the club head towards the heel, and the "½" Toe" row indicates the loss of ball speed from a strike a half inch from the center of the club head towards the toe. All values in Table 1 are in miles per hour (mph).

TABLE 1

| Impact Location | Example 1 | Example 2 | Example 3 | Example 4 |
|---|---|---|---|---|
| Center | 134.1 | 132.8 | 133.8 | 133.6 |
| ½" Heel (drop from center) | −1.0 | −0.4 | −0.9 | −0.7 |
| ½" Toe (drop from center) | −6.9 | −6.5 | −6.8 | −6.7 |

From the results in Table 1, the golf club head with the elastomer (Example 4) displays a relatively high ball speed from the center of the face, while also providing a reduced loss of ball speed from strikes near the toe or the heel of the golf club.

In addition, as mentioned above, the type of material utilized for any of the elastomer elements discussed herein has an effect on the displacement of the striking face. For instance, an elastomer element with a greater elastic modulus will resist compression and thus deflection of the striking face, leading to lower ball speeds. For example, for a golf club head similar to golf club head 400A, Table 2 indicates ball speeds achieved from using materials with different elasticity properties. All ball speeds were the result of strikes at the center of the face.

TABLE 2

| Material | Elastic Modulus (GPa) | Ball Speed (mph) |
|---|---|---|
| Material A | 0.41 | 132.2 |
| Material B | 0.58 | 132.2 |
| Material C | 4.14 | 132.0 |
| Material D | 41.4 | 131.0 |

From the results in Table 2, a selection of material for the elastomer element can be used to fine tune the performance of the golf club. Any of the materials listed in Table 2 are acceptable for use in forming an elastomer element to be used in the present technology.

The different types of materials also have effect on the ball speed retention across the striking face. For example, for a golf club head similar to golf club head 400A, Table 3 indicates ball speeds achieved across the striking face from heel to toe for the different materials used as the elastomer element. The materials referenced in Table 3 are the same materials from Table 2. All speeds in Table 3 are in mph.

TABLE 3

| Material | ½" Toe Impact | Center Impact | ½" Heel Impact |
|---|---|---|---|
| No Elastomer Element | 128.7 | 132.2 | 129.4 |
| Material A (0.41 GPa) | 128.7 | 132.2 | 129.4 |
| Material C (4.1 GPa) | 128.7 | 132.0 | 129.3 |
| Material D (41 GPa) | 127.9 | 131.0 | 128.7 |

From the results in Table 3, materials having a higher elastic modulus provide for better ball speed retention across the striking face, but lose maximum ball speed for impacts at the center of the face. For some applications, a range of elastic moduli for the elastomer element from about 4 to about 15 GPa may be used. In other applications, a range of elastic moduli for the elastomer element from about 1 to about 40 or about 50 GPa may be used.

As mentioned above with reference to FIGS. 4A-4C, the size of the cradle may also have an impact on the ball speed. For a smaller cradle, such as cradle 408A in FIGS. 4A-4B, and an elastomer element made of a 13 GPa material, a loss of about 0.2 mph is observed for a center impact as compared to the same club with no elastomer element. For a larger cradle that is about 5 mm deeper, such as cradle 408C in FIG. 4C, and an elastomer element also made of a 13 GPa material, a loss of about 0.4 mph is observed for a center impact as compared to the same club with no elastomer element. For the same larger cradle and an elastomer element made of a 0.4 GPa material, a loss of only about 0.2 mph is observed for a center impact as compared to the same club with no elastomer element.

San Diego Plastics, Inc. of National City, Calif. offers several plastics having elastic moduli ranging from 2.6 GPa to 13 GPa that would all be acceptable for use. The plastics also have yield strengths that are also acceptable for use in the golf club heads discussed herein. Table 4 lists several materials offered by San Diego Plastics and their respective elastic modulus and yield strength values.

TABLE 4

| | ABS | Tecaform Acetal | PVC | Tecapeek | Tecapeek 30% Carbon Fiber |
|---|---|---|---|---|---|
| Thermoplastic Elastic Modulus (GPa) | 2.8 | 2.6 | 2.8 | 3.6 | 13 |
| Thermoplastic Compressive Yield Strength (GPa) | 0.077 | 0.031 | 0.088 | 0.118 | 0.240 |

Figure 5B:
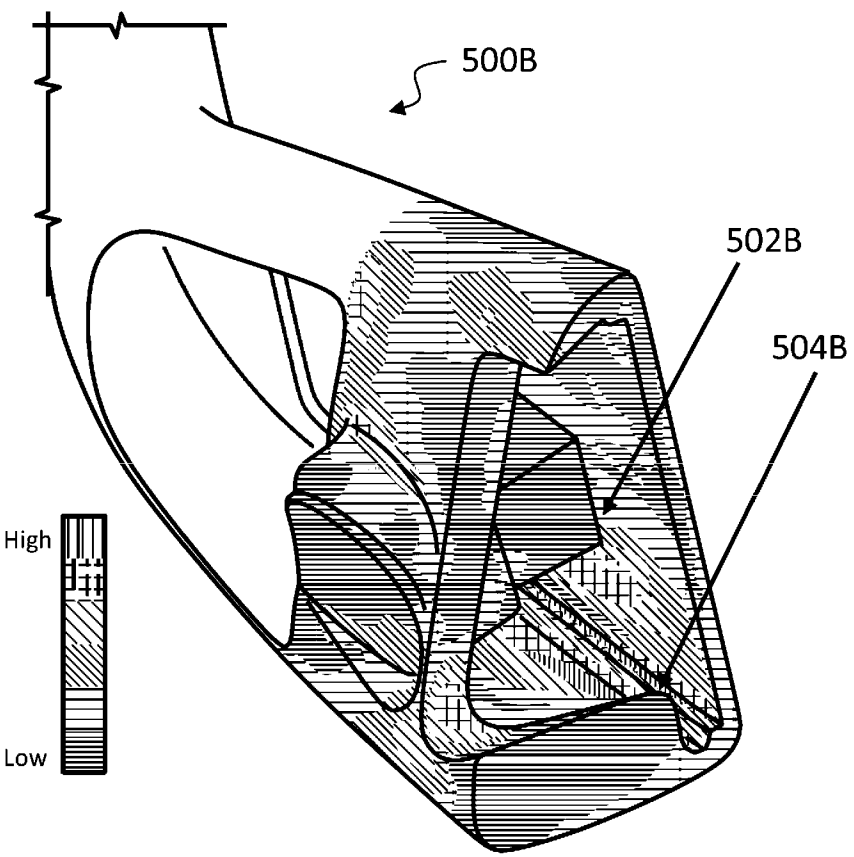
FIG. 5B depicts a stress contour diagram for a golf club head with an elastomer element.
Figure 5A:
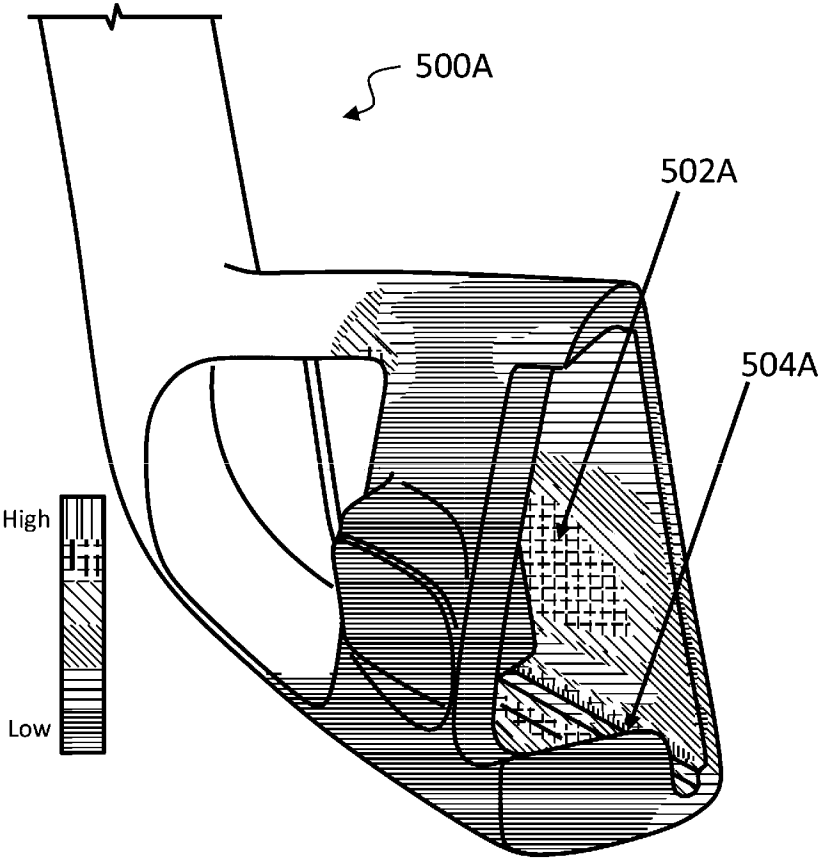
FIG. 5A depicts a stress contour diagram for a golf club head without an elastomer element.

The inclusion of an elastomer element also provide benefits in durability for the club face by reducing stress values displayed by the striking face upon impact with a golf ball. FIG. 5A depicts a stress contour diagram for a golf club head 500A without an elastomer element, and FIG. 5B depicts a stress contour diagram for a golf club head 500B with an elastomer element. In the golf club head 500A, the von Mises stress at the center of the face 502A is about 68% of the maximum von Mises stress, which occurs at the bottom face edge 504A. Without an elastomer element, the von Mises stress levels are high and indicate that the club face may be susceptible to failure and/or early deterioration. In the golf club 500B, for an elastomer element having an elastic modulus of 0.41 GPa, the von Mises stress for the face near the edge of the elastomer element 502B is reduced by about 16% and the maximum von Mises stress occurring at the bottom face edge 504B is reduced by about 18%. These von Mises stresses are still relatively high, but are significantly reduced from those of the golf club head 500A. For a golf club head 500B with an elastomer element having an elastic modulus of about 13 GPa, the von Mises stress for the face near the edge of the elastomer element 502B is reduced by about 50% and the maximum von Mises stress occurring at the bottom face edge 504B is reduced by about 56%. Such von Mises stress values are lower and are indicative of a more durable golf club head that may be less likely to fail.

Figure 6A:
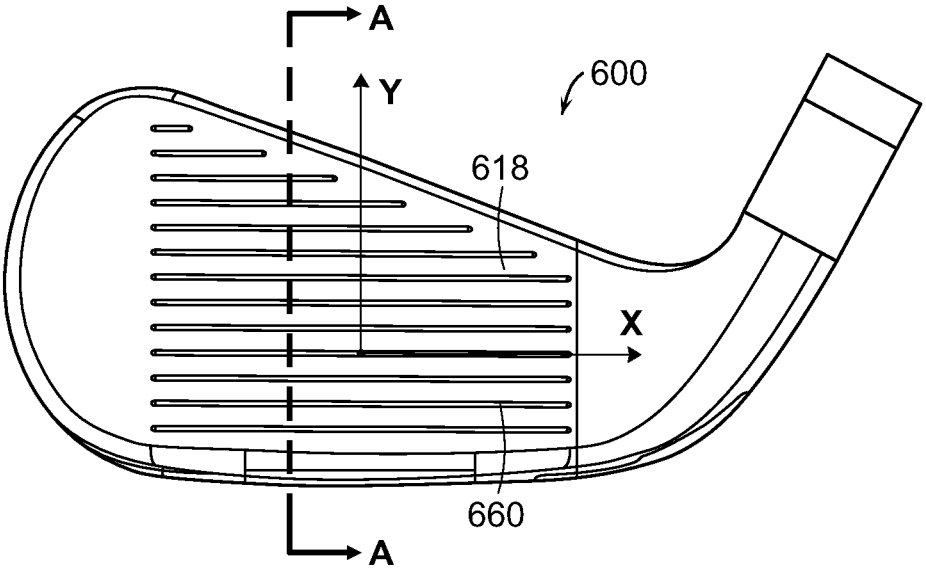
FIG. 6A depicts a front view of the golf club head.
Figure 6B:
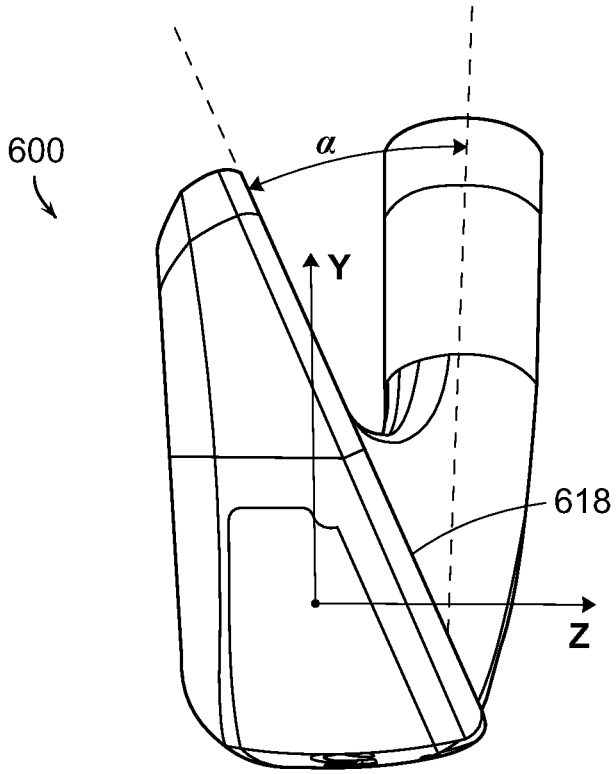
FIG. 6B depicts a toe view of the golf club head of FIG. 6A.
Figure 6C:
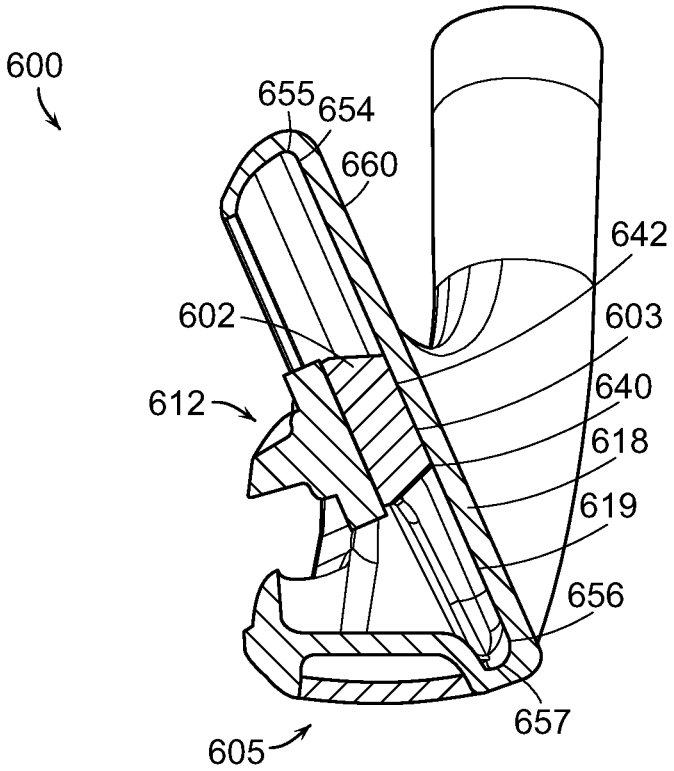
FIG. 6C depicts a section view A-A of the golf club head of FIG. 6A.
Figure 6D:
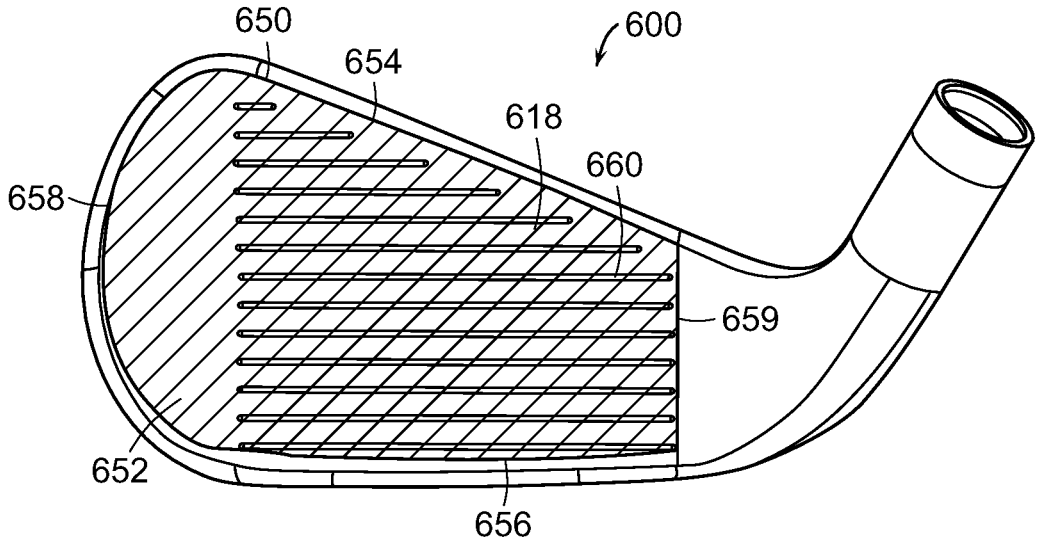
FIG. 6D depicts a perspective view of the golf club head of FIG. 6A oriented perpendicular to the striking face.
Figure 6E:
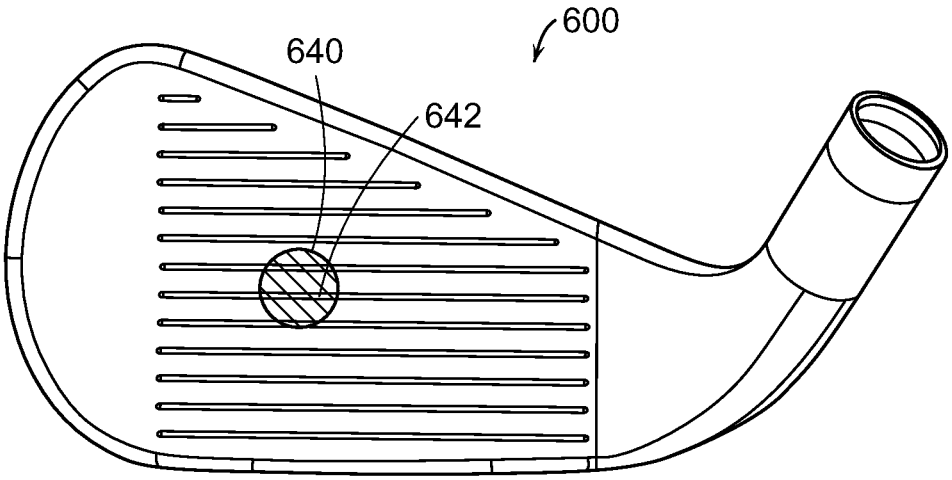
FIG. 6E depicts a perspective view of the golf club head of FIG. 6A oriented perpendicular to the striking face including the supported region.

FIGS. 6A-6E depict a golf club head 600 having an elastomer element 602. FIG. 6A depicts a front view of the golf club head 600. FIG. 6B depicts a toe view of the golf club head 600 of FIG. 6A. FIG. 6C depicts a section view A-A of the golf club head 600 of FIG. 6A. FIG. 6D depicts a perspective view of the golf club head 600 of FIG. 6A oriented perpendicular to the striking face 618. FIG. 6E depicts a perspective view of the golf club head 600 of FIG. 6A oriented perpendicular to the striking face 618 including the supported region 642. The golf club head 600 includes a striking face 618 configured to strike a ball, a sole 605 located at the bottom of the golf club head 600, and a back portion 612.

As illustrated in FIGS. 6A and 6B, the golf club head 600 includes a coordinate system centered at the center of gravity (CG) of the golf club head 600. The coordinate system includes a y-axis which extends vertically, perpendicular to a ground plane when the golf club head 600 is in an address position at prescribed lie and loft a. The coordinate system includes an x-axis, perpendicular to the y-axis, parallel to the striking face 618, and extending towards the heel of the golf club head 600. The coordinate system includes a z-axis, perpendicular to the y-axis and x-axis and extending through the striking face 618. The golf club head 600 has a rotational moment of inertia about the y-axis (MOI-Y), a value which represents the golf club head's resistance to angular acceleration about the y-axis.

An elastomer element 602 is disposed between the striking face 618 and the back portion 612. The striking face 618 includes a rear surface 619. The front portion 603 of the elastomer element 602 contacts the rear surface 619 of the striking face 618. As illustrated in FIGS. 6C and 6E, the striking face 618 includes a supported region 642, the portion of the rear surface 619 supported by the elastomer element 602, which is defined as the area inside the supported region perimeter 640 defined by the outer extent of the front portion 603 of the elastomer element 602 in contact with the rear surface 619 of the striking face 618. The supported region 642 is illustrated with hatching in FIG. 6E. The supported region 642 wouldn't normally be visible from the front of the golf club head 600 but was added for illustrative purposes.

The striking face 618 includes a striking face area 652, which is defined as the area inside the striking face perimeter 650 as illustrated in FIG. 6D. As illustrated in FIG. 6C, the striking face perimeter is delineated by an upper limit 654 and a lower limit 656. The upper limit 654 is located at the intersection of the substantially flat rear surface 619 and the upper radius 655 which extends to the top line of the golf club head 600. The lower limit 656 is located at the intersection of the substantially flat rear surface 619 and the lower radius 657 which extends to the sole 605 of the golf club head 600. The striking face perimeter is similarly delineated 658 (as illustrated in FIG. 6D) at the toe of the golf club head 600 (not illustrated in cross section). The heel portion of the striking face perimeter is defined by a plane 659 extending parallel to the y-axis and the x-axis offset 1 millimeter (mm) towards the heel from the heel-most extent of the scorelines 660 formed in the striking face 618. The striking face area 652 is illustrated with hatching in FIG. 6D. The limits 654, 656 of the striking face perimeter have been projected onto the striking face 618 in FIG. 6D for ease of illustration and understanding.

A plurality of golf club heads much like golf club head 600 described herein can be included in a set, each golf club head having a different loft a. Each golf club head can also have additional varying characteristics which may include, for example, MOI-Y, Striking Face Area, Area of Supported Region, and the Unsupported Face Percentage. The Unsupported Face Percentage is calculated by dividing the Area of Supported Region by the Striking Face Area and multiplying by 100% and subtracting it from 100%. An example of one set of iron type golf club heads is included in Table 5 below. The set in Table 5 includes the following lofts: 21, 24, 27, and 30. Other sets may include a greater number of golf club heads and/or a wider range of loft a values, or a smaller number of golf club heads and/or a smaller range of loft a values. Additionally, a set may include one or more golf club heads which include an elastomer element and one or more golf club heads which do not include an elastomer element.

TABLE 5

| Loft of Iron (Degrees) | MOI-Y (kg*mm$^2$) | Striking Face Area (mm$^2$) | Area of Supported Region (mm$^2$) | Unsupported Face Percentage (%) |
|---|---|---|---|---|
| 21 | 270 | 2809 | 74 | 97.37 |
| 24 | 272 | 2790 | 74 | 97.35 |
| 27 | 276 | 2777 | 74 | 97.34 |
| 30 | 278 | 2742 | 74 | 97.30 |

An example of an additional embodiment of set of iron type golf club heads is included in Table 6 below.

TABLE 6

| Loft of Iron (Degrees) | MOI-Y (kg*mm$^2$) | Striking Face Area (mm$^2$) | Area of Supported Region (mm$^2$) | Unsupported Face Percentage (%) |
|---|---|---|---|---|
| 21 | 272 | 2897 | 74 | 97.45 |
| 24 | 278 | 2890 | 74 | 97.44 |
| 27 | 289 | 2878 | 74 | 97.43 |
| 30 | 294 | 2803 | 74 | 97.36 |

If all other characteristics are held constant, a larger the MOI-Y value increases the ball speed of off-center hits. For clubs with a smaller MOI-Y, the decrease in off-center ball speed can be mitigated with a greater unsupported face percentage. By supporting a smaller percentage of the face, more of the face is able to flex during impact, increasing off-center ball speed. Thus, for the inventive golf club set described in Table 5 above, the MOI-Y increases through the set as loft a increases and the unsupported face percentage decreases through the set as loft a increases. This relationship creates consistent off-center ball speeds through a set of golf clubs.

A set of golf clubs can include a first golf club head with a loft greater than or equal to 20 degrees and less than or equal to 24 degrees and a second golf club head with a loft greater than or equal to 28 degrees and less than or equal to 32 degrees. In one embodiment, the set can be configured so that the first golf club head has a larger unsupported face percentage than the second golf club head and the first golf club head has a lower MOI-Y than the second golf club head.

More particular characteristics of embodiments described herein are described below. In some embodiments, the area of the supported region can be greater than 30 millimeters$^2$. In some embodiments, the area of the supported region can be greater than 40 millimeters$^2$. In some embodiments, the area of the supported region can be greater than 60 millimeters$^2$. In some embodiments, the area of the supported region can be greater than 65 millimeters$^2$. In some embodiments, the area of the supported region can be greater than 70 millimeters$^2$. In some embodiments, the area of the supported region can be greater than 73 millimeters$^2$.

In some embodiments, the area of the supported region can be less than 140 millimeters$^2$. In some embodiments, the area of the supported region can be less than 130 millimeters$^2$. In some embodiments, the area of the supported region can be less than 120 millimeters$^2$. In some embodiments, the area of the supported region can be less than 110 millimeters$^2$. In some embodiments, the area of the supported region can be less than 100 millimeters$^2$. In some embodiments, the area of the supported region can be less than 90 millimeters$^2$. In some embodiments, the area of the supported region can be less than 85 millimeters$^2$. In some embodiments, the area of the supported region can be less than 80 millimeters$^2$. In some embodiments, the area of the supported region can be less than 75 millimeters$^2$.

In some embodiments, the unsupported face percentage is greater than 70%. In some embodiments, the unsupported face percentage is greater than 75%. In some embodiments, the unsupported face percentage is greater than 80%. In some embodiments, the unsupported face percentage is greater than 85%. In some embodiments, the unsupported face percentage is greater than 90%. In some embodiments, the unsupported face percentage is greater than 95%. In some embodiments, the unsupported face percentage is greater than 96%. In some embodiments, the unsupported face percentage is greater than 97%.

In some embodiments, the unsupported face percentage is less than 99.75%. In some embodiments, the unsupported face percentage is less than 99.50%. In some embodiments, the unsupported face percentage is less than 99.25%. In some embodiments, the unsupported face percentage is less than 99.00%. In some embodiments, the unsupported face percentage is less than 98.75%. In some embodiments, the unsupported face percentage is less than 98.50%. In some embodiments, the unsupported face percentage is less than 98.25%. In some embodiments, the unsupported face percentage is less than 98.00%. In some embodiments, the unsupported face percentage is less than 97.75%. In some embodiments, the unsupported face percentage is less than 97.50%. In some embodiments, the unsupported face percentage is less than 97.25%. In some embodiments, the unsupported face percentage is less than 97.00%.

Figure 7A:
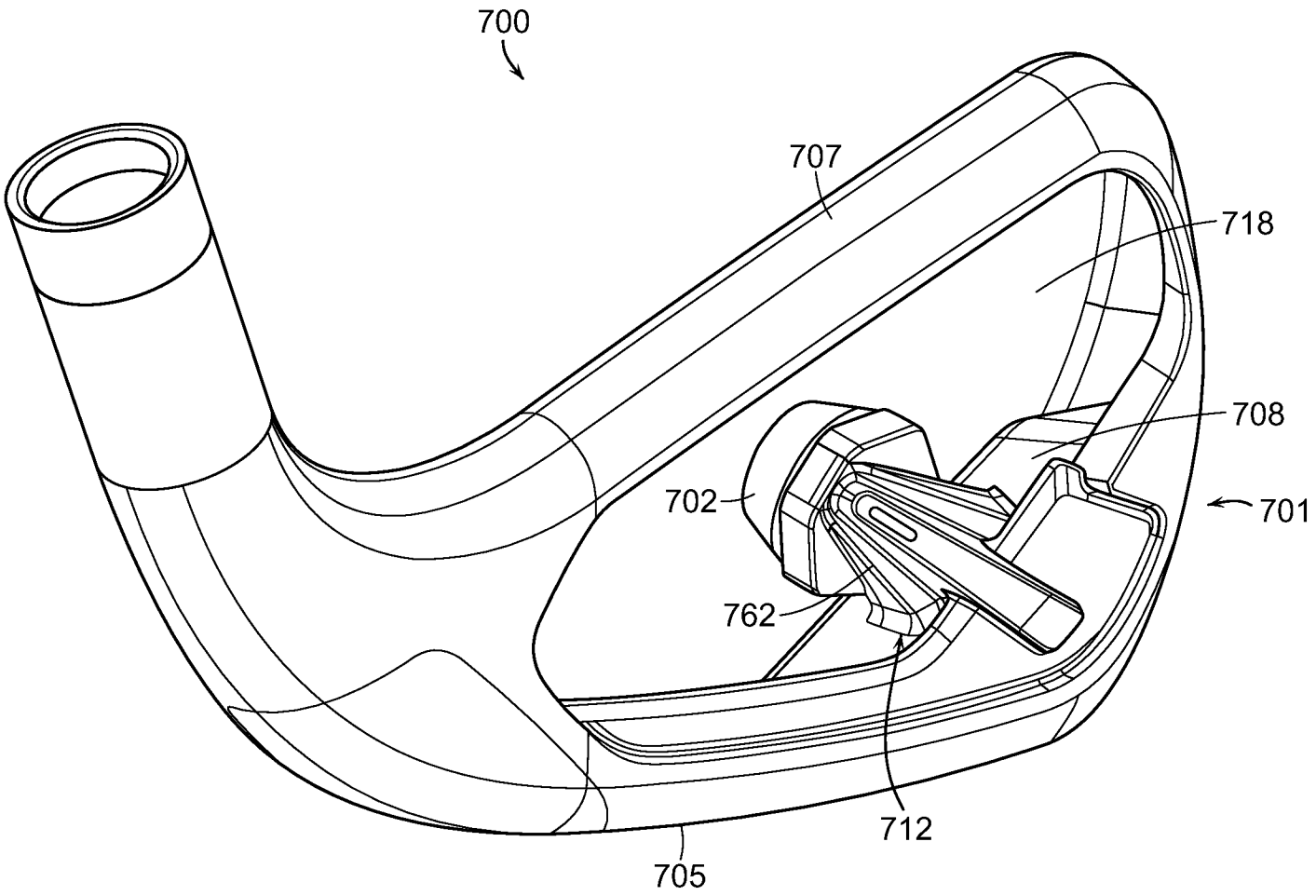
FIG. 7A depicts a perspective view of the golf club head.
Figure 7B:
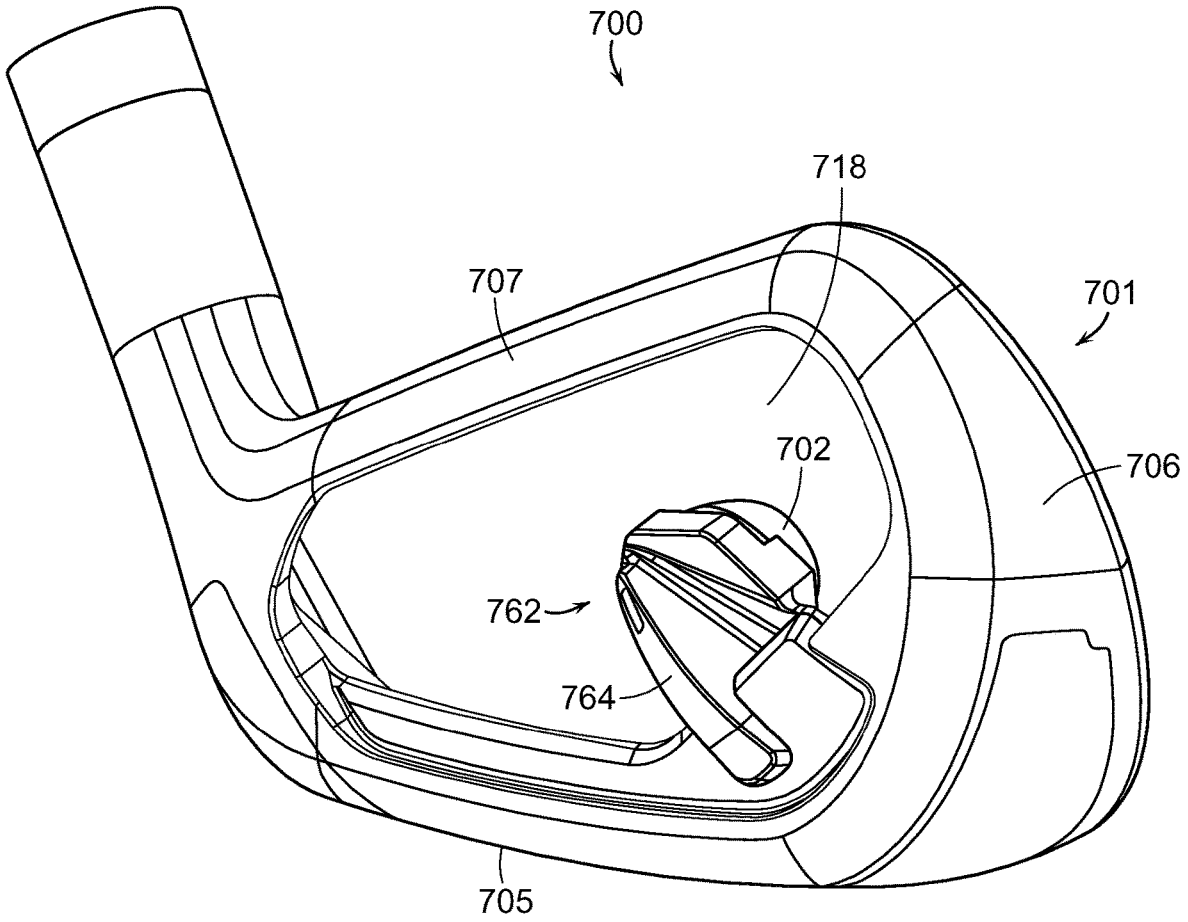
FIG. 7B depicts an additional perspective view of the golf club head of FIG. 7A.
Figure 7C:
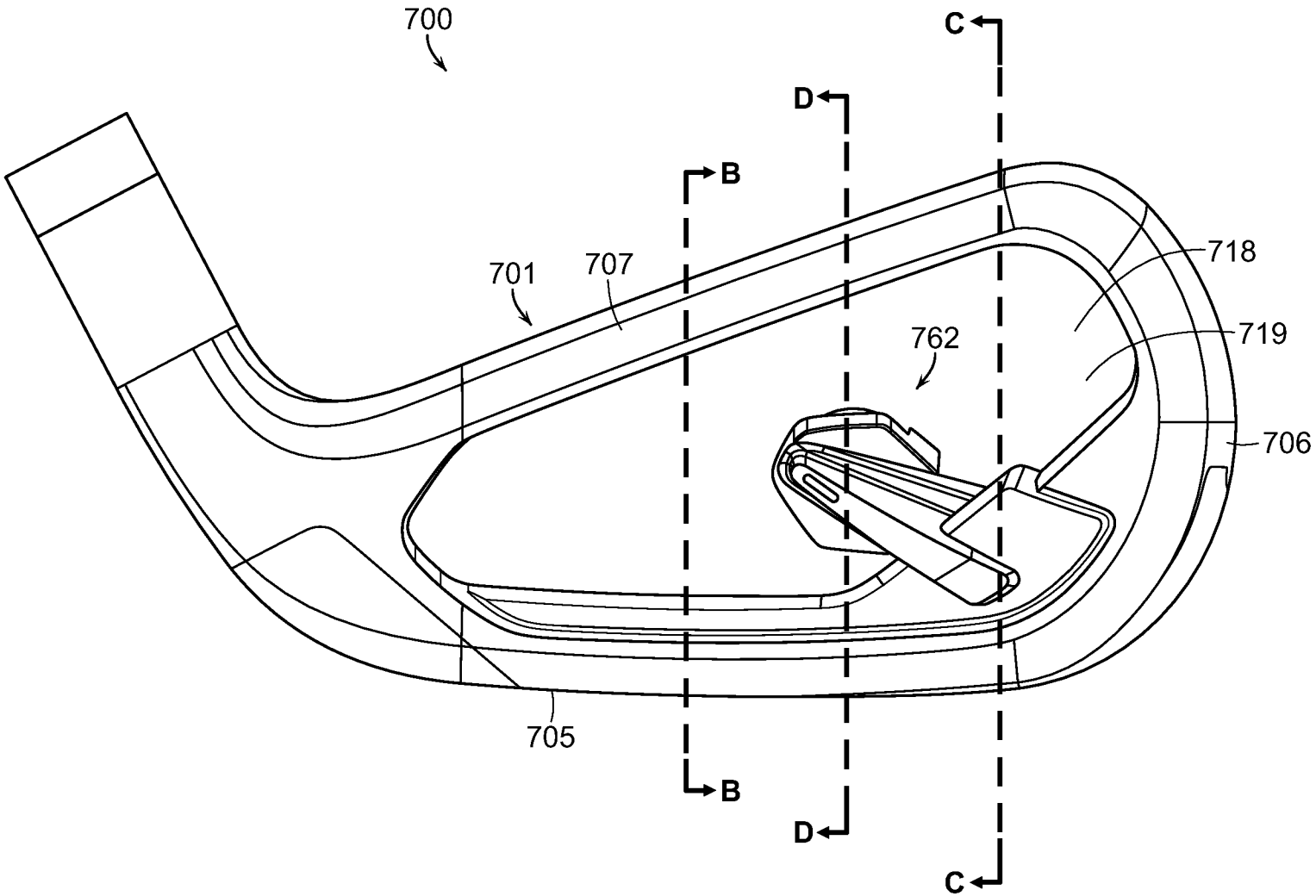
FIG. 7C depicts a rear view of the golf club head of FIG. 7A.
Figure 10:
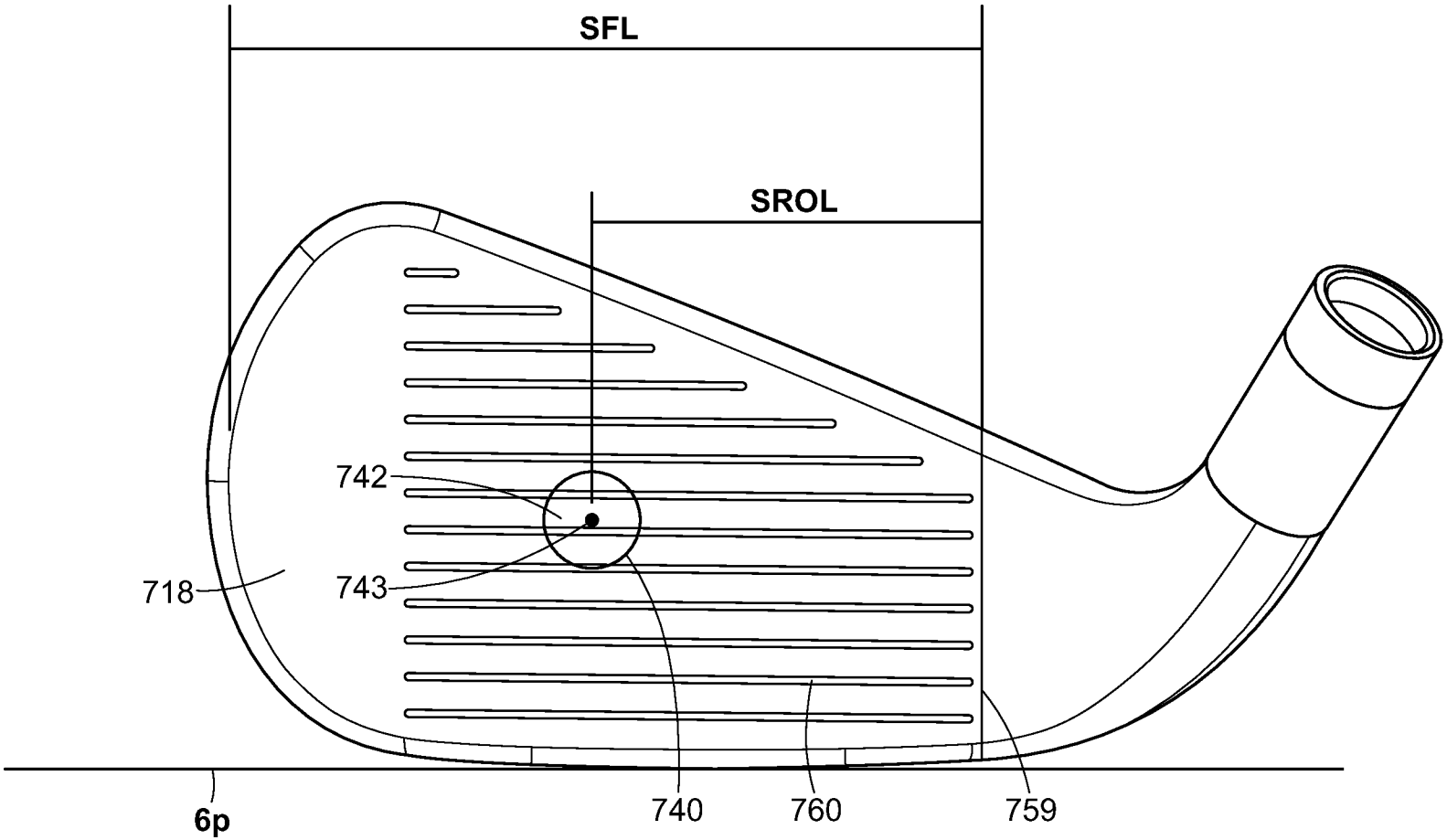
FIG. 10 depicts a perspective view of the golf club head of FIG. 7A oriented perpendicular to the striking face including the supported region.

FIGS. 7A-10 depict a golf club head 700 having an elastomer element 702. FIG. 7A depicts a perspective view of the golf club head 700. FIG. 7B depicts an additional perspective view of the golf club head 700 of FIG. 7A. FIG. 7C depicts a rear view of the golf club head 700 of FIG. 7A. FIG. 8A depicts a section view B-B of the golf club head 700 of FIG. 7C. FIG. 8B depicts a section view C-C of the golf club head 700 of FIG. 7C. FIG. 8C depicts a section view D-D of the golf club head 700 of FIG. 7C. FIG. 9A depicts an additional section view of the front of the golf club head 700 of FIG. 7A missing the striking face. FIG. 9B depicts the section view from FIG. 9A with the elastomer element removed. FIG. 10. Depicts a perspective view of the golf club head 700 of FIG. 7A oriented perpendicular to the striking face 718 including the supported region 742. Please note that the golf club head 700 illustrated in FIGS. 7A-10 is an iron-type cavity back golf club but the inventions described herein are applicable to other types of golf club heads as well.

The golf club head 700 includes a deformable member 702 disposed between the striking face 718 and the back portion 712. In one embodiment, the deformable member 702 is formed from an elastomer. The front portion 703 of the elastomer element 702 contacts the rear surface 719 of the striking face 718. The striking face 718 includes a supported region 742, the portion of the rear surface 719 supported by the elastomer element 702, which is defined as the area inside the supported region perimeter 740 defined by the outer extent of the front portion 703 of the elastomer element 702 in contact with the rear surface 719 of the striking face 718. The supported region 742 wouldn't normally be visible from the front of the golf club head 700 but was added in FIG. 10 for illustrative purposes.

The golf club head 700 illustrated in FIGS. 7A-10 is a cavity back construction and includes a periphery portion 701 surrounding and extending rearward from the striking face 718. The periphery portion 701 includes the sole 705, the toe 706, and the topline 707. The periphery portion 701 can also include a weight pad 710. The golf club head 700 also includes a back portion 712 configured to support the elastomer element 702.

The back portion 712 includes a cantilever support arm 762 affixed to the periphery portion 701. The support arm 762 can include a cradle 708 configured to hold the elastomer element 702 in place. The cradle 708 can include a lip 709 configured to locate the elastomer element 702 on the cradle 708 and relative to the striking face 718. The lip 709 can surround a portion of the elastomer element 702. Additionally, an adhesive can be used between the elastomer element 702 and the cradle 708 to secure the elastomer element 702 to the cradle 708.

The support arm 762 extends from the weight pad 710 located at the intersection of the sole 705 and the toe 706 of the periphery portion 701 towards the supported region 742. The support arm 762 is oriented substantially parallel to the rear surface 719 of the striking face 718. The support arm 762 can include a rib 764 to increase the stiffness of the support arm 762. The rib 764 can extend rearwards from the support arm 762 substantially perpendicularly to the rear surface 719 of the striking face 718. One benefit of a cantilever support arm 762 is it provides a lower CG height than an alternative beam design, such as the embodiment illustrated in FIG. 4A, which supported at both ends by the periphery portion.

In order to provide a low CG height the support arm 762 is cantilevered which means it is only affixed to the periphery portion 701 at one end of the support arm 762. The support arm is designed such that the distance H between the highest portion of the support arm 762 and the ground plane GP when the golf club head 700 is in an address position, as illustrated in FIG. 8C, is minimized, while locating the elastomer element 702 in the optimal position. In one embodiment, H is less than or equal to 50 mm. In an additional embodiment, H is less than 45 mm. In an additional embodiment, H is less than or equal to 40 mm. In an additional embodiment, H is less than or equal to 35 mm. In an additional embodiment, H is less than or equal to 30 mm. In an additional embodiment, H is less than or equal to 29 mm. In an additional embodiment, H is less than or equal to 28 mm.

In one embodiment, the golf club head 700 can have a CG height CGH of less than or equal to 25 mm. In an additional embodiment, the golf club head 700 can have a CG height CGH of less than or equal to 24 mm. In an additional embodiment, the golf club head 700 can have a CG height CGH of less than or equal to 23 mm. In an additional embodiment, the golf club head 700 can have a CG height CGH of less than or equal to 22 mm. In an additional embodiment, the golf club head 700 can have a CG height CGH of less than or equal to 21 mm. In an additional embodiment, the golf club head 700 can have a CG height CGH of less than or equal to 20 mm. In an additional embodiment, the golf club head 700 can have a CG height CGH of less than or equal to 19 mm. In an additional embodiment, the golf club head 700 can have a CG height CGH of less than or equal to 18 mm.

Another advantage to the illustrated support arm 762 is it provides a high MOI-Y due to its orientation. By concentrating mass at the heel end and toe end of the golf club head 700 the MOI-Y can be increased. The support arm 762 is angled to concentrate much of its mass near the toe 706, increasing MOI-Y compared with a back portion located more centrally on the golf club head 700. In one embodiment, the MOI-Y of the golf club head 700 is greater than or equal to 200 kg-mm$^2$. In an additional embodiment, the MOI-Y of the golf club head 700 is greater than or equal to 210 kg-mm$^2$. In an additional embodiment, the MOI-Y of the golf club head 700 is greater than or equal to 220 kg-mm$^2$. In an additional embodiment, the MOI-Y of the golf club head 700 is greater than or equal to 230 kg-mm$^2$. In an additional embodiment, the MOI-Y of the golf club head 700 is greater than or equal to 240 kg-mm$^2$. In an additional embodiment, the MOI-Y of the golf club head 700 is greater than or equal to 250 kg-mm$^2$. In an additional embodiment, the MOI-Y of the golf club head 700 is greater than or equal to 260 kg-mm$^2$. In an additional embodiment, the MOI-Y of the golf club head 700 is greater than or equal to 270 kg-mm$^2$.

Figure 8A:
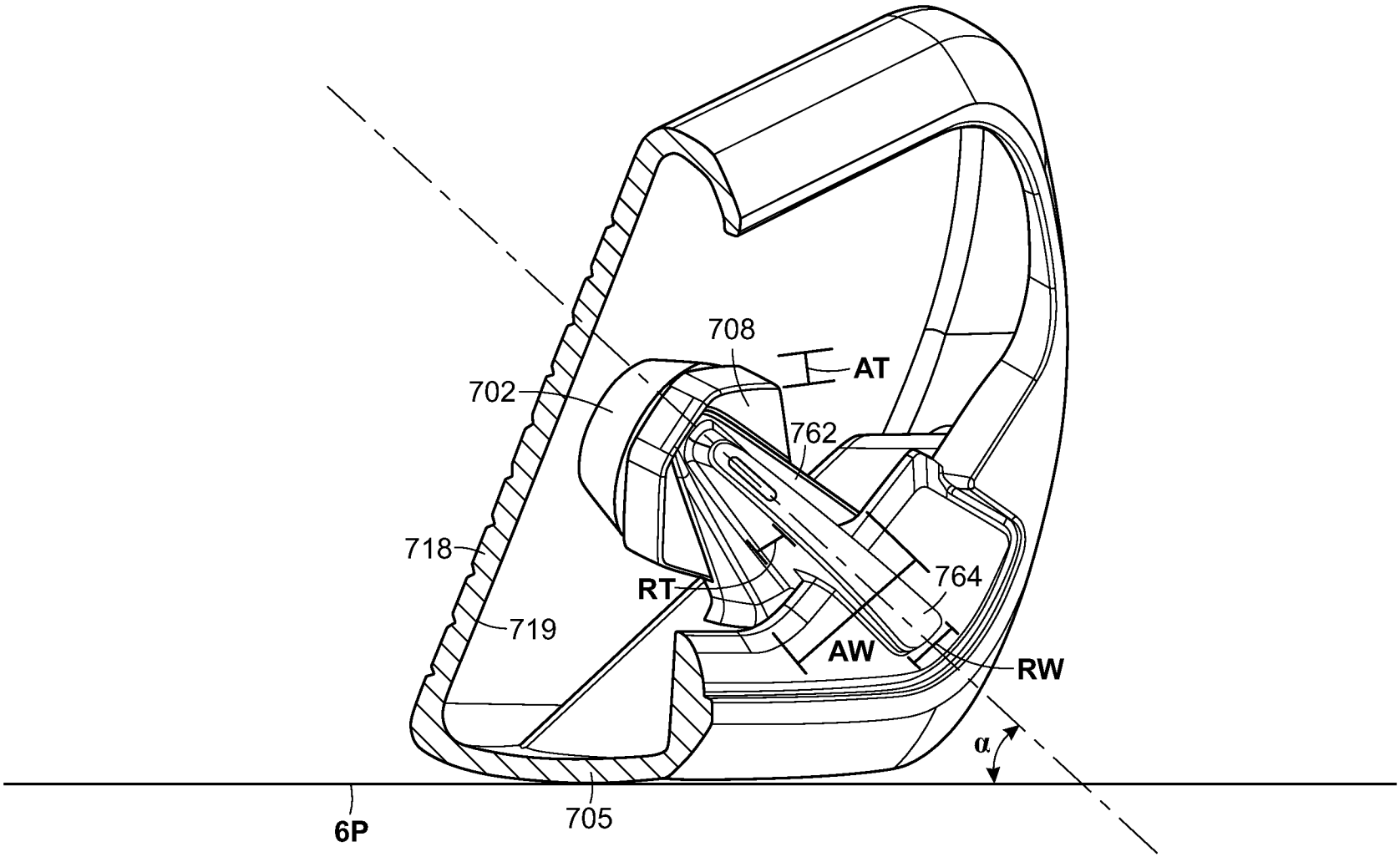
FIG. 8A depicts a section view B-B of the golf club head of FIG. 7C.
Figure 8C:
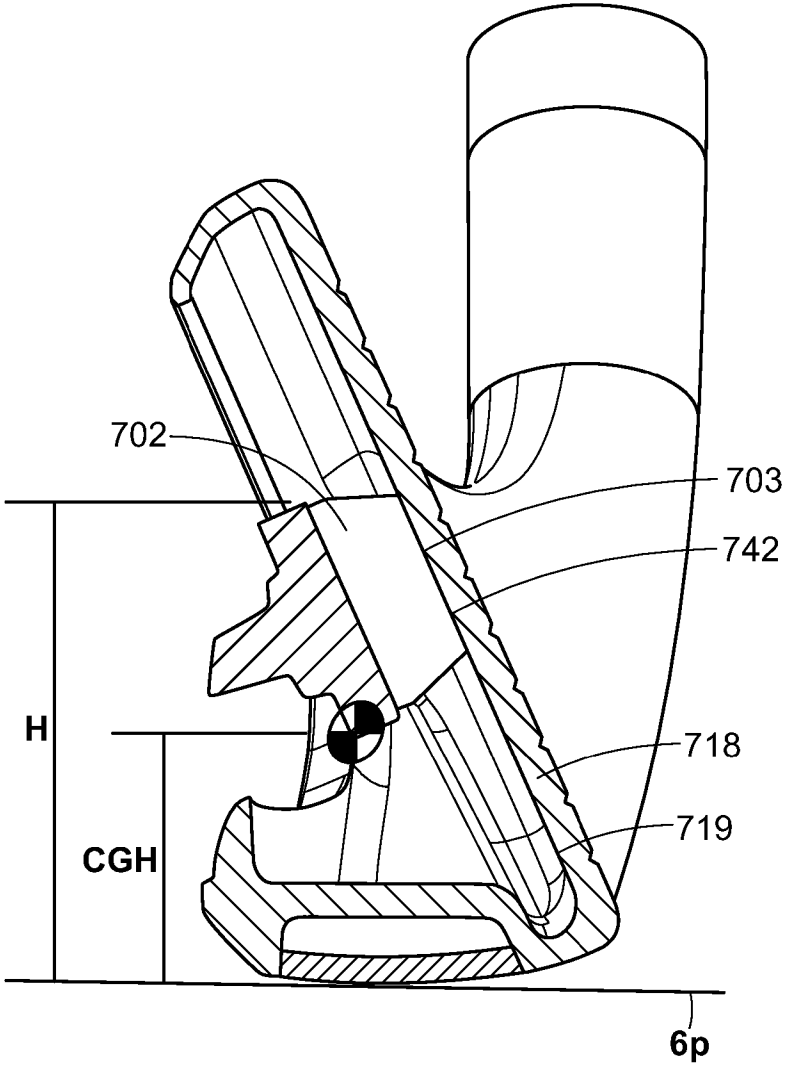
FIG. 8C depicts a section view D-D of the golf club head of FIG. 7C.
Figure 8B:
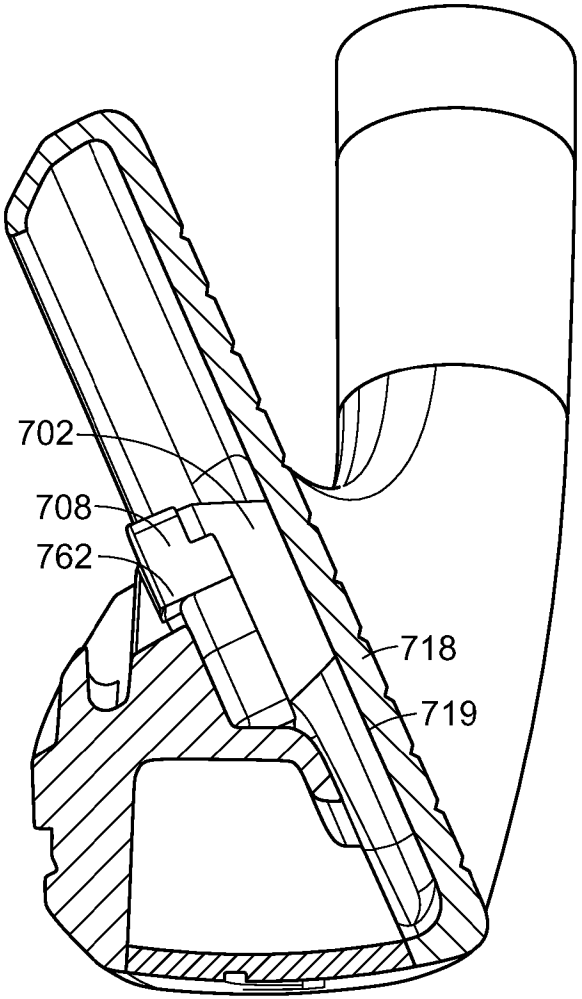
FIG. 8B depicts a section view C-C of the golf club head of FIG. 7C.
Figure 9A:
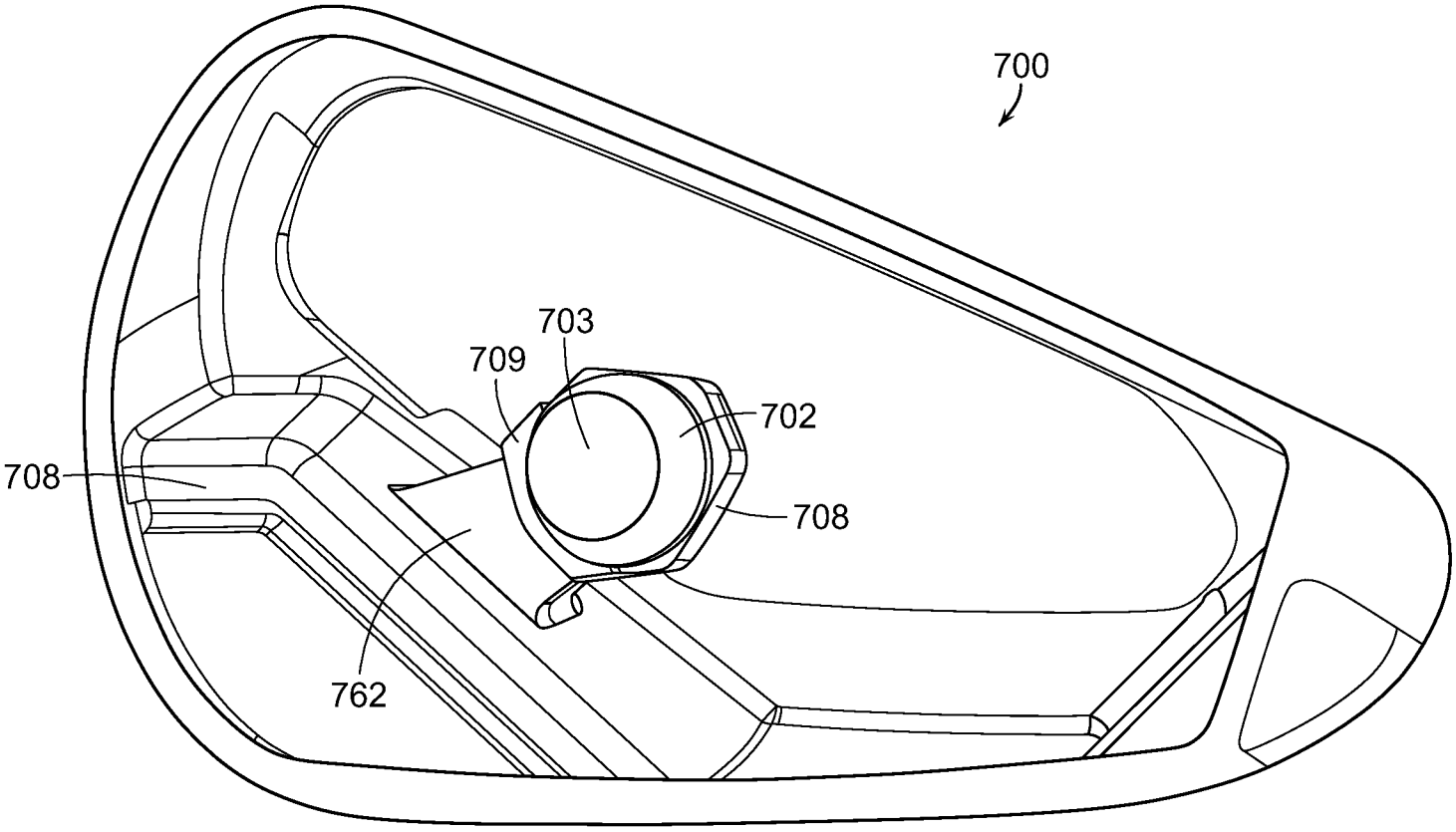
FIG. 9A depicts an additional section view of the front of the golf club head of FIG. 7A missing the striking face.
Figure 9B:
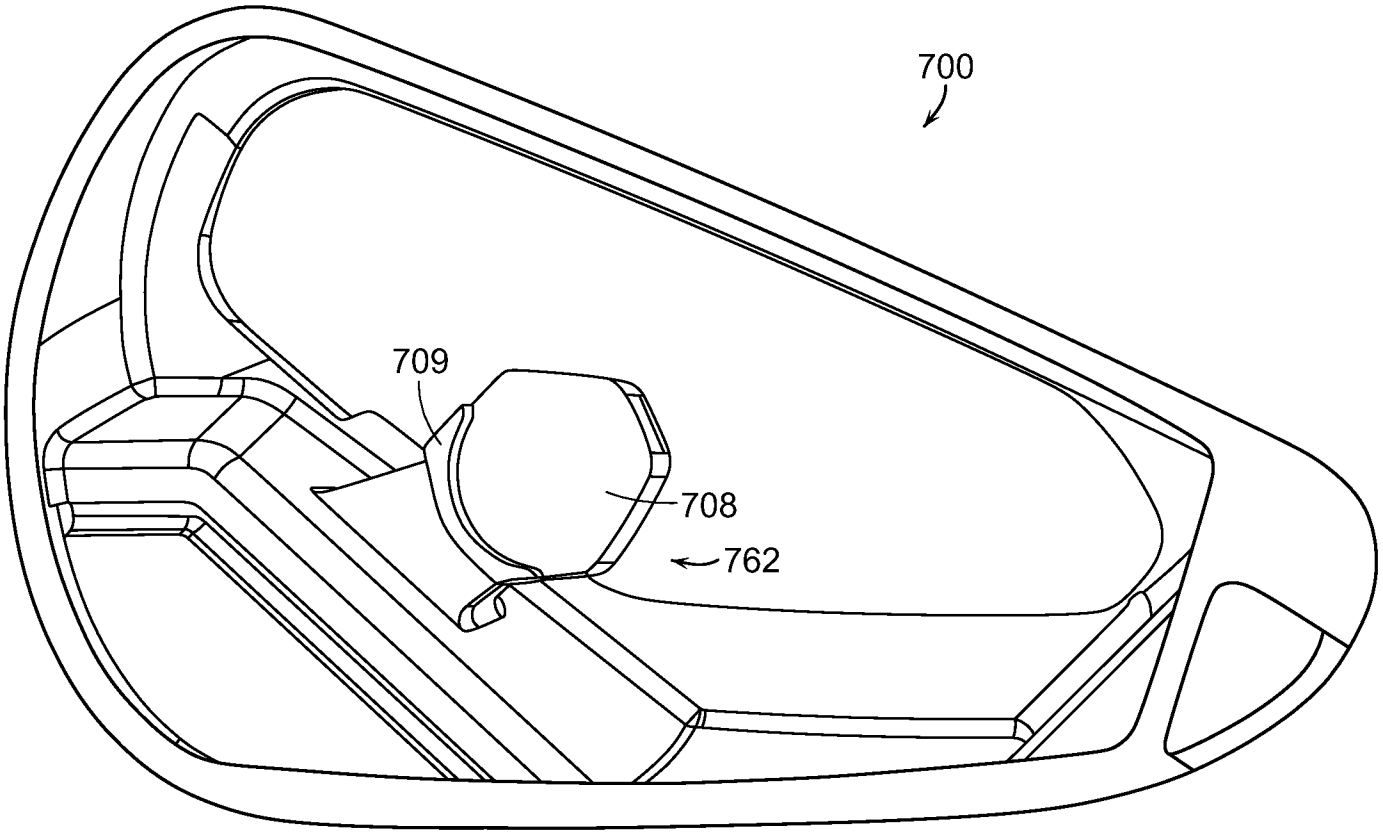
FIG. 9B depicts the section view from FIG. 9A with the deformable member removed.

The support arm 762 can include an arm centerline CL, as illustrated in FIG. 8A, which is oriented parallel to the rear surface 719 of the striking face 718 and extends along the center of the support arm 762 from the periphery portion 701 towards the supported region 742. The angle $\alpha$ is measured between the ground plane GP and the centerline CL. In one embodiment, the angle $\alpha$ is greater than or equal to 5 degrees and less than or equal to 45 degrees. In an additional embodiment, the angle $\alpha$ is greater than or equal to 10 degrees and less than or equal to 40 degrees. In an additional embodiment, the angle $\alpha$ is greater than or equal to 15 degrees and less than or equal to 35 degrees. In an additional embodiment, the angle $\alpha$ is greater than or equal to 20 degrees and less than or equal to 30 degrees. In an additional embodiment, the angle $\alpha$ is greater than or equal to 23 degrees and less than or equal to 28 degrees.

The support arm 762 can have an arm width AW measured perpendicularly to the arm centerline CL and parallel to the rear surface 719 of the striking face 718. The arm width AW can vary along the length of the support arm 762. In one embodiment the arm width of at least one portion of the support arm is greater than or equal to 6 mm. In an additional embodiment the arm width of at least one portion of the support arm is greater than or equal to 8 mm. In an additional embodiment the arm width of at least one portion of the support arm is greater than or equal to 10 mm.

The support arm 762 can have an arm thickness AT measured perpendicular to the rear surface 719 of the striking face 718. The arm thickness AT can vary along the length of the support arm 762. In one embodiment the arm thickness AT of at least one portion of the support arm is greater than or equal to 2 mm. In an additional embodiment the arm thickness AT of at least one portion of the support arm is greater than or equal to 3 mm. In an additional embodiment the arm thickness AT of at least one portion of the support arm is greater than or equal to 4 mm. In an additional embodiment the arm thickness AT of at least one portion of the support arm is greater than or equal to 5 mm. In an additional embodiment the arm thickness AT of at least one portion of the support arm is greater than or equal to 6 mm.

The rib 764 of the support arm 762 can have a rib width RW measured perpendicularly to the arm centerline CL and parallel to the rear surface 719 of the striking face 718. The rib width RW can vary along the length of the rib. In one embodiment, the rib width RW of at least a portion of the rib is greater than or equal to 1 mm. In an additional embodiment, the rib width RW of at least a portion of the rib is greater than or equal to 2 mm. In an additional embodiment, the rib width RW of at least a portion of the rib is greater than or equal to 3 mm. In an additional embodiment, the rib width RW of at least a portion of the rib is greater than or equal to 4 mm.

The rib 764 of the support arm 762 can have a rib thickness RT measured perpendicular to the rear surface 719 of the striking face 718. The rib thickness RT can vary along the length of the rib. In one embodiment, the rib thickness RT of at least a portion of the rib is greater than or equal to 2 mm. In an additional embodiment, the rib thickness RT of at least a portion of the rib is greater than or equal to 3 mm. In an additional embodiment, the rib thickness RT of at least a portion of the rib is greater than or equal to 4 mm. In an additional embodiment, the rib thickness RT of at least a portion of the rib is greater than or equal to 5 mm. In an additional embodiment, the rib thickness RT of at least a portion of the rib is greater than or equal to 6 mm.

The supported region 742, as illustrated in FIG. 10, is specifically located on the rear surface 719 of the striking face 718. The striking face heel reference plane 759 extends parallel to the y-axis and the x-axis and is offset 1 mm towards the heel from the heel-most extent of the scorelines 760 formed in the striking face 718. The geometric center 743 of the supported region 742 is located a supported region offset length SROL toeward from the striking face heel reference plane 759 measured parallel to the ground plane GP and parallel to the striking face 718 with the golf club head 700 in an address position. In one embodiment, the supported region offset length SROL is greater than or equal to 20 mm. In an additional embodiment, the supported region offset length SROL is greater than or equal to 22 mm. In an additional embodiment, the supported region offset length SROL is greater than or equal to 24 mm. In an additional embodiment, the supported region offset length SROL is greater than or equal to 26 mm. In an additional embodiment, the supported region offset length SROL is greater than or equal to 27 mm. In an additional embodiment, the supported region offset length SROL is greater than or equal to 28 mm.

The striking face length SFL is measured from the striking face heel reference plane 759 to the toe-most extent of the striking face 718, measured parallel to the ground plane GP and parallel to the striking face 718 with the golf club head 700 in an address position. In one embodiment, the striking face length SFL is greater than or equal to 60 mm. In an additional embodiment, the striking face length SFL is greater than or equal to 65 mm. In an additional embodiment, the striking face length SFL is greater than or equal to 70 mm. In an additional embodiment, the striking face length SFL is greater than or equal to 71 mm. In an additional embodiment, the striking face length SFL is greater than or equal to 72 mm. In an additional embodiment, the striking face length SFL is greater than or equal to 73 mm. In an additional embodiment, the striking face length SFL is greater than or equal to 74 mm.

In one embodiment, the supported region offset ratio, defined as the supported region offset length SROL divided by the striking face length SFL multiplied by 100%, is greater than or equal to 40%. In an additional embodiment, the supported region offset ratio is greater than or equal to 41%. In an additional embodiment, the supported region offset ratio is greater than or equal to 42%. In an additional embodiment, the supported region offset ratio is greater than or equal to 43%. In an additional embodiment, the supported region offset ratio is greater than or equal to 44%. In an additional embodiment, the supported region offset ratio is greater than or equal to 45%. In an additional embodiment, the supported region offset ratio is greater than or equal to 46%. In an additional embodiment, the supported region offset ratio is greater than or equal to 47%. In an additional embodiment, the supported region offset ratio is greater than or equal to 48%. In an additional embodiment, the supported region offset ratio is greater than or equal to 49%. In an additional embodiment, the supported region offset ratio is greater than or equal to 50%. In an additional embodiment, the supported region offset ratio is greater than or equal to 51%.

An additional benefit of incorporating a supported region 742 is the ability to utilize a thin striking face. In the illustrated embodiments, the striking face 718 has a constant thickness. In other embodiments, the striking face may have a variable thickness. In one embodiment, the thickness of the striking face is less than or equal to 2.5 mm. In an additional embodiment, the thickness of the striking face is less than or equal to 2.4 mm. In an additional embodiment, the thickness of the striking face is less than or equal to 2.3 mm. In an additional embodiment, the thickness of the striking face is less than or equal to 2.2 mm. In an additional embodiment, the thickness of the striking face is less than or equal to 2.1 mm. In an additional embodiment, the thickness of the striking face is less than or equal to 2.0 mm. In an additional embodiment, the thickness of the striking face is less than or equal to 1.9 mm. In an additional embodiment, the thickness of the striking face is less than or equal to 1.8 mm. In an additional embodiment, the thickness of the striking face is less than or equal to 1.7 mm. In an additional embodiment, the thickness of the striking face is less than or equal to 1.6 mm. In an additional embodiment, the thickness of the striking face is less than or equal to 1.5 mm. In an additional embodiment, the thickness of the striking face is less than or equal to 1.4 mm.

Figure 11B:
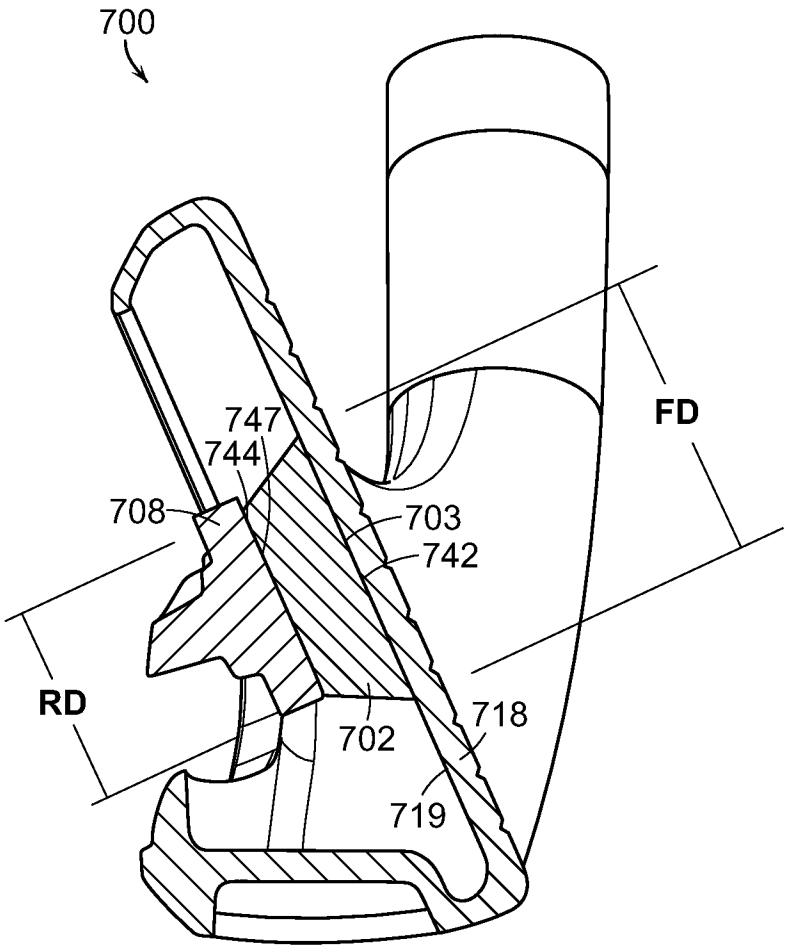
FIG. 11B depicts a cross sectional view of the golf club head of FIG. 7C including an additional embodiment of an elastomer element.
Figure 11A:
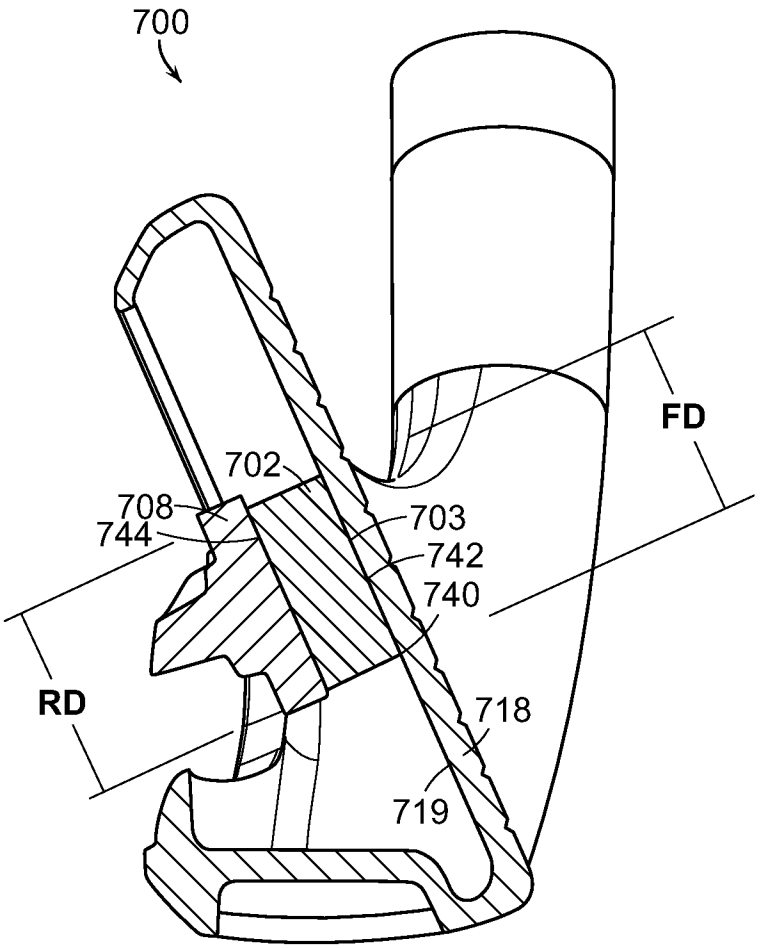
FIG. 11A depicts a cross sectional view of the golf club head of FIG. 7C including an additional embodiment of an elastomer element.

FIGS. 11A-11D depict the golf club head 700 of FIG. 7A having additional embodiments of an elastomer element 702. FIG. 11A illustrates a cross sectional view of the golf club head 700 including an additional embodiment of an elastomer element 702. The elastomer element 702 of FIG. 11A is circular similar to the embodiment illustrated in FIG. 7A. The front portion 703 of the elastomer element 702, which abuts the rear surface 719 of the striking face 718, has a front diameter FD and the rear portion 744, which abuts the cradle 708, has a rear diameter RD. The front diameter FD is substantially similar or equal to the rear diameter RD of the elastomer element 702 illustrated in FIG. 11A.

FIG. 11B illustrates a cross sectional view of the golf club head 700 including an additional embodiment of an elastomer element 702. The elastomer element 702 of FIG. 11B is circular. The front diameter FD is greater than rear diameter RD of the elastomer element 702 illustrated in FIG. 11B. The rear portion 744 of the elastomer element 702 in contact with the cradle 708 has a rear support region 747, which has an area.

Figure 11D:
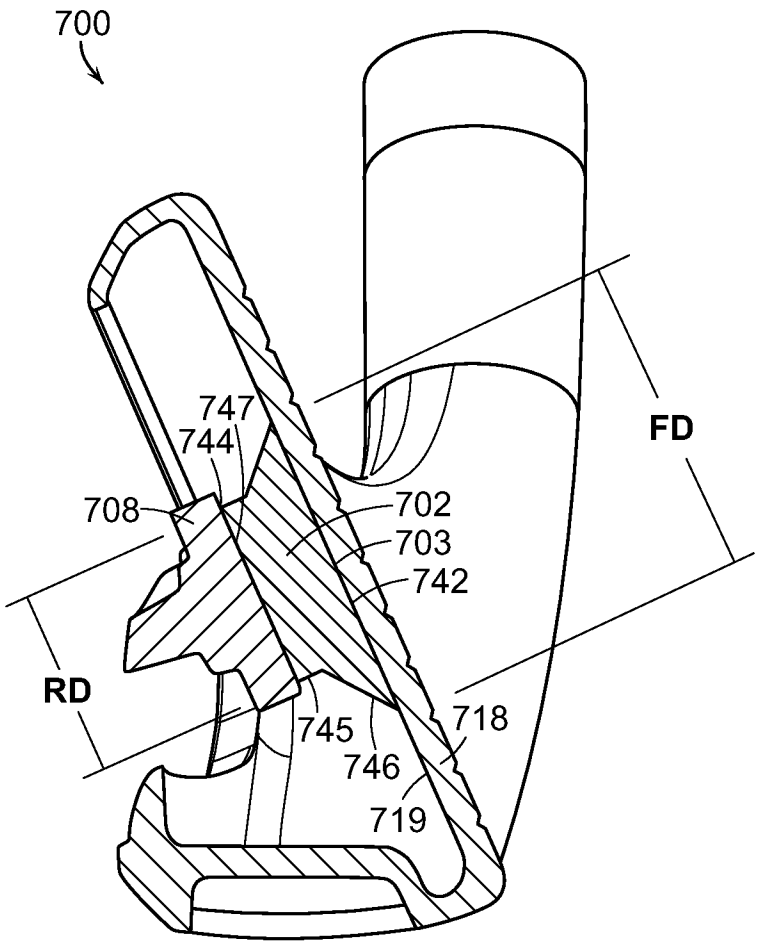
FIG. 11D depicts a cross sectional view of the golf club head of FIG. 7C including an additional embodiment of an elastomer element.
Figure 11C:
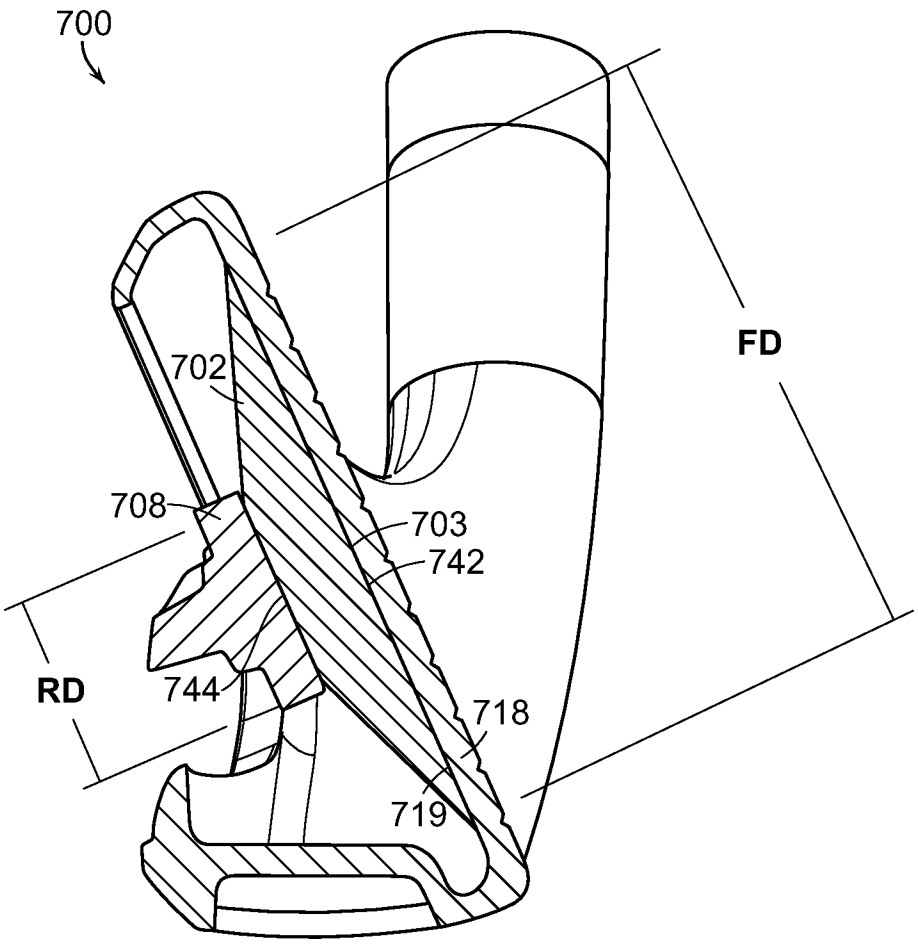
FIG. 11C depicts a cross sectional view of the golf club head of FIG. 7C including an additional embodiment of an elastomer element.

FIG. 11C illustrates a cross sectional view of the golf club head 700 including an additional embodiment of an elastomer element 702. The elastomer element 702 of FIG. 11C is circular. The front diameter FD is greater than rear diameter RD of the elastomer element 702 illustrated in FIG. 11C.

FIG. 11D illustrates a cross sectional view of the golf club head 700 including an additional embodiment of an elastomer element 702. The elastomer element 702 of FIG. 11D is circular. The front diameter FD is greater than rear diameter RD of the elastomer element 702 illustrated in FIG. 11D. Additionally, the rear portion 744 has a constant diameter region 745 aft of the tapered region 746 extending towards the striking face 718. In one embodiment, the rear diameter RD is approximately 12.5 mm and the front diameter FD is approximately 18.5 mm.

The enlarged front portion 703 and thus enlarged supported region 742 offered by the embodiments of the elastomer elements 702 illustrated in FIGS. 11B, 11C, and 11D offer advantages. These advantages include more consistent off-center ball speeds, reduced sound energy, particularly above 3800 Hz.

In one embodiment, the area of the supported region can be greater than 75 millimeters$^2$. In an additional embodiment, the area of the supported region can be greater than 100 millimeters$^2$. In an additional embodiment, the area of the supported region can be greater than 125 millimeters$^2$. In an additional embodiment, the area of the supported region can be greater than 150 millimeters$^2$. In an additional embodiment, the area of the supported region can be greater than 175 millimeters$^2$. In an additional embodiment, the area of the supported region can be greater than 200 millimeters$^2$. In an additional embodiment, the area of the supported region can be greater than 225 millimeters$^2$. In an additional embodiment, the area of the supported region can be greater than 250 millimeters$^2$. In an additional embodiment, the area of the supported region can be greater than 255 millimeters$^2$. In an additional embodiment, the area of the supported region can be greater than 260 millimeters$^2$. In an additional embodiment, the area of the supported region can be greater than 50 millimeters$^2$ and less than 1000 millimeters$^2$. In an additional embodiment, the area of the supported region can be greater than 100 millimeters$^2$ and less than 1000 millimeters$^2$. In an additional embodiment, the area of the supported region can be greater than 150 millimeters$^2$ and less than 1000 millimeters$^2$. In an additional embodiment, the area of the supported region can be greater than 200 millimeters$^2$ and less than 1000 millimeters$^2$. In an additional embodiment, the area of the supported region can be greater than 250 millimeters$^2$ and less than 1000 millimeters$^2$.

In one embodiment, the ratio of the front diameter FD divided by the rear diameter RD is greater than 1.2. In an additional embodiment, the ratio of the front diameter FD divided by the rear diameter RD is greater than 1.4. In an additional embodiment, the ratio of the front diameter FD divided by the rear diameter RD is greater than 1.6. In an additional embodiment, the ratio of the front diameter FD divided by the rear diameter RD is greater than 1.8. In an additional embodiment, the ratio of the front diameter FD divided by the rear diameter RD is greater than 2.0. In an additional embodiment, the ratio of the front diameter FD divided by the rear diameter RD is greater than 3.0. In an additional embodiment, the ratio of the front diameter FD divided by the rear diameter RD is greater than 4.0.

In one embodiment, the area of the supported region 742 is greater than the area of the rear support region 747. In one embodiment, the ratio of the supported region 742 divided by the area of the rear supported region 747 is greater than 1.2. In an additional embodiment, the ratio of the supported region 742 divided by the area of the rear supported region 747 is greater than 1.4. In an additional embodiment, the ratio of the supported region 742 divided by the area of the rear supported region 747 is greater than 1.6. In an additional embodiment, the ratio of the supported region 742 divided by the area of the rear supported region 747 is greater than 1.8. In an additional embodiment, the ratio of the supported region 742 divided by the area of the rear supported region 747 is greater than 2.0. In an additional embodiment, the ratio of the supported region 742 divided by the area of the rear supported region 747 is greater than 2.5. In an additional embodiment, the ratio of the supported region 742 divided by the area of the rear supported region 747 is greater than 3.0. In an additional embodiment, the ratio of the supported region 742 divided by the area of the rear supported region 747 is greater than 3.5. In an additional embodiment, the ratio of the supported region 742 divided by the area of the rear supported region 747 is greater than 4.0. In an additional embodiment, the ratio of the supported region 742 divided by the area of the rear supported region 747 is greater than 5.0. In an additional embodiment, the ratio of the supported region 742 divided by the area of the rear supported region 747 is greater than 6.0. In an additional embodiment, the ratio of the supported region 742 divided by the area of the rear supported region 747 is greater than 7.0. In an additional embodiment, the ratio of the supported region 742 divided by the area of the rear supported region 747 is greater than 8.0. In an additional embodiment, the ratio of the supported region 742 divided by the area of the rear supported region 747 is greater than 9.0. In an additional embodiment, the ratio of the supported region 742 divided by the area of the rear supported region 747 is greater than 10.0.

The contact energy absorption factor is defined as the ratio of the front diameter FD divided by the diameter of a golf ball, which is approximately 42.75 mm. In one embodiment, the contact energy absorption factor is greater than 0.1. In an additional embodiment, the contact energy absorption factor is greater than 0.2. In an additional embodiment, the contact energy absorption factor is greater than 0.3. In an additional embodiment, the contact energy absorption factor is greater than 0.4. In an additional embodiment, the contact energy absorption factor is greater than 0.5. In an additional embodiment, the contact energy absorption factor is greater than 0.6. In an additional embodiment, the contact energy absorption factor is greater than 0.7. In an additional embodiment, the contact energy absorption factor is greater than 0.8. In an additional embodiment, the contact energy absorption factor is greater than 0.9. In an additional embodiment, the contact energy absorption factor is greater than 1.0. In an additional embodiment, the contact energy absorption factor is less than 0.2. In an additional embodiment, the contact energy absorption factor is less than 0.3. In an additional embodiment, the contact energy absorption factor is less than 0.4. In an additional embodiment, the contact energy absorption factor is less than 0.5. In an additional embodiment, the contact energy absorption factor is less than 0.6. In an additional embodiment, the contact energy absorption factor is less than 0.7. In an additional embodiment, the contact energy absorption factor is less than 0.8. In an additional embodiment, the contact energy absorption factor is less than 0.9. In an additional embodiment, the contact energy absorption factor is less than 1.0.

In additional embodiments, the elastomer elements 702 may not be circular. They may have additional shapes which may include square, rectangular, octagonal, etc.

Figure 12A:
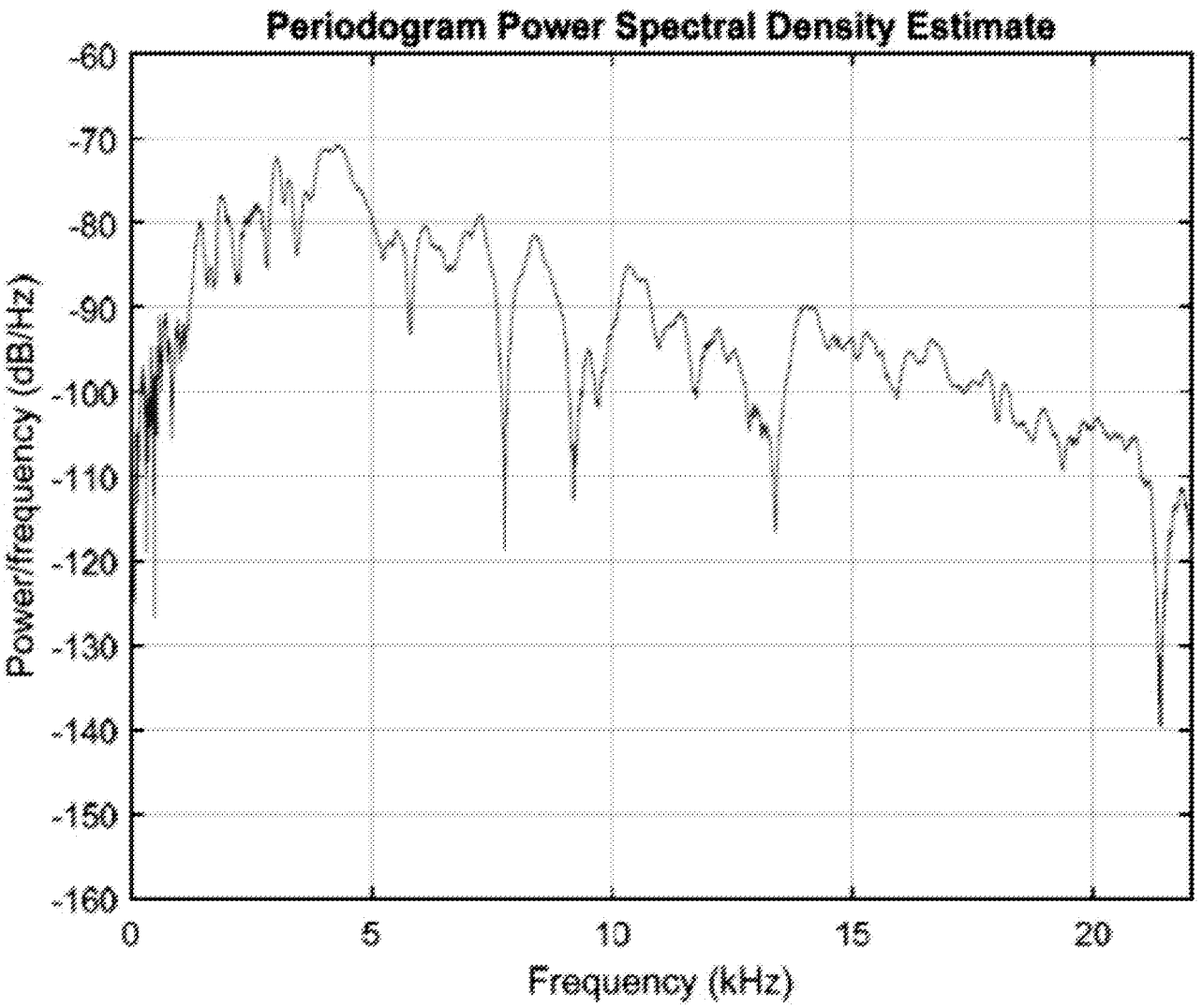
FIG. 12A depicts the periodogram power spectral density estimate of the golf club head depicted in FIG. 11A.
Figure 12B:
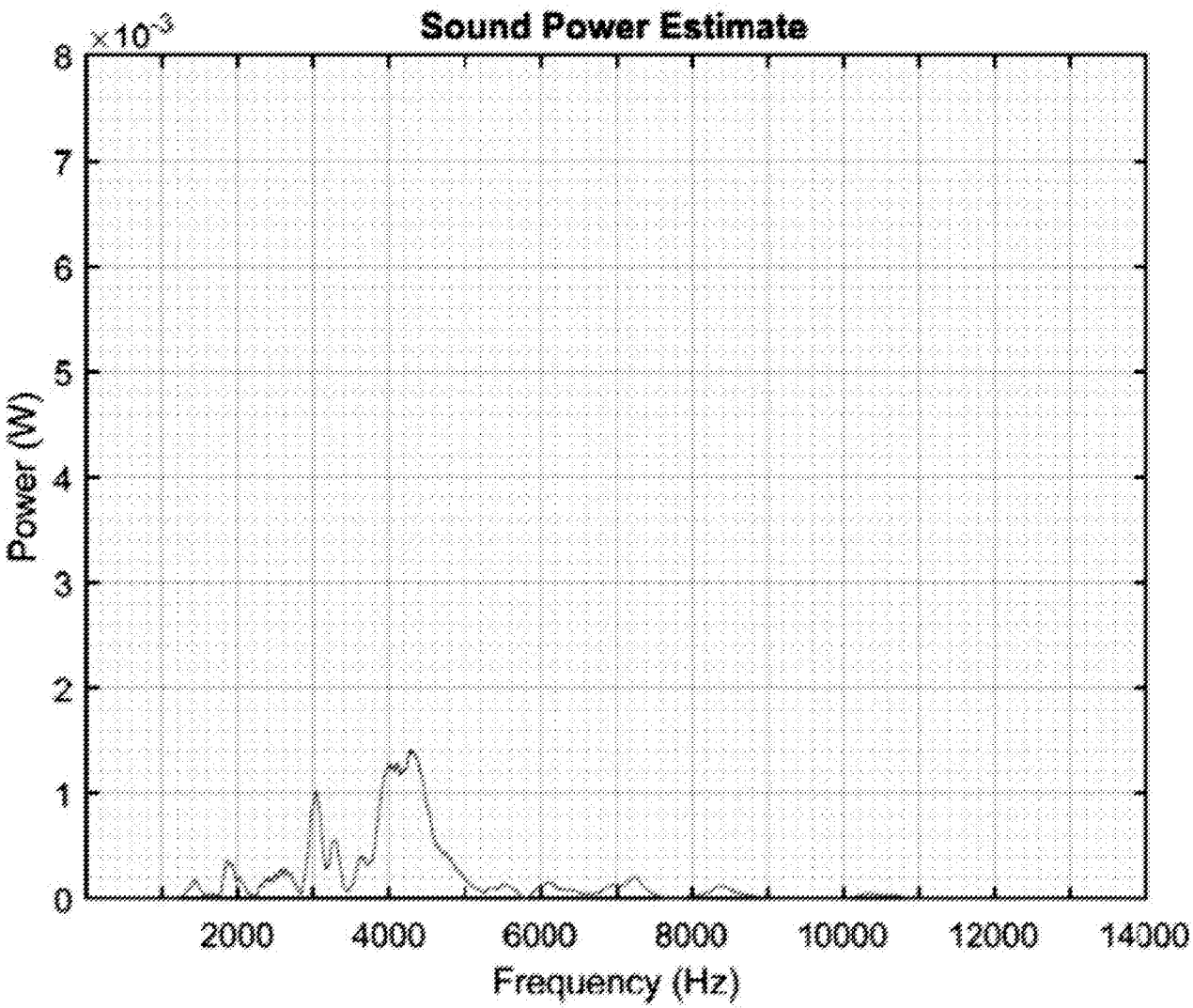
FIG. 12B depicts the sound power estimate of the golf club head depicted in FIG. 11A.
Figure 13A:
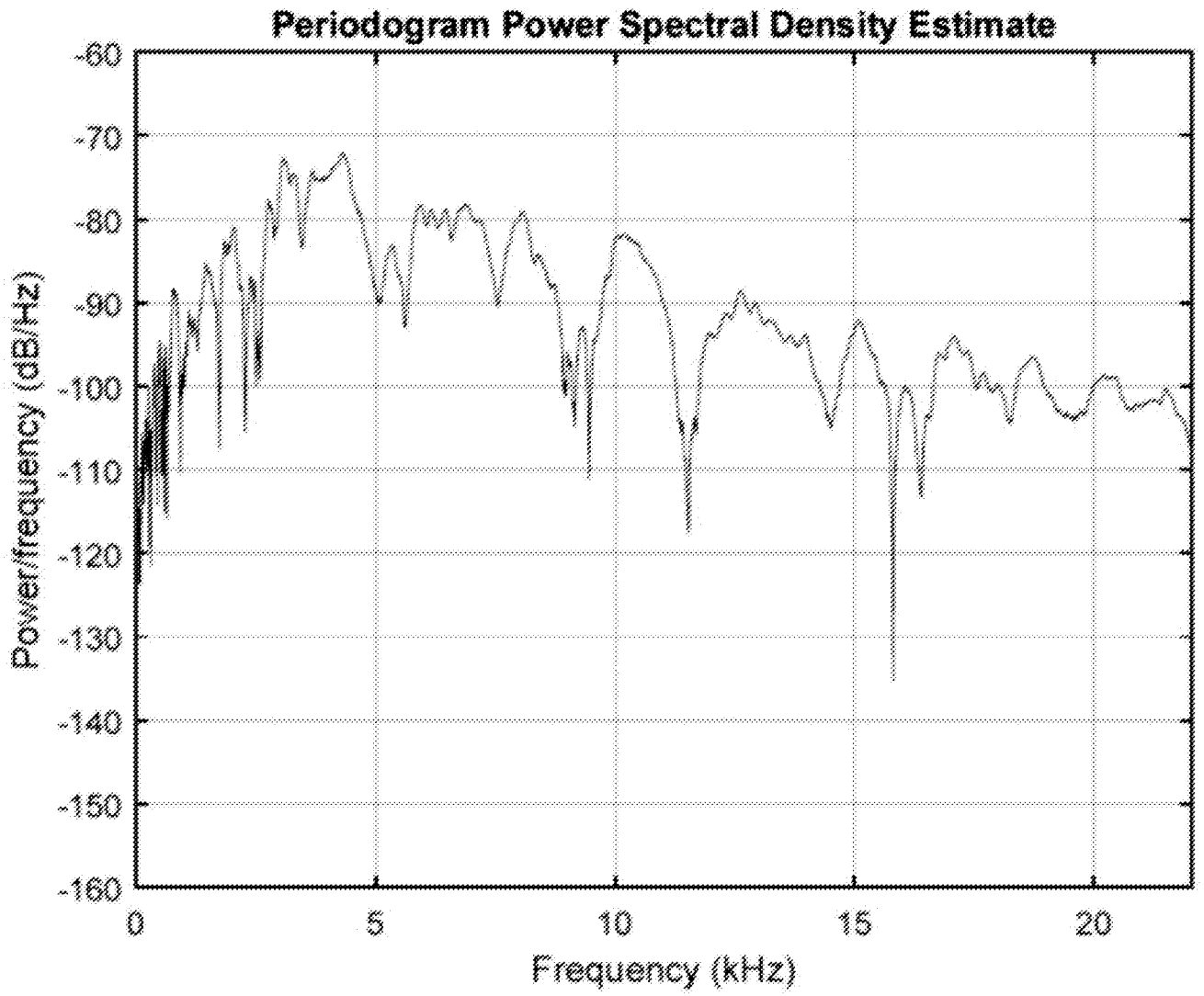
FIG. 13A depicts the periodogram power spectral density estimate of the golf club head depicted in FIG. 11D.
Figure 13B:
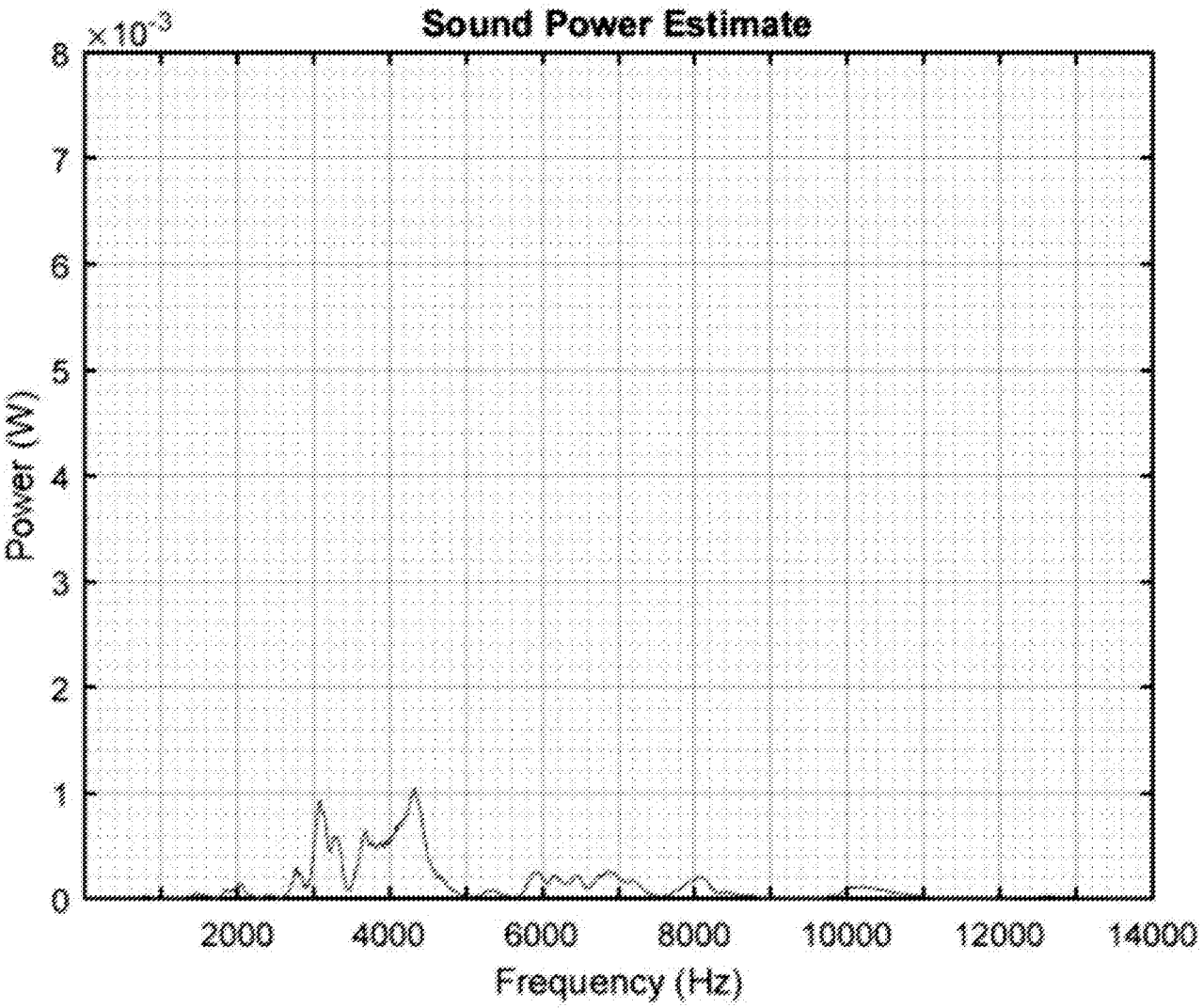
FIG. 13B depicts the sound power estimate of the golf club head depicted in FIG. 11D.

Identical golf club heads with different elastomer elements were subjected to acoustic testing to determine the effectiveness of different embodiments of elastomer elements. The testing was performed with each club head striking a Titleist ProV1 golf ball with a club head speed at impact of approximately 95 miles per hour. The acoustic qualities of the embodiments illustrated in FIGS. 11A and 11D were recorded when each golf club head struck a golf ball. FIGS. 12A and 12B reflect the recording of the golf club head utilizing the cylindrical elastomer element embodiment illustrated in FIG. 11A striking a golf ball and FIGS. 13A and 13B reflect the recording of the golf club head utilizing the tapered elastomer element embodiment illustrated in FIG. 11D striking a golf ball. FIG. 12A illustrates the periodogram power spectral density estimate of the FIG. 11A cylindrical embodiment. FIG. 12B illustrates the sound power estimate of the FIG. 11A cylindrical embodiment. FIG. 13A illustrates the periodogram power spectral density estimate of the FIG. 11D tapered embodiment. FIG. 13B illustrates the sound power estimate of the FIG. 11D tapered embodiment.

As illustrated in FIGS. 12A and 12B, the dominant frequency for the cylindrical elastomer element 702 of FIG. 11A is 4,279.7 HZ. As illustrated in FIGS. 13A and 13B, the dominant frequency for the tapered elastomer element 702 of FIG. 11D is 4317.4 Hz. Generally, when an iron type golf club head strikes a golf ball, sound frequencies produced between approximately 1,000 Hz and 3,800 Hz are produced by golf club and golf ball interaction and golf ball resonances while sound frequencies above approximately 3,800 Hz are produced solely by the golf club head. Thus, the first sound power peak in the sound power estimate graphs of FIGS. 12B and 13B correlates primarily to the golf ball and the subsequent sound power peak correlates to the vibration of the striking face of the golf club head. As illustrated in FIGS. 12B and 13B the peak sound power estimate below 3,800 Hz, corresponding to the golf ball, is approximately $1.00\times10^{-3}$ watts. As illustrated in FIG. 12B, the sound power generated by the golf club head utilizing the cylindrical elastomer element embodiment illustrated in FIG. 11A peaks at approximately $1.40\times10^{-3}$ watts. As illustrated in FIG. 13B, the sound power generated by the golf club head utilizing the tapered elastomer element embodiment illustrated in FIG. 11D peaks at approximately $1.04\times10^{-3}$ watts. Sound power levels correlate directly with the loudness of the sound produced by the golf club striking a golf ball. Therefore, it is evident that the sound produced by the golf club head utilizing the cylindrical elastomer element embodiment illustrated in FIG. 11A is significantly less loud than the golf club head utilizing the tapered elastomer element embodiment illustrated in FIG. 11D.

Additionally, the sound power generated by the golf club head utilizing the cylindrical elastomer element embodiment illustrated in FIG. 11A divided by the sound power generated by the golf ball is approximately 1.40. The sound power generated by the golf club head utilizing the cylindrical elastomer element embodiment illustrated in FIG. 11D divided by the sound power generated by the golf ball is approximately 1.04. In some embodiments, it is preferable to have the sound power generated by the golf club head divided by the sound power generated by the golf ball to be less than 1.50. In some embodiments, it is preferable to have the sound power generated by the golf club head divided by the sound power generated by the golf ball to be less than 1.40. In some embodiments, it is preferable to have the sound power generated by the golf club head divided by the sound power generated by the golf ball to be less than 1.30. In some embodiments, it is preferable to have the sound power generated by the golf club head divided by the sound power generated by the golf ball to be less than 1.20. In some embodiments, it is preferable to have the sound power generated by the golf club head divided by the sound power generated by the golf ball to be less than 1.10. In some embodiments, it is preferable to have the sound power generated by the golf club head divided by the sound power generated by the golf ball to be less than 1.00.

FIGS. 14A-L depict additional embodiments of an elastomer element 702, which can also be referred to as a deformable member. These embodiments are designed with variable compressive stiffness, spring rate, or flexural modulus. This can be achieved through various geometries as well as combinations of various co-molded materials of different durometers.

Figure 14A:
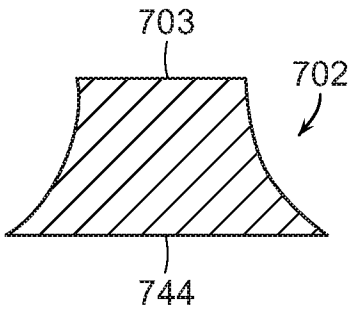
FIG. 14A illustrates a cross sectional view of an elastomer element having a larger rear portion than front portion.
Figure 14B:
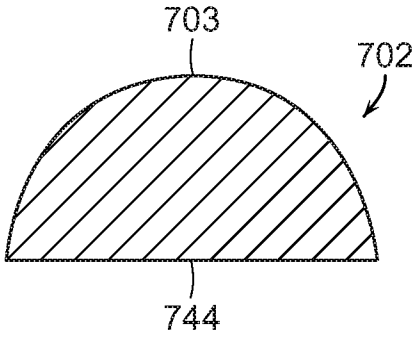
FIG. 14B illustrates a cross sectional view of an elastomer element having a larger rear portion than front portion.
Figure 14C:
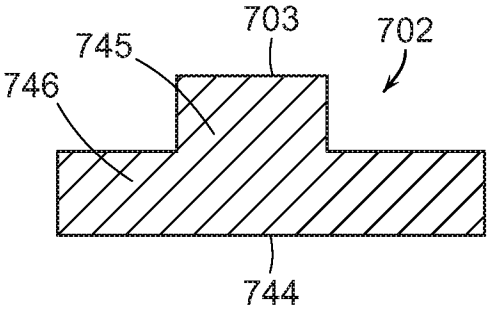
FIG. 14C illustrates a cross sectional view of an elastomer element having a larger rear portion than front portion.
Figure 14D:
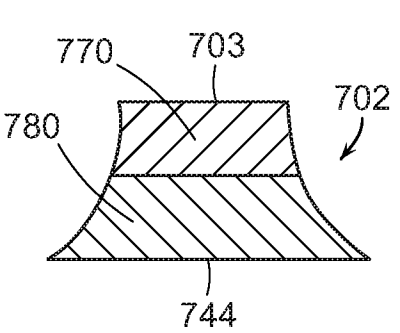
FIG. 14D illustrates a cross sectional view of an elastomer element similar to that of FIG. 14A but includes a first material and a second material.
Figure 14E:
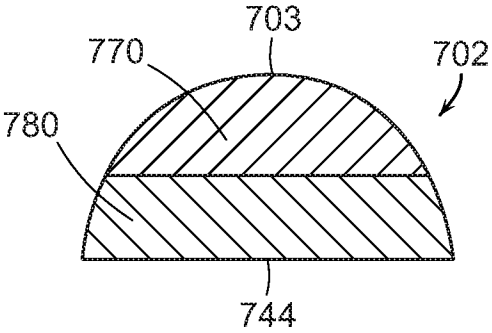
FIG. 14E illustrates a cross sectional view of an elastomer element similar to that of FIG. 14B but includes a first material and a second material.
Figure 14F:
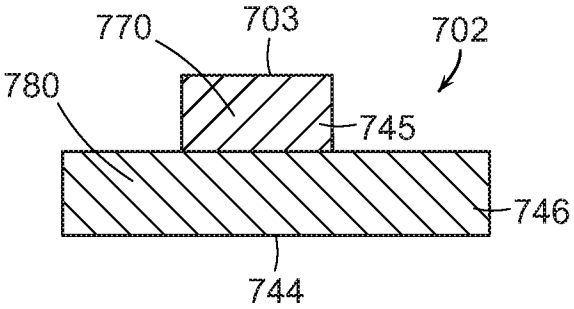
FIG. 14F illustrates a cross sectional view of an elastomer element similar to that of FIG. 14C but includes a first material and a second material.

FIG. 14A illustrates a cross sectional view of an elastomer element 702 having a larger rear portion 744 than front portion 702. The front portion 702 and rear portion 744 are substantially planar. FIG. 14B illustrates a cross sectional view of an elastomer element 702 having a larger rear portion 744 than front portion 702. The rear portion 744 is substantially planar and the front portion 702 is hemispherical. FIG. 14C illustrates a cross sectional view of an elastomer element 702 having a larger rear portion 744 than front portion 702. The elastomer element 702 includes a front constant diameter region 746 and a rear constant diameter region 745, where the rear constant diameter region 746 has a larger diameter than the front constant diameter region 745. FIG. 14D illustrates a cross sectional view of an elastomer element 702 similar to that of FIG. 14A but includes a first material 770 and a second material 780. In one embodiment, the first material 770 can be stiffer than the second material 780. In an additional embodiment, the second material 780 can be stiffer than the first material 770. FIG. 14E illustrates a cross sectional view of an elastomer element 702 similar to that of FIG. 14B but includes a first material 770 and a second material 780. FIG. 14F illustrates a cross sectional view of an elastomer element 702 similar to that of FIG. 14C but includes a first material 770 and a second material 780.

FIG. 14G illustrates a cross sectional view of an elastomer element 702 similar to that of FIG. 14A but the center of the front portion 703 is offset from a center of the rear portion 744. The offset can be towards the topline, towards, the sole, towards the toe, towards the heel, or any combination thereof. FIG. 14H illustrates a cross sectional view of an elastomer element 702 similar to that of FIG. 14B but the center of the front portion 703 is offset from a center of the rear portion 744. FIG. 14I illustrates a cross sectional view of an elastomer element 702 similar to that of FIG. 14C but the center of the front portion 703 is offset from a center of the rear portion 744. FIG. 14J illustrates a cross sectional view of an elastomer element 702 which necks down in diameter between the front portion 703 and the rear portion 744. FIG. 14K illustrates a cross sectional view of an elastomer element 702 which necks down in diameter between the front portion 703 and the rear portion 744. FIG. 14L illustrates a cross sectional view of an elastomer element 702 similar to that of FIG. 14J but includes a first material 770 and a second material 780.

Any of these embodiments of elastomer element 702 described herein can be flipped, such that the rear portion 744 abuts the rear surface of the striking face rather than the front portion 704. Additionally, the embodiments illustrated in FIGS. 14A-14L are circular when viewed from a front view in a preferred embodiment. In other embodiments, the elastomer elements may comprise different shapes. In some embodiments, the flexural modulus of the first material can be greater than the flexural modulus of the second material.

Figure 15A:
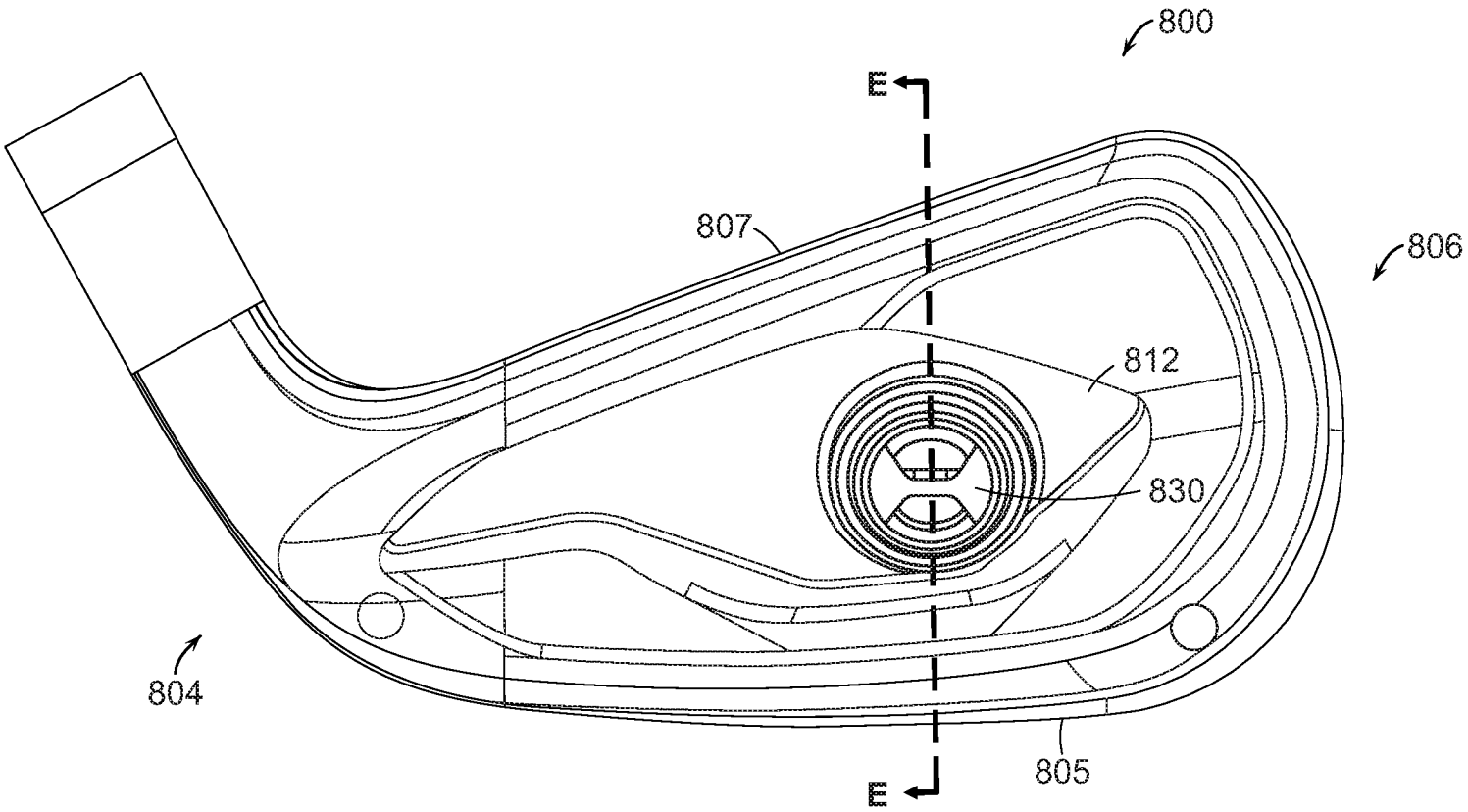
FIG. 15A depicts a rear view of the golf club head.
Figure 15B:
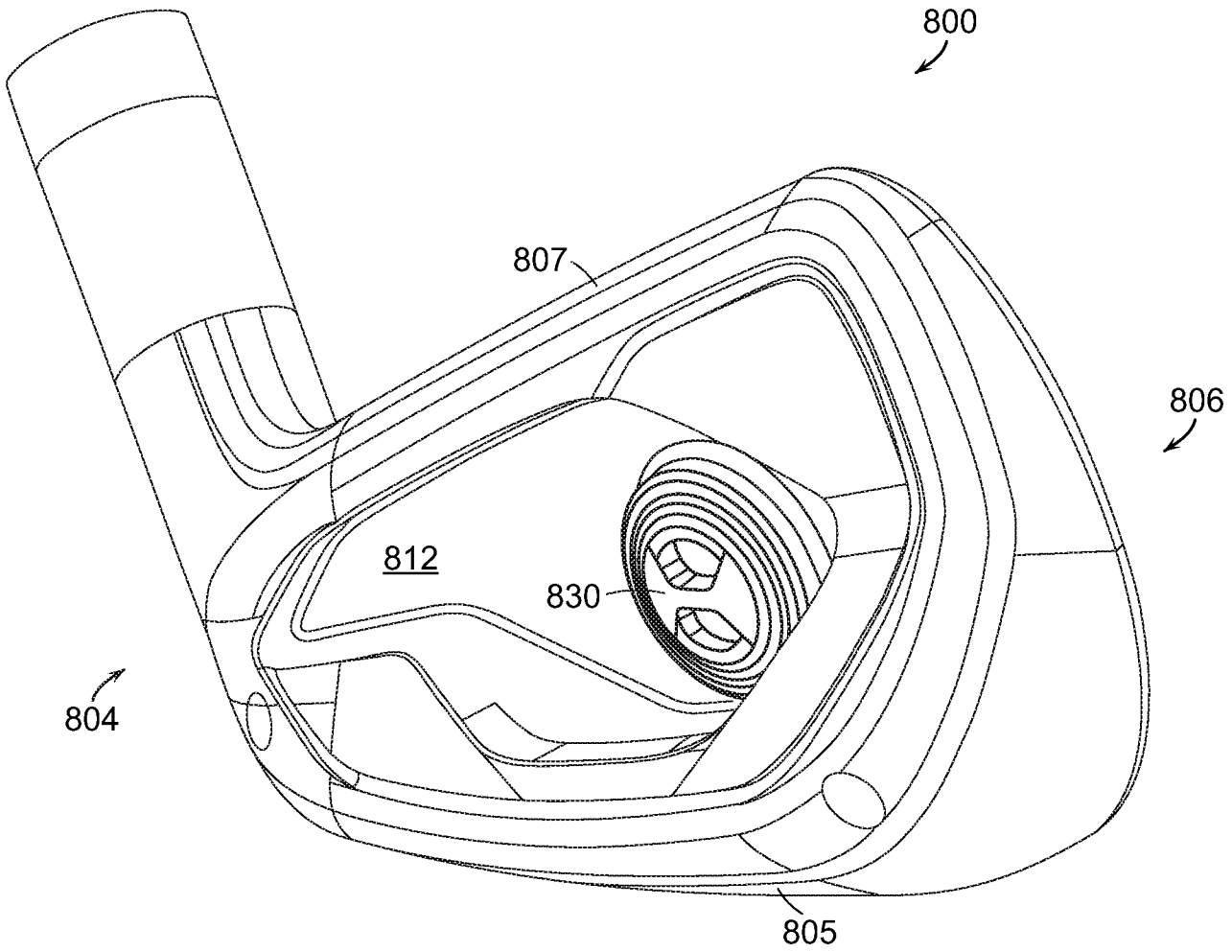
FIG. 15B depicts a perspective view of the golf club head of FIG. 15A.
Figure 15C:
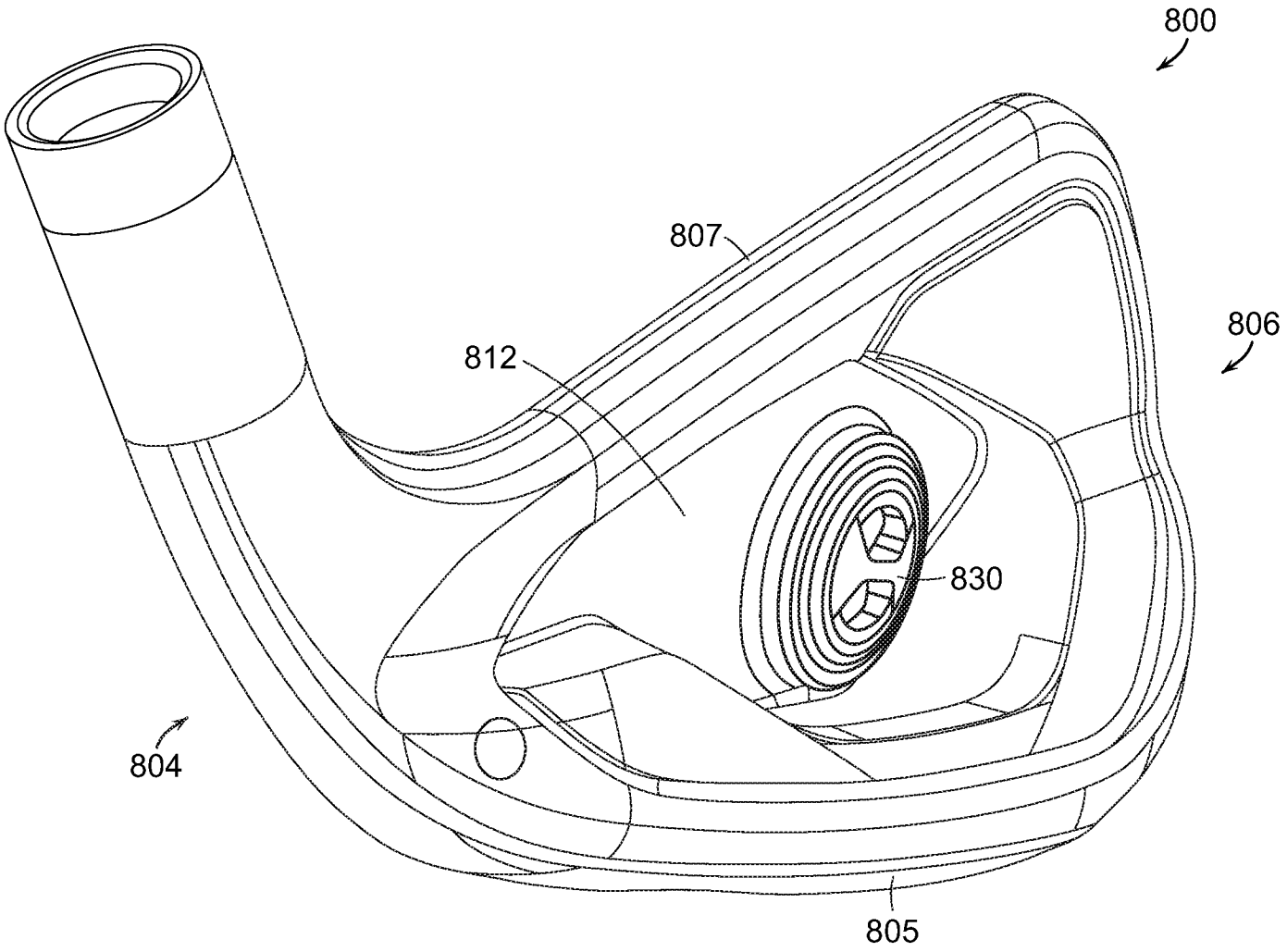
FIG. 15C depicts an additional perspective view of the golf club head of FIG. 15A.
Figure 16:
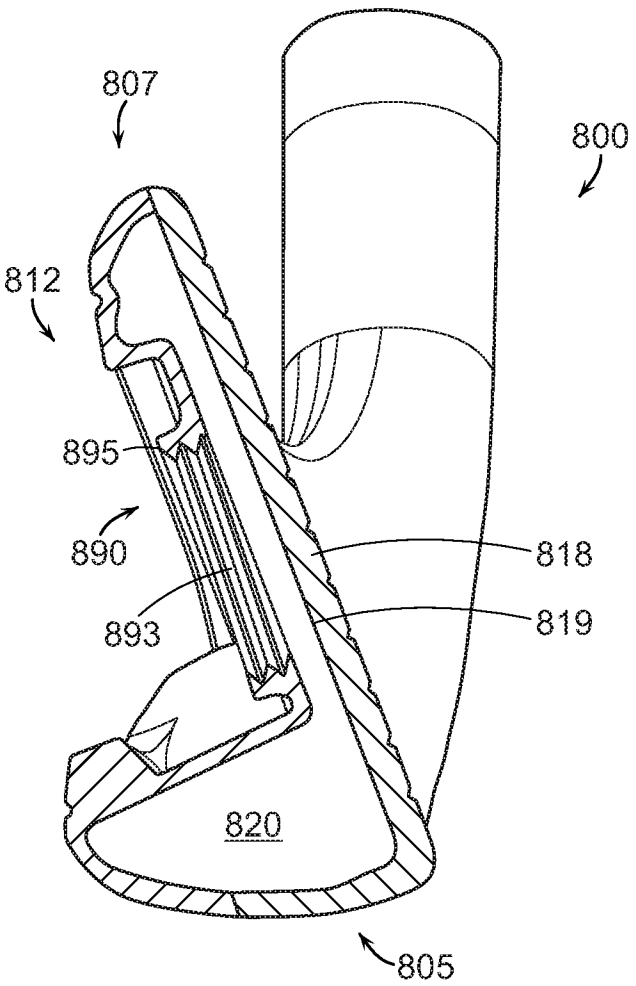
FIG. 16 depicts the section view E-E of the golf club head of FIG. 15D without the adjustment driver and elastomer element installed.
Figure 15D:
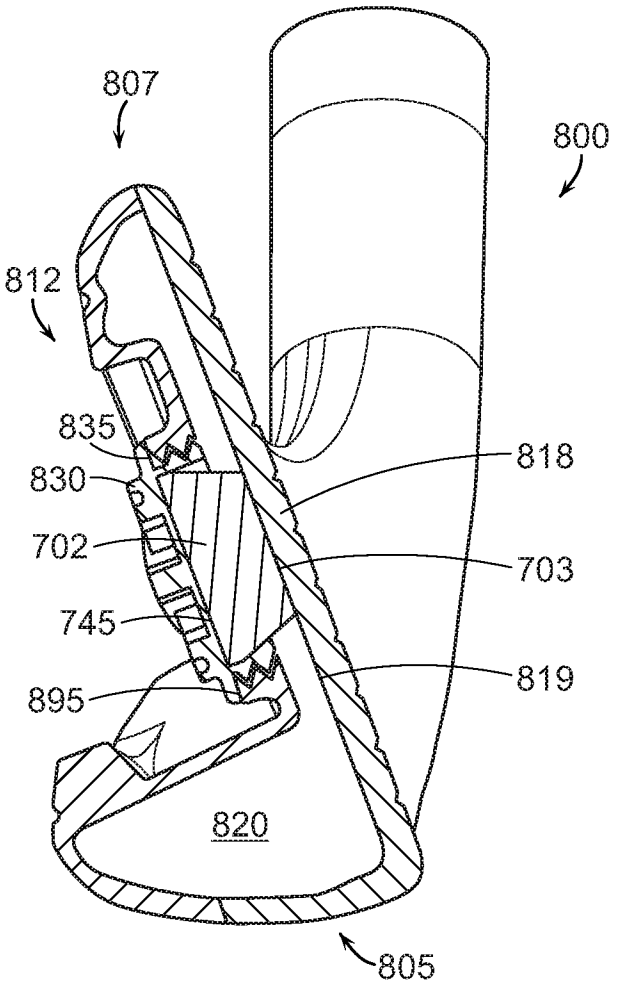
FIG. 15D depicts a section view E-E of the golf club head of FIG. 15A.
Figure 17C:
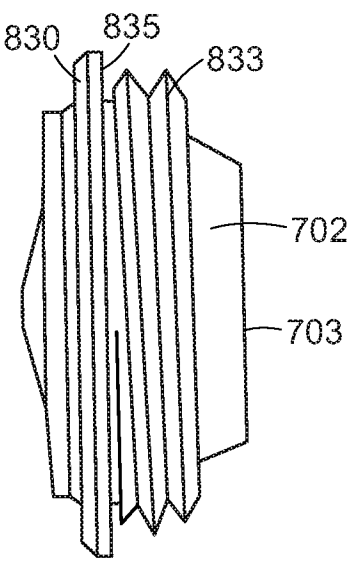
FIG. 17C depicts a side view of the adjustment driver and elastomer element of the golf club head of FIG. 15A.
Figure 17B:
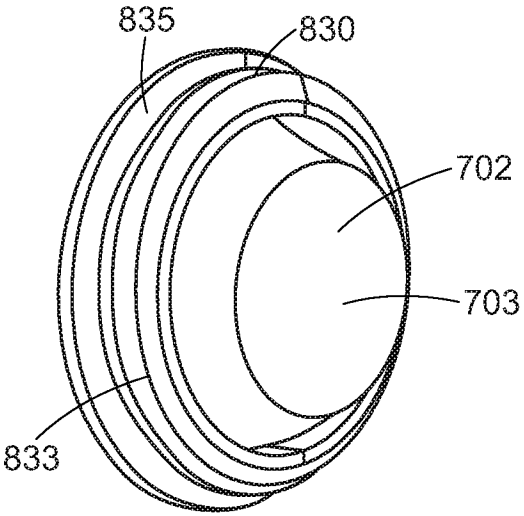
FIG. 17B depicts an additional perspective view of the adjustment driver and elastomer element of the golf club head of FIG. 15A.
Figure 17A:
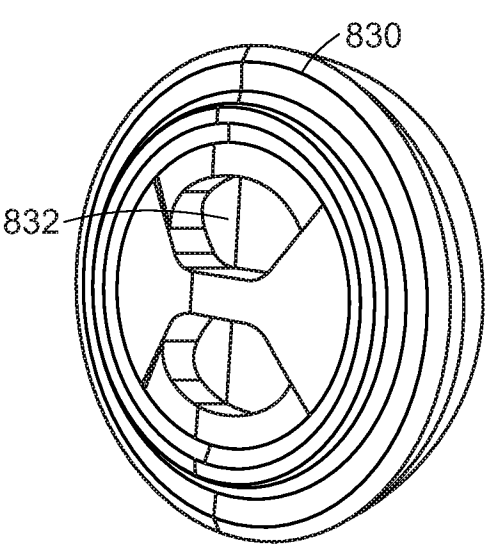
FIG. 17A depicts a perspective view of the adjustment driver and elastomer element of the golf club head of FIG. 15A.
Figure 17E:
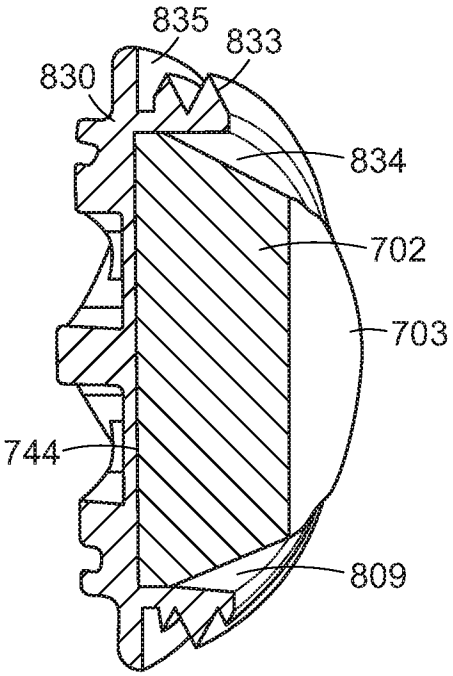
FIG. 17E depicts an additional perspective of the section view of the adjustment driver and elastomer element of FIG. 17A.
Figure 17D:
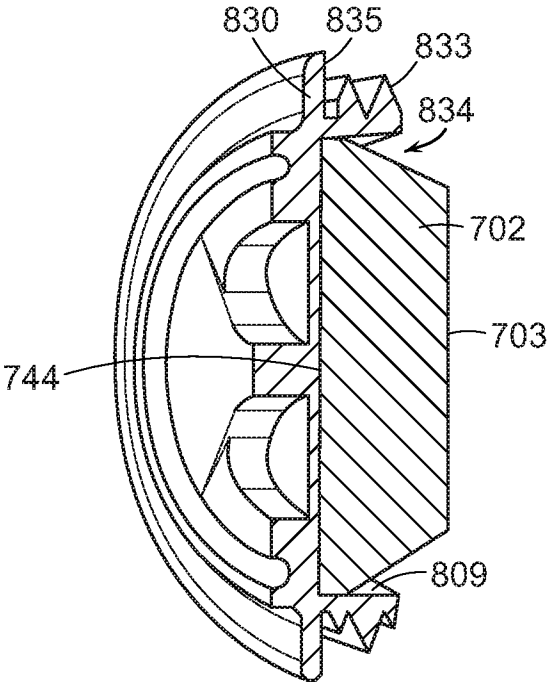
FIG. 17D depicts a section view of the adjustment driver and elastomer element of FIG. 17A.

FIGS. 15A-15D depict a golf club head 800 having an elastomer element 702. FIG. 15A depicts a rear view of the golf club head 800. FIG. 15B depicts a perspective view of the golf club head 800 of FIG. 15A. FIG. 15C depicts an additional perspective view of the golf club head 800 of FIG. 15A. FIG. 15D depicts a section view E-E of the golf club head 800 of FIG. 15A. FIG. 16 depicts the section view E-E of the golf club head 800 of FIG. 15D without the adjustment driver 830 and elastomer element 702 installed. FIG. 17A depicts a perspective view of the adjustment driver 830 and elastomer element 702 of the golf club head 800 of FIG. 15A. FIG. 17B depicts an additional perspective view of the adjustment driver 830 and elastomer element 702 of the golf club head 800 of FIG. 15A. FIG. 17C depicts a side view of the adjustment driver 830 and elastomer element 702 of the golf club head 800 of FIG. 15A. FIG. 17D depicts a section view of the adjustment driver 830 and elastomer element 702 of FIG. 17A. FIG. 17E depicts an additional perspective of the section view of the adjustment driver 830 and elastomer element 702 of FIG. 17A.

As illustrated in FIGS. 15D and 16, the golf club head 800 includes a striking face 818 having a rear surface 819. The golf club head 800 also includes a back portion 812 configured to support the elastomer element 702. The golf club head 800 is made with a hollow body construction and the back portion 812 covers a substantial portion of the back of the golf club head 800. The back portion 812 is located behind the striking face 818 and extends between the topline 807 and the sole 805 and from the heel 804 to the toe 806 forming a cavity 820. The elastomer element 702 is disposed within the cavity 820. As illustrated in FIG. 15D. the striking face 818 can be formed separately and welded to the rest of the golf club head 800. More specifically, the separately formed striking face portion can include a portion of the sole, forming an L-shaped striking face portion. In other embodiments, the striking face 818 may be formed integrally with the rest of the golf club.

The golf club head 800 includes an adjustment driver 830 much like the adjustment driver 330 described earlier and illustrated in FIGS. 3A and 3B. The golf club head 800 also includes a deformable member 702 disposed between the striking face 818 and the adjustment driver 830. The deformable member 702 can take the form of any of the elastomer elements described herein. The adjustment driver 830 is configured to retain the elastomer element 702 between the adjustment driver 830 and the striking face 818, with the front portion 703 of the elastomer element 702 contacting the rear surface 819 of the striking face 818 and the rear portion 744 of the elastomer element 702 contacting the adjustment driver 830. The adjustment driver can include an interface 834 configured to retain the elastomer element 702. The interface 834 can include a recess with a lip 809 surrounding at least a portion of the elastomer element 702 as illustrated in FIGS. 15D and 17A-17E.

The golf club head 800 can include an adjustment receiver 890, much like the adjustment receiver 306 illustrated in FIGS. 3A and 3B. As illustrated in FIG. 16, the adjustment receiver 890 can include an aperture formed in the back portion 812 of the golf club head 800. The aperture can include a threaded portion 893. Additionally, the adjustment receiver 890 can include a receiver shelf 895 for the adjustment driver 830 to engage when it is installed in the adjustment receiver 890 as illustrated in FIG. 15D. The adjustment driver 830, as illustrated in FIGS. 15D and 17A-17E, can include a threaded portion 833 configured to engage the threaded portion 893 of the adjustment receiver 890. Additionally, the adjustment driver 830 can include a flange 835 configured to engage the receiver shelf 895 of the adjustment receiver 890 when the adjustment driver 830 is installed in the adjustment receiver 890. The receiver shelf 895 and flange 835 help to ensure the elastomer element properly and consistently engages the rear surface 819 of the striking face 818 and provides the support necessary for optimal performance. While the adjustment driver 330 discussed earlier is configured such that it may be adjusted after assembly, the preferred embodiment of the adjustment driver 830 illustrated in FIGS. 15A-15D and 17A-17E is configured to be installed to a set position during assembly and remain in that position. The receiver shelf 895 and flange 835 help to ensure the adjustment driver 830 is installed consistently and that the elastomer element properly and consistently engages the rear surface 819 of the striking face 818 and provides the support necessary for optimal performance. The adjustment driver 830 can also include a screw drive 832 configured to receive a tool and allow the adjustment driver 830 to be rotated relative to the golf club head 800. Finally, the adjustment driver 830 can have a mass. In some embodiments, the mass of the golf club head can be adjusted by swapping out the adjustment driver 830 for another adjustment driver 830 having a different mass. The difference in mass can be achieved through the use of different materials for different adjustment drivers such as aluminum, brass, polymers, steel, titanium, tungsten, etc. In another embodiment, not illustrated, mass elements could be added to the adjustment driver to change the mass. In one embodiment, mass elements could be added to the recess of the adjustment driver. Additionally, the mass element added to the recess could also be used to change the distance between the rear portion of the elastomer element and the rear surface of the striking face, altering the compression of the elastomer element.

Figure 18:
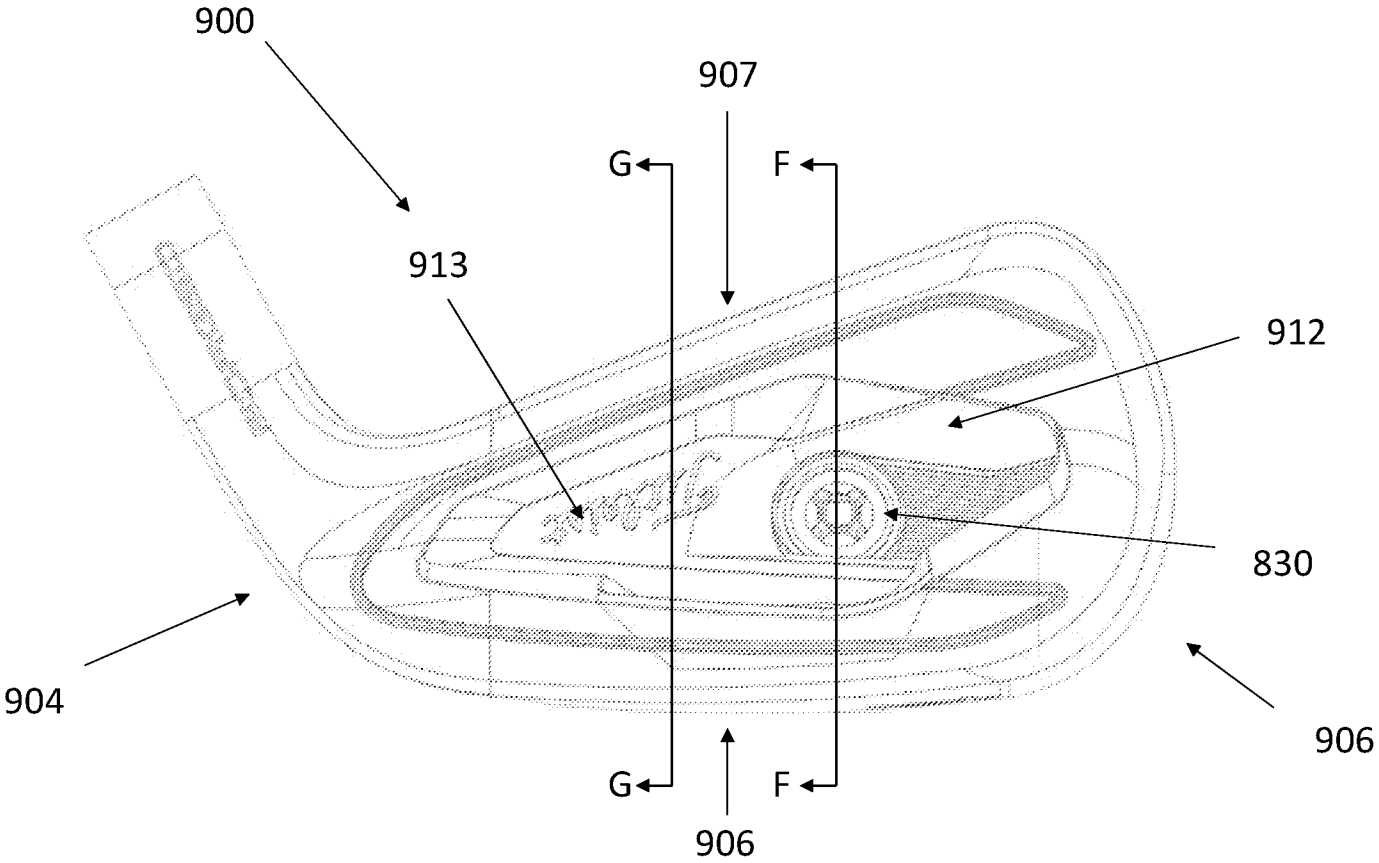
FIG. 18 depicts a rear view of the golf club head.
Figure 19:
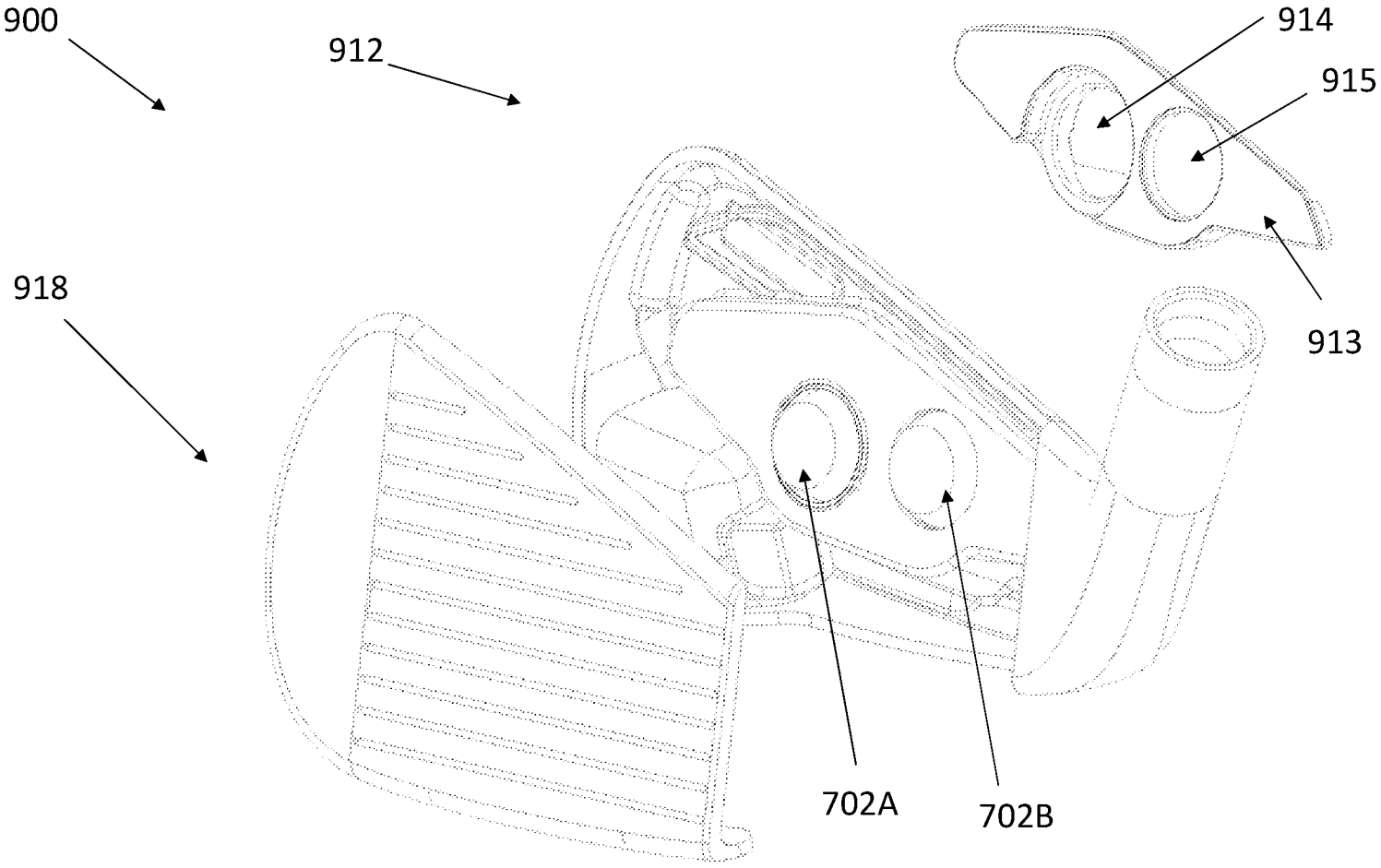
FIG. 19 depicts an exploded view of the golf club head of FIG. 18.
Figure 21:
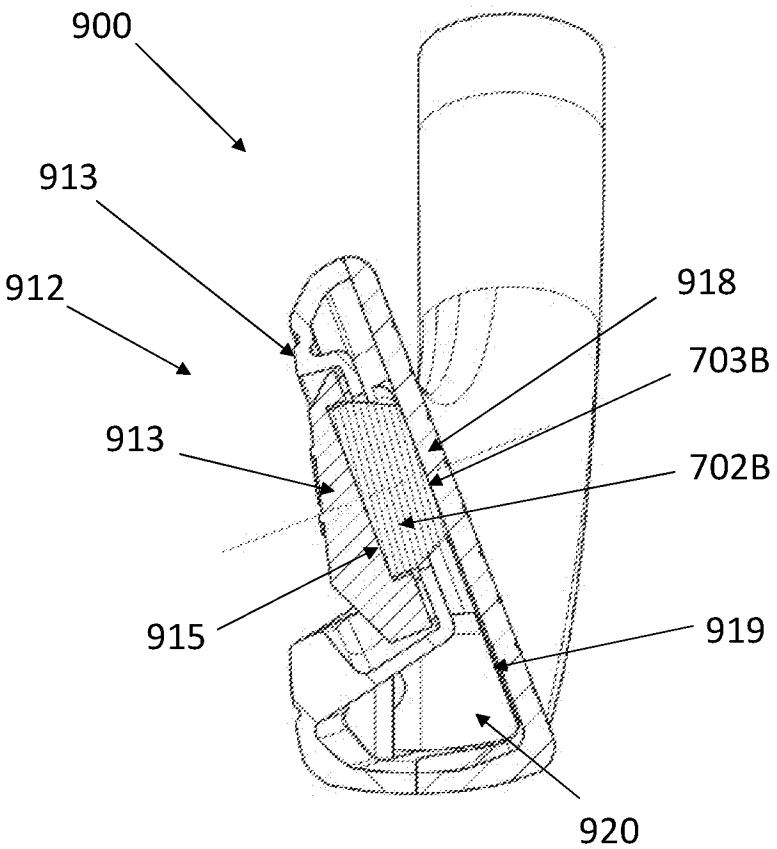
FIG. 21 depicts a section view G-G of the golf club head.
Figure 20:
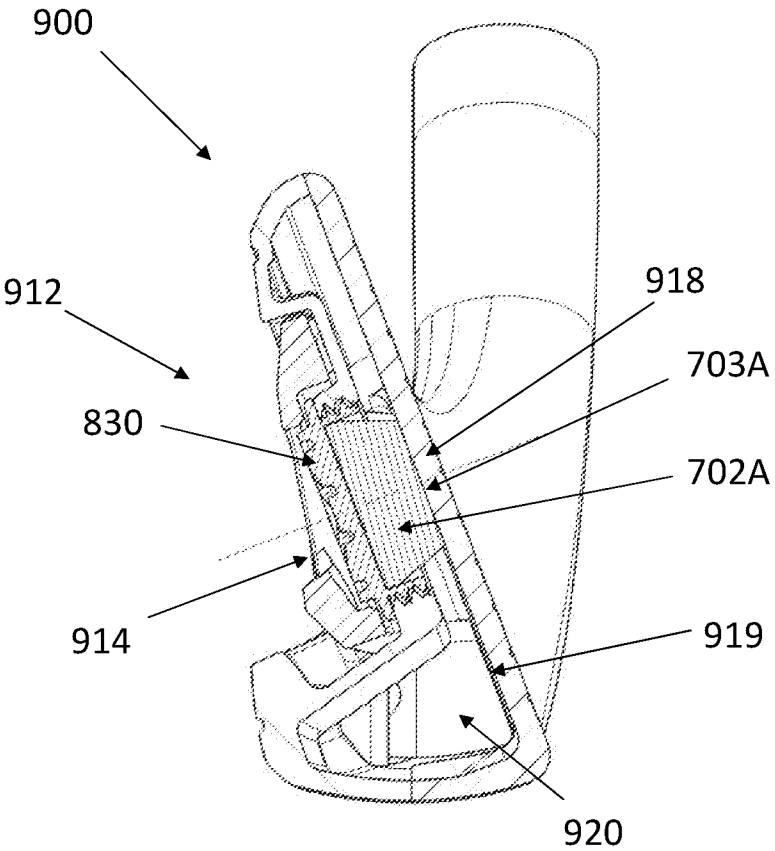
FIG. 20 depicts a section view F-F of the golf club head.
Figure 22:
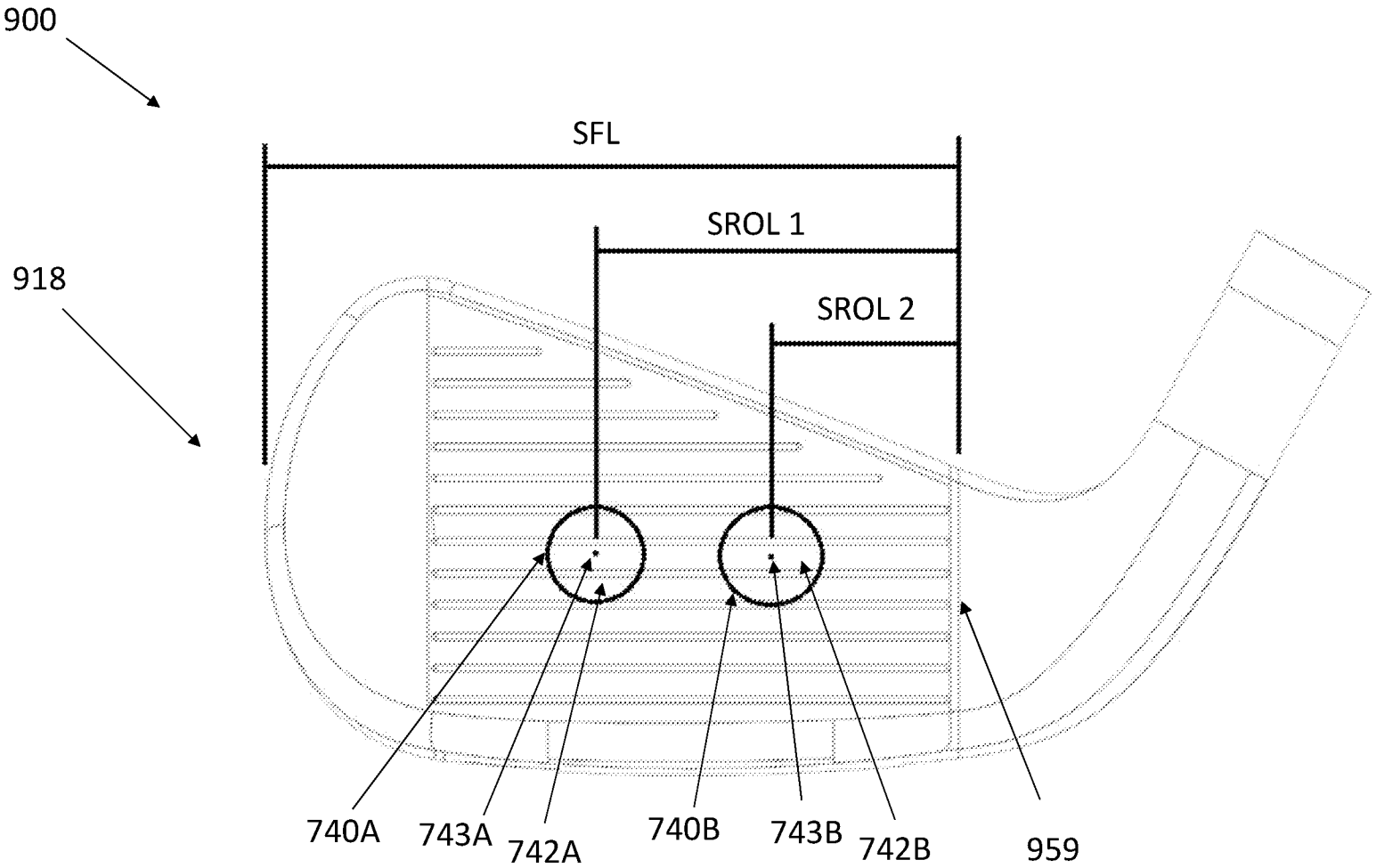
FIG. 22 depicts a frontal view of the golf club head of FIG. 18, including the supported regions.

FIGS. 18-22 depict a golf club head 900 similar to the golf club head 800 depicted in FIGS. 15A-15D. Golf club head 900 however includes a second deformable member 702B in addition to a first deformable member 702A. FIG. 18 depicts a rear view of the golf club head 900. FIG. 19 depicts an exploded view of the golf club head 900 of FIG. 18. FIG. 20 depicts a section view F-F of the golf club head 900. FIG. 21 depicts a section view G-G of the golf club head 900. FIG. 22 depicts a frontal view of the golf club head 900 of FIG. 18, including the supported regions.

As illustrated in FIGS. 18-22, the golf club head 900 includes a striking face 918 having a rear surface 919. The golf club head 900 also includes a back portion 912 configured to support the first deformable member 702A and the second deformable member 702B. The first deformable member 702A can be the same as the deformable member 700 described earlier. The first deformable member 702A and a second deformable member 702B can each take the form of any of the elastomer elements described herein. They may take the same form, or they make take different forms. The golf club head 900 is made with a hollow body construction and the back portion 912 covers a substantial portion of the back of the golf club head 900. The back portion 912 is located behind the striking face 918 and extends between the topline 917 and the sole 905 from the heel 904 to the toe 906 forming a cavity 920. In the preferred illustrated embodiments the first deformable member 702A is spaced from and does not contact the second deformable member 702B. In an alternative embodiment, the first deformable member 702A may be spaced closely to and contact the second deformable member 702B.

Much like golf club head 800, the golf club head 900 includes an adjustment driver 830 configured to retain the first deformable member 702A. The front portion 703A of the first deformable member 702A contacts the rear surface 919 of the striking face 918. The back portion 912 of the golf club head 900 includes a back cover 913. In the illustrated embodiment, the back cover 913 includes a recess 915 configured to retain the second deformable member 702B such that the front portion 703B of the second deformable member 702B contacts the rear surface 919 of the striking face 918. The back cover 913 also includes an aperture 914 for the adjustment driver 830. In one embodiment, the second deformable member is attached to the back cover 913 with an adhesive. Additionally, the back cover 913 can be attached to the rest of the golf club head 900 with an adhesive, which may include, for example, double sided tape. In one embodiment, the striking face 918 of the golf club head 900 is made from a high density material such as steel, whereas the back cover 913 is made from a low density material, such as plastic, which may include for example, acrylonitrile butadiene styrene. In an alternative embodiment, the back cover may also be made of a high density material.

As illustrated in FIG. 22, the striking face includes a plurality of supported regions. The first supported region 742A is defined by the portion of the rear surface 919 of the striking face 918 supported by the first deformable member 702A, which is defined by the area inside the first supported region perimeter 740A defined by the outer extent of the front portion 703A of the first deformable member 702A in contact with the rear surface 919 of the striking face 918. The second supported region 742B is defined by the portion of the rear surface 919 of the striking face 918 supported by the second deformable member 702B, which is defined by the area inside the second supported region perimeter 740B defined by the outer extent of the front portion 703B of the second deformable member 702B in contact with the rear surface 919 of the striking face 918. The first supported region 742A and second supported region 742B wouldn't normally be visible from the front of the golf club head 900 but was added in FIG. 22 for illustrative purposes.

The first geometric center 743A of the first supported region 742A is located a first supported region offset length SROL 1 toeward from the striking face heel reference plane 959, measured parallel to the ground plane and parallel to the striking face 918 with the golf club head 900 in an address position. The second geometric center 743B of the second supported region 742B is located a second supported region offset length SROL 2 toeward from the striking face heel reference plane 959, measured parallel to the ground plane and parallel to the striking face 918 with the golf club head 900 in an address position.

In a preferred embodiment, SROL 1 is approximately 36.0 mm and SROL 2 is approximately 17.6 mm. In a preferred embodiment SROL 1 is greater than SROL 2. In a preferred embodiment, SROL 1 divided by SROL2 is greater than 1.0. In a preferred embodiment, SROL 1 divided by SROL2 is greater than 1.25. In a preferred embodiment, SROL 1 divided by SROL2 is greater than 1.50. In a preferred embodiment, SROL 1 divided by SROL2 is greater than 1.75. In a preferred embodiment, SROL 1 divided by SROL2 is greater than 2.0. In an alternative embodiment, not illustrated, SROL 2 is greater than SROL 1.

In one embodiment, the first deformable member 702A is made of the same material as the second deformable member 702B and thus has the same hardness. In an additional embodiment, the first deformable member 702A is made of a material which has a greater hardness than the material of the second deformable member 702B. In an alternative embodiment, the material of the first deformable member 702A has a lower modulus than the material of the second deformable member 702B. In one embodiment, the first deformable member 702A has a Shore A 50 durometer and the second deformable member has a Shore A 10 durometer. In one embodiment, the first deformable member 702A has a Shore A durometer greater than 25 and the second deformable member has a Shore A durometer less than 25.

It should be noted that the first deformable member could be housed, structured, or supported similarly to the second deformable member and also the second deformable member could be housed, structured, or supported similarly to the first deformable member. Additionally, the first deformable member and second deformable member could be housed, structured, or supported in any fashion described throughout this disclosure.

Figure 24:
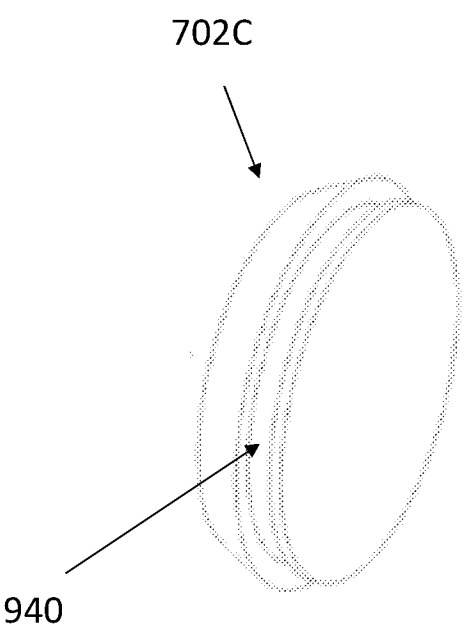
FIG. 24 depicts the second deformable member illustrated in FIG. 23.
Figure 23:
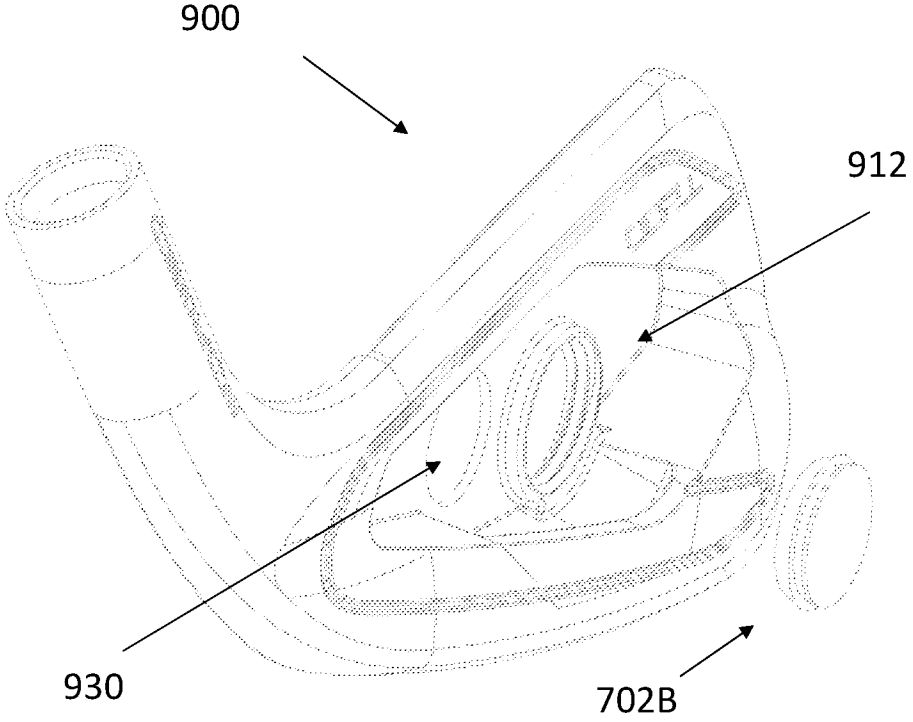
FIG. 23 depicts a perspective view of golf club head and an additional embodiment of the second deformable member.
Figure 25:
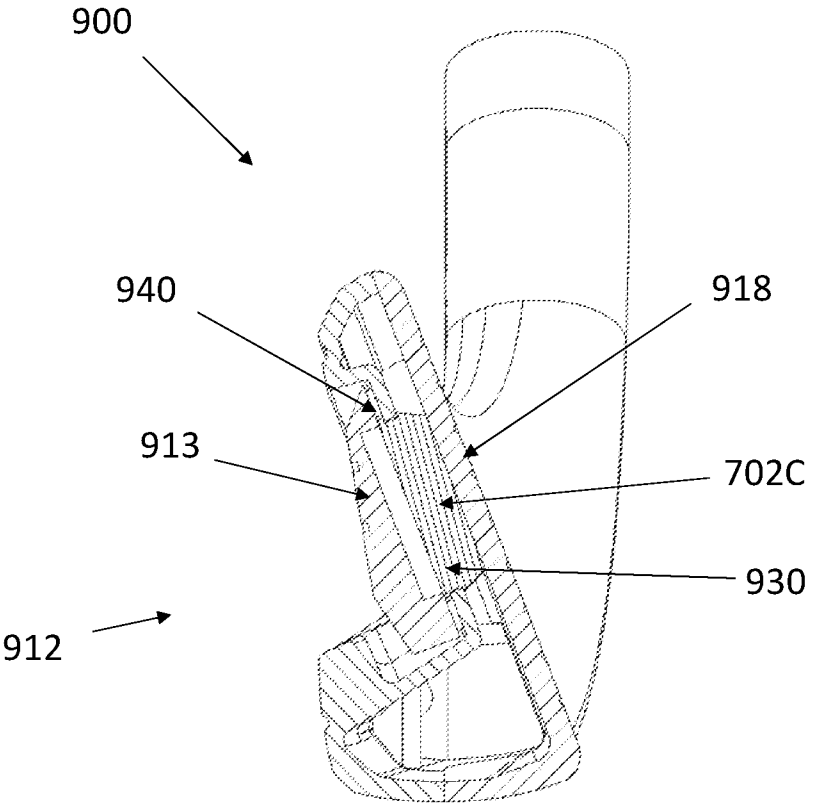
FIG. 25 depicts a section view F-F of the golf club head including the second deformable member illustrated in FIGS. 23 and 24.

FIG. 23 depicts a perspective view of golf club head 900 and an additional embodiment of the second deformable member 702C. The second deformable member 702C is illustrated in an exploded fashion behind the golf club head 900. FIG. 24 depicts the second deformable member 702C illustrated in FIG. 23. FIG. 25 depicts a section view F-F of the golf club head 900 including the second deformable member 702C illustrated in FIGS. 23 and 24. The back portion 912 of the golf club head 900 includes an aperture 930 configured to receive the second deformable member 702C, or alternatively the second deformable member 702B. The second deformable member 702C, as illustrated in FIGS. 23-25, includes an annular groove 940 formed therein configured to engage the perimeter of the aperture 930 of the back portion 912 of the golf club head 900 and secure the second deformable member 702C to the gold club head 900. Portions of the second deformable member 702C can be configured to deform as the second deformable member 702C is installed in the aperture 930 of the golf club head 900 until the groove 940 engages the aperture 930.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a club head body comprising a back portion and a striking face;

wherein said striking face comprises a front surface configured to strike a golf ball and a rear surface opposite said front surface;

wherein said back portion is spaced from said rear surface;

a first deformable member residing between said back portion and said rear surface of said striking face;

wherein said first deformable member comprises a front surface in contact with said rear surface of said striking face and a rear surface in contact with said back portion; and a second deformable member residing between said back portion and said rear surface of said striking face;

wherein said second deformable member comprises a front surface in contact with said rear surface of said striking face and a rear surface in contact with said back portion; and a coordinate system centered at a center of gravity of said golf club head, said coordinate system comprising a y-axis extending vertically, perpendicular to a ground plane when said golf club head is in an address position at prescribed loft and lie, an x-axis perpendicular to said y-axis and parallel to the striking face, extending towards a heel of said golf club head, and a z-axis, perpendicular to said y-axis and said x-axis and extending through said striking face, wherein said striking face comprises a plurality of scorelines, wherein said striking face comprises a heel reference plane extending parallel to said y-axis and said-x-axis, wherein said heel reference plane is offset 1 millimeter towards said heel from a heel-most extent of said scorelines, wherein said striking face comprises a striking face length measured from said heel reference plane to a toe-most extent of said front surface of said striking face parallel to said x-axis;

wherein said rear surface of said striking face comprises a first supported region, wherein a perimeter of said front surface of said first deformable member defines said first supported region, wherein said first supported region comprises a first geometric center, wherein said first geometric center of said first supported region is located a first supported region offset length toeward from said heel reference plane measured parallel to said x-axis;

wherein said rear surface of said striking face comprises a second supported region, wherein a perimeter of said front surface of said second deformable member defines said second supported region, wherein said second supported region comprises a second geometric center, wherein said second geometric center of said second supported region is located a second supported region offset length toeward from said heel reference plane measured parallel to said x-axis;

wherein said first supported region offset length divided by said second supported region offset length is greater than 1.0.

2. The golf club head of claim 1, wherein said first supported region offset length divided by said second supported region offset length is greater than 1.5.

3. The golf club head of claim 1, wherein said first supported region offset length divided by said second supported region offset length is greater than 2.0.

4. The golf club head of claim 1, wherein at least a portion of said striking face comprises a thickness of less than or equal to 2.2 mm.

5. The golf club head of claim 1, wherein said front surface of said first deformable member is circular having a front diameter, wherein said rear surface of said first deformable member is circular having a rear diameter, wherein said front diameter is less than said rear diameter and wherein said front surface of said second deformable member is circular having a front diameter, wherein said rear surface of said second deformable member is circular having a rear diameter, wherein said front diameter is less than said rear diameter.

6. The golf club head of claim 1, wherein said first deformable member has a greater Shore A durometer than said second deformable member.

7. The golf club head of claim 1, wherein said striking face comprises a first density, wherein said back portion comprises a back cover, wherein said back cover comprises a recess, wherein said second deformable member is at least partially retained within said recess, wherein said back cover comprises a second density, wherein said first density is greater than said second density.

8. The golf club head of claim 1, wherein said center of gravity of said golf club head is located less than or equal to 20 millimeters above said ground plane, measured parallel to said y-axis, and wherein said golf club head comprises an MOI-Y greater than or equal to 250 kg-mm$^2$.

9. A golf club head comprising:

a club head body comprising a back portion and a striking face;

wherein said striking face comprises a front surface configured to strike a golf ball and a rear surface opposite said front surface;

wherein said back portion is spaced from said rear surface;

a first deformable member residing between said back portion and said rear surface of said striking face;

wherein said first deformable member comprises a front surface in contact with said rear surface of said striking face; and a second deformable member residing between said back portion and said rear surface of said striking face;

wherein said second deformable member comprises a front surface in contact with said rear surface of said striking face;

wherein said first deformable member has a greater Shore A durometer than said second deformable member;

wherein said golf club head comprises an interior cavity formed between said back portion and said striking face, wherein an aperture is formed through said back portion, an adjustment driver residing within said aperture, said adjustment driver comprising a recess adjacent said interior cavity, wherein at least a portion of said first deformable member resides within said recess, wherein said back portion comprises a shelf surrounding said aperture and wherein said adjustment driver comprises a flange, said flange in contact with said shelf.

10. The golf club head of claim 9, wherein said striking face comprises a first density, wherein said back portion comprises a back cover, wherein said back cover comprises a recess, wherein said second deformable member is at least partially retained within said recess, wherein said back cover comprises a second density, wherein said first density is greater than said second density.

11. The golf club head of claim 9, wherein at least a portion of said striking face comprises a thickness of less than or equal to 2.2 mm.

12. The golf club head of claim 9, further comprising a coordinate system centered at a center of gravity of said golf club head, said coordinate system comprising a y-axis extending vertically, perpendicular to a ground plane when said golf club head is in an address position at prescribed loft and lie, an x-axis perpendicular to said y-axis and parallel to the striking face, extending towards a heel of said golf club head, and a z-axis, perpendicular to said y-axis and said x-axis and extending through said striking face, wherein said striking face comprises a plurality of scorelines, wherein said striking face comprises a heel reference plane extending parallel to said y-axis and said-x-axis, wherein said heel reference plane is offset 1 millimeter towards said heel from a heel-most extent of said scorelines, wherein said striking face comprises a striking face length measured from said heel reference plane to a toe-most extent of said front surface of said striking face parallel to said x-axis, wherein said rear surface of said striking face comprises a first supported region, wherein a perimeter of said front surface of said first deformable member defines said first supported region, wherein said first supported region comprises a first geometric center, wherein said first geometric center of said first supported region is located a first supported region offset length toeward from said heel reference plane measured parallel to said x-axis, wherein said rear surface of said striking face comprises a second supported region, wherein a perimeter of said front surface of said second deformable member defines said second supported region, wherein said second supported region comprises a second geometric center, wherein said second geometric center of said second supported region is located a second supported region offset length toeward from said heel reference plane measured parallel to said x-axis, wherein said first supported region offset length divided by said second supported region offset length is greater than 1.5.

13. A golf club head comprising:

a club head body comprising a back portion and a striking face;

wherein said striking face comprises a front surface configured to strike a golf ball and a rear surface opposite said front surface;

wherein said back portion is spaced from said rear surface;

a first deformable member residing between said back portion and said rear surface of said striking face;

wherein said first deformable member comprises a front surface in contact with said rear surface of said striking face; and a second deformable member residing between said back portion and said rear surface of said striking face;

wherein said second deformable member comprises a front surface in contact with said rear surface of said striking face;

wherein said first deformable member has a greater Shore A durometer than said second deformable member;

wherein said front surface of said first deformable member is circular having a front diameter, wherein said rear surface of said first deformable member is circular having a rear diameter, wherein said front diameter is less than said rear diameter, wherein said front surface of said second deformable member is circular having a front diameter, wherein said rear surface of said second deformable member is circular having a rear diameter, wherein said front diameter is less than said rear diameter.

14. A golf club head comprising:

a club head body comprising a back portion and a striking face;

wherein said striking face comprises a front surface configured to strike a golf ball and a rear surface opposite said front surface;

wherein said back portion is spaced from said rear surface;

a first deformable member residing between said back portion and said rear surface of said striking face;

wherein said first deformable member comprises a front surface in contact with said rear surface of said striking face; and a second deformable member residing between said back portion and said rear surface of said striking face;

wherein said second deformable member comprises a front surface in contact with said rear surface of said striking face;

wherein said back portion comprises a back cover;

wherein said back cover comprises a recess; and wherein said second deformable member is at least partially retained within said recess.

15. The golf club head of claim 14, wherein said striking face comprises a first density, wherein said back cover comprises a second density, wherein said first density is greater than said second density.

16. The golf club head of claim 14, wherein said first deformable member has a greater Shore A durometer than said second deformable member.

17. The golf club head of claim 14, wherein at least a portion of said striking face comprises a thickness of less than or equal to 2.2 mm.

18. The golf club head of claim 14, wherein said front surface of said first deformable member is circular having a front diameter, wherein said rear surface of said first deformable member is circular having a rear diameter, wherein said front diameter is less than said rear diameter, wherein said front surface of said second deformable member is circular having a front diameter, wherein said rear surface of said second deformable member is circular having a rear diameter, wherein said front diameter is less than said rear diameter.

19. The golf club head of claim 14, wherein said golf club head comprises an interior cavity formed between said back portion and said striking face, wherein an aperture is formed through said back portion, an adjustment driver residing within said aperture, said adjustment driver comprising a recess adjacent said interior cavity, wherein at least a portion of said first deformable member resides within said recess, wherein said back portion comprises a shelf surrounding said aperture and wherein said adjustment driver comprises a flange, said flange in contact with said shelf.

* * * * *